US010669146B2

(12) United States Patent
Bates et al.

(10) Patent No.: US 10,669,146 B2
(45) Date of Patent: Jun. 2, 2020

(54) ATTACHMENT AND SYSTEM FOR MIXING AND DISPENSING A CHEMICAL AND DILUENT

(71) Applicant: S. C. Johnson & Son, Inc., Racine, WI (US)

(72) Inventors: Julie L. Bates, Franklin, WI (US); Thomas A. Helf, New Berlin, WI (US); James R. Crapser, Racine, WI (US); Richard A. Batton, Racine, WI (US); Jeffrey L. Crull, McFarland, WI (US); Cunjiang Cheng, Madison, WI (US); Elizabeth Alstad, Madison, WI (US); Casey Frett, Madison, WI (US); Katlyn Garcia, McFarland, WI (US); Evan A. Sparks, Madison, WI (US); Joel Kramka, Madison, WI (US); Shawn Smith, Madison, WI (US); Joshua James Riley, St. Louis, MO (US); James Michael Schlueter, Defiance, MO (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 16/179,193

(22) Filed: Nov. 2, 2018

(65) Prior Publication Data

US 2019/0119094 A1 Apr. 25, 2019

Related U.S. Application Data

(63) Continuation of application No. 15/272,122, filed on Sep. 21, 2016, now Pat. No. 10,138,110.

(Continued)

(51) Int. Cl.
*B67D 3/00* (2006.01)
*B05B 15/62* (2018.01)

(Continued)

(52) U.S. Cl.
CPC ..... *B67D 3/0012* (2013.01); *B05B 7/2443* (2013.01); *B05B 12/088* (2013.01);

(Continued)

(58) Field of Classification Search
CPC .. B67D 3/0012; B67D 3/0061; B05B 7/2424; B05B 7/2443; B05B 12/088; B05B 15/063; B05B 15/62
See application file for complete search history.

(56) References Cited

U.S. PATENT DOCUMENTS

D14,328 S 9/1883 Moses
2,072,124 A 3/1937 Neuman (Continued)

FOREIGN PATENT DOCUMENTS

EP 0030081 B1 3/1983
EP 0130188 B1 12/1988

(Continued)

*Primary Examiner* — J C Jacyna

(57) ABSTRACT

A container can be configured for use with an attachment for mixing and dispensing a solution. The container can include an outlet opening for flow out of the container, and a container valve that is configured to control the flow out of the outlet opening. A neck of the container can be oblong, can include a first attachment flange and a second attachment flange, or can include a first attachment shelf and a second attachment shelf.

18 Claims, 40 Drawing Sheets

Related U.S. Application Data

(60) Provisional application No. 62/221,442, filed on Sep. 21, 2015, provisional application No. 62/354,369, filed on Jun. 24, 2016.

(51) Int. Cl.
*B05B 7/24* (2006.01)
*B05B 12/08* (2006.01)
*B05B 15/63* (2018.01)

(52) U.S. Cl.
CPC ..... *B05B 15/62* (2018.02); *B05B 15/63* (2018.02); *B67D 3/0061* (2013.01)

(56) References Cited

U.S. PATENT DOCUMENTS 2,198,998 A 4/1940 Honsberger
2,246,211 A 6/1941 Kilich
2,302,799 A 11/1942 Peterson
2,310,633 A 2/1943 Heimburger
2,388,445 A 11/1945 Stewart
2,507,410 A 5/1950 Kemp
2,536,361 A 1/1951 Flanders
2,592,896 A 4/1952 Hayes
2,624,619 A 1/1953 Fletcher
2,808,182 A 10/1957 Furedi
2,812,113 A 11/1957 Beall, Jr.
2,827,329 A 3/1958 Bullock
3,032,275 A 5/1962 Schneider
3,060,956 A 10/1962 Menzie
3,142,320 A 7/1964 Olson
3,168,221 A 2/1965 Parker
3,180,580 A 4/1965 Schedel
D202,986 S 11/1965 Halaby, Sr. et al.
3,376,991 A 4/1968 Deaver
3,447,753 A 6/1969 Proctor
3,770,205 A 11/1973 Proctor et al.
3,863,843 A 2/1975 Hechler, IV
3,933,179 A 1/1976 Hechler, IV
3,984,021 A * 10/1976 Uhlig ..... B65D 50/046 215/216
4,014,363 A 3/1977 Hechler, IV
4,029,299 A 6/1977 Hechler, IV
RE29,405 E 9/1977 Gunzel, Jr. et al.
4,127,913 A 12/1978 Monson
4,142,681 A 3/1979 Hechler, IV
4,247,046 A 1/1981 Hechler, IV
4,333,203 A 6/1982 Yonkers
4,385,034 A 5/1983 Gacer
4,475,689 A 10/1984 Hauger et al.
4,508,272 A 4/1985 Thompson
4,512,955 A 4/1985 Etani
4,527,740 A 7/1985 Gunzel, Jr. et al.
4,558,484 A 12/1985 Groth
4,566,149 A 1/1986 Fitzwater
4,901,923 A 2/1990 McRoskey et al.
4,938,421 A 7/1990 Berfield et al.
5,037,003 A 8/1991 Bally et al.
5,083,677 A 1/1992 Bally et al.
5,089,854 A * 2/1992 Kaieda ..... G03G 15/0855 141/346
5,147,615 A 9/1992 Bird et al.
5,228,598 A 7/1993 Bally et al.
5,303,729 A 4/1994 DeMarco
5,372,310 A 12/1994 Ketcham
D355,852 S 2/1995 Wicki
5,425,404 A * 6/1995 Dyer ..... B67D 3/0012 141/351
5,544,810 A 8/1996 Horvath, Jr. et al.
5,595,345 A 1/1997 Chura et al.
5,765,605 A 6/1998 Waymire et al.
5,839,474 A 11/1998 Greaney
5,850,973 A 12/1998 Liljeqvist et al.
5,862,948 A 1/1999 Duchon et al.
5,954,240 A 9/1999 Duchon et al.
5,954,272 A 9/1999 Liao
5,988,912 A 11/1999 Chen
6,012,650 A 1/2000 Hadar
D419,871 S 2/2000 Hall et al.
6,029,720 A * 2/2000 Swinford ..... F16K 1/123 137/625.66
6,036,057 A 3/2000 Poutiatine
6,116,798 A 9/2000 Chen et al.
6,126,089 A 10/2000 Williamson et al.
6,129,125 A 10/2000 Duchon et al.
6,138,873 A 10/2000 Gramola
6,453,935 B1 9/2002 Gilmore
D466,584 S 12/2002 Hubmann et al.
D468,801 S 1/2003 Hubmann et al.
6,546,949 B1 4/2003 Gilmore
D474,256 S 5/2003 Hubmann et al.
6,578,776 B1 6/2003 Shanklin et al.
6,588,615 B1 7/2003 Pitassi
6,604,546 B1 8/2003 Gilmore
D480,124 S 9/2003 Hubmann et al.
6,619,318 B2 9/2003 Dalhart et al.
D482,793 S 11/2003 Oyama et al.
D483,270 S 12/2003 Bertucci et al.
6,659,128 B2 12/2003 Gilmore
6,659,311 B2 12/2003 Prueter
D484,946 S 1/2004 Hubmann et al.
6,672,520 B2 1/2004 Shanklin et al.
6,708,901 B2 3/2004 Hubmann et al.
6,715,643 B1 4/2004 Kelly
6,719,216 B2 4/2004 Hubmann et al.
6,772,914 B2 8/2004 Hubmann et al.
D496,278 S 9/2004 Bertucci et al.
6,805,149 B1 10/2004 Gilmore
6,827,293 B2 12/2004 Seeman
6,913,209 B2 7/2005 Shanklin et al.
6,932,229 B2 8/2005 Pitassi
D509,560 S 9/2005 Hubmann et al.
6,988,675 B2 1/2006 Hubmann et al.
D514,447 S 2/2006 Bertucci et al.
7,025,289 B2 4/2006 Hubmann et al.
7,086,610 B2 8/2006 Hubmann et al.
D528,917 S 9/2006 Bertucci et al.
7,100,843 B2 9/2006 Boticki et al.
7,152,626 B1 12/2006 Lang et al.
7,168,635 B2 1/2007 Amaduzzi
D537,915 S 3/2007 Hubmann et al.
7,188,786 B2 3/2007 Dodd
7,237,728 B1 7/2007 Laible
7,258,250 B2 8/2007 Baudin
D555,227 S 11/2007 Hubmann et al.
7,293,584 B1 11/2007 Hubmann
7,296,761 B1 11/2007 Laible
7,341,206 B2 3/2008 Hubmann et al.
7,341,207 B2 3/2008 Hubmann
D567,084 S 4/2008 Batton et al.
D569,254 S 5/2008 Moretti
D569,727 S 5/2008 Moretti
7,370,813 B2 5/2008 Hubmann et al.
D571,216 S 6/2008 Christian et al.
7,407,117 B2 8/2008 Dodd
7,513,442 B2 4/2009 Dodd
D593,863 S 6/2009 Fahy et al.
D602,117 S 10/2009 Fontaine
D602,120 S 10/2009 Reimann et al.
D604,385 S 11/2009 Fontaine
7,631,783 B1 12/2009 Laible
7,661,604 B1 2/2010 MacLean-Blevins
7,703,703 B2 4/2010 Gavin
7,850,095 B2 12/2010 Hubmann et al.
7,854,354 B2 12/2010 Laible
D633,175 S 2/2011 Swain et al.
D633,807 S 3/2011 Fahy et al.
7,938,299 B2 5/2011 Fahy et al.
7,942,346 B2 5/2011 Faupel
D640,349 S 6/2011 Swain et al.
8,016,212 B2 9/2011 Hubmann et al.
8,069,878 B2 12/2011 Laible
D654,985 S 2/2012 Swain et al.

(56) References Cited

U.S. PATENT DOCUMENTS

| | | | |
|---|---|---|---|
| D655,172 | S | 3/2012 | Brooks et al. |
| 8,177,143 | B2 | 5/2012 | Laible |
| D668,744 | S | 10/2012 | Swain et al. |
| 8,398,003 | B2 | 3/2013 | Hubmann et al. |
| 8,403,183 | B2 | 3/2013 | Fahy et al. |
| 8,434,699 | B2 | 5/2013 | Faupel |
| 8,622,320 | B2 | 1/2014 | Plantz et al. |
| D700,948 | S | 3/2014 | McGiveron |
| 8,662,358 | B2 | 3/2014 | Hague et al. |
| 8,668,117 | B2 | 3/2014 | Crossdale et al. |
| D704,554 | S | 5/2014 | Baird |
| 8,726,939 | B2 | 5/2014 | Laible |
| D710,198 | S | 8/2014 | Blowfield et al. |
| 8,820,661 | B2 | 9/2014 | Clarke |
| 8,870,094 | B2 | 10/2014 | Hubmann et al. |
| 8,998,042 | B2 | 4/2015 | Hague et al. |
| 8,998,111 | B2 | 4/2015 | Sun |
| 9,062,777 | B2 | 6/2015 | Shanklin et al. |
| D733,569 | S | 7/2015 | Martinon |
| 9,199,256 | B2 | 12/2015 | Jia et al. |
| 9,227,212 | B2 | 1/2016 | Crossdale et al. |
| 9,302,283 | B2 | 4/2016 | Plantz et al. |
| 10,138,110 | B2 * | 11/2018 | Bates ..... B67D 3/0012 |
| 2006/0109736 | A1 | 5/2006 | Neto |
| 2006/0186075 | A1 | 8/2006 | Rainey et al. |
| 2008/0197214 | A1 | 8/2008 | Hubmann |
| 2009/0224072 | A1 | 9/2009 | Clarke |
| 2010/0193606 | A1 | 8/2010 | Gavin |
| 2011/0095047 | A1 | 4/2011 | Hubmann et al. |
| 2012/0223161 | A1 | 9/2012 | Goodwin et al. |
| 2013/0126640 | A1 | 5/2013 | Hubmann et al. |
| 2013/0193226 | A1 | 8/2013 | Uschold et al. |
| 2013/0206868 | A1 | 8/2013 | Laffey |
| 2013/0233943 | A1 | 9/2013 | Janik et al. |
| 2014/0261798 | A1 | 9/2014 | Wang |
| 2014/0263417 | A1 | 9/2014 | Hanson et al. |
| 2014/0367489 | A1 | 12/2014 | Clarke |
| 2015/0102131 | A1 | 4/2015 | Goodwin et al. |
| 2015/0190825 | A1 | 7/2015 | Arminak et al. |
| 2015/0224523 | A1 | 8/2015 | Sun |

FOREIGN PATENT DOCUMENTS

| | | | |
|---|---|---|---|
| EP | 0467513 | B1 | 8/1994 |
| EP | 0526593 | B1 | 9/1996 |
| EP | 0876199 | B1 | 4/2002 |
| EP | 0828567 | B1 | 10/2002 |
| EP | 0961755 | B1 | 3/2004 |
| EP | 0867230 | B1 | 5/2004 |
| EP | 1391388 | B1 | 4/2005 |
| EP | 1034132 | B1 | 8/2005 |
| EP | 1353756 | B1 | 6/2006 |
| EP | 1675689 | B1 | 1/2007 |
| EP | 1451077 | B1 | 2/2007 |
| EP | 1663500 | B1 | 11/2007 |
| EP | 1420868 | B1 | 1/2008 |
| EP | 1874482 | A2 | 1/2008 |
| EP | 1879701 | A2 | 1/2008 |
| EP | 2002167 | A1 | 12/2008 |
| EP | 2155575 | A1 | 2/2010 |
| EP | 1773504 | B1 | 4/2010 |
| EP | 1352690 | B1 | 6/2010 |
| EP | 1716930 | B1 | 3/2011 |
| EP | 1827708 | B1 | 2/2012 |
| EP | 1645335 | B1 | 4/2012 |
| EP | 2531415 | A2 | 12/2012 |
| EP | 2077916 | B1 | 1/2013 |
| EP | 2897739 | A1 | 7/2015 |
| WO | 8402286 | A1 | 6/1984 |
| WO | 9116138 | A1 | 10/1991 |
| WO | 9637261 | A1 | 11/1996 |
| WO | 9707049 | A2 | 2/1997 |
| WO | 0062910 | A2 | 10/2000 |
| WO | 0119696 | A1 | 3/2001 |
| WO | 02055213 | A2 | 7/2002 |
| WO | 03004127 | A1 | 1/2003 |
| WO | 03027000 | A2 | 4/2003 |
| WO | 03042056 | A1 | 5/2003 |
| WO | 2004016953 | A1 | 2/2004 |
| WO | 2004109121 | A1 | 12/2004 |
| WO | 2005023432 | A1 | 3/2005 |
| WO | 2005025755 | A1 | 3/2005 |
| WO | 2006007035 | A1 | 1/2006 |
| WO | 2006050061 | A2 | 5/2006 |
| WO | 2006068965 | A2 | 6/2006 |
| WO | 2006089620 | A1 | 8/2006 |
| WO | 2006115865 | A2 | 11/2006 |
| WO | 2007109384 | A1 | 9/2007 |
| WO | 2007146667 | A2 | 12/2007 |
| WO | 2008057393 | A2 | 5/2008 |
| WO | 2008118446 | A2 | 10/2008 |
| WO | 2008154498 | A1 | 12/2008 |
| WO | 2009103078 | A2 | 8/2009 |
| WO | 2010030578 | A2 | 3/2010 |
| WO | 2010147657 | A2 | 12/2010 |
| WO | 2011097177 | A2 | 8/2011 |
| WO | 2011112711 | A2 | 9/2011 |
| WO | 2012128908 | A2 | 9/2012 |
| WO | 2013169276 | A1 | 11/2013 |
| WO | 2014046961 | A1 | 3/2014 |

* cited by examiner

ATTACHMENT AND SYSTEM FOR MIXING AND DISPENSING A CHEMICAL AND DILUENT

CROSS REFERENCE TO RELATED APPLICATIONS

This application is a continuation of U.S. patent application Ser. No. 15/272,122, which was filed on Sep. 21, 2016 and which claims priority to U.S. Provisional Patent Application No. 62/354,369, which was filed on Jun. 24, 2016, and to U.S. Provisional Patent Application No. 62,221,442, which was filed on Sep. 21, 2015, all of which are incorporated herein by reference.

STATEMENT REGARDING FEDERALLY SPONSORED RESEARCH

Not Applicable.

BACKGROUND OF THE INVENTION

1. Field of the Invention

The invention relates to a system for mixing a chemical with a diluent and dispensing a mixture of the chemical and the diluent.

2. Description of the Related Art

Various conventional devices allow chemicals to be mixed with a diluent or carrier fluid, then dispensed for cleaning or other activities. For example, U.S. Patent Application Publication No. US 2014/0061233 describes a handheld device configured to receive a diluent reservoir and a separate chemical reservoir. Actuation of a pump mechanism causes the chemical and the diluent to be drawn from the respective reservoirs, mixed within the device, then dispensed from a spray nozzle.

It may be useful to provide an alternative system that can accept a container having a concentrated chemical and be connected to a conduit for conveying diluent from an external source, create a mixture of the chemical and the diluent, and dispense the diluted concentrate through an outlet port.

SUMMARY

The foregoing needs can be met with a fluid application system according to the present disclosure. For example, a fluid mixing and dispensing system can mix a chemical with a diluent and dispense a mixture of the chemical and the diluent through an outlet port.

In one aspect, a system for mixing and dispensing a solution includes a body with a first flow passage extending between a diluent inlet and an outlet, and a second flow passage extending between a concentrate inlet and the first flow passage. The system further includes a container for concentrate, with the container including a container valve. Moving the body axially toward the container to seat the body on the container opens the container valve for a flow of concentrate from the container to the first flow passage via the second flow passage. Further, moving the body axially away from the container to unseat the body from the container closes the container valve to the flow of concentrate.

In a different aspect, a system for mixing and dispensing a solution, for use with a container that includes concentrate and a container valve, includes a unitary attachment including a body with a mixing chamber, a diluent inlet, a concentrate inlet, and a mixture outlet. The body further includes a first flow passage that tapers inwardly between the diluent inlet and the mixing chamber, a second flow passage that extends from the concentrate inlet to the mixing chamber, and a third flow passage that extends from the mixing chamber to the mixture outlet. The unitary attachment is configured to move solely axially toward the container to seat the body on the container and open the container valve for a flow of concentrate from the container to the mixing chamber via the concentrate inlet and the second flow passage. Further, the unitary attachment is configured to move solely axially away from the container to unseat the body from the container and close the container valve to the flow of concentrate.

In another aspect, a method for directing use of a mixing and dispensing system includes providing a mixing and dispensing system that includes a unitary body with a diluent inlet, a concentrate inlet, a mixing chamber, and an outlet. The method further includes providing a container that includes concentrate and a valve to regulate flow of concentrate out of the container. The method further includes providing instructions to a user for dispensing a solution from the mixing and dispensing system, which include the steps of moving the unitary body in a single direction toward the container, with the concentrate inlet aligned with the valve, to temporarily seat the unitary body on the container and temporarily open the valve, connecting an external diluent source to the diluent inlet, and initiating flow of diluent from the external diluent source into the diluent inlet. The unitary body and the container are configured so that the step of initiating the flow of the diluent into the diluent inlet automatically causes a flow of the concentrate from the container to the mixing chamber, a mixing of the concentrate and the diluent in the mixing chamber to provide the solution, and a dispensing of the solution from the unitary body.

In yet another aspect, a container can be configured for use with an attachment for mixing and dispensing a solution. The container can include an outlet opening for flow out of the container, a container valve that is configured to control the flow out of the outlet opening, and an oblong neck. The oblong neck can include a first attachment flange and a second attachment flange that are configured to secure the attachment to the container.

In still another aspect, a container can be configured for use with an attachment for mixing and dispensing a solution, with the attachment including a first hook and a second hook. The container can include a neck with an outlet opening for flow out of the container, a container valve that is configured to control the flow out of the outlet opening, a first attachment flange that at least partly defines a first attachment groove to receive the first hook, and a second attachment flange that at least partly defines a second attachment groove to receive the second hook. The first and second attachment flanges can extend a first distance from the outlet opening at first opposing sides of the neck. The first and second attachment flanges can extend a second distance from the outlet opening at second opposing sides of the neck, the second distance being smaller than the first distance.

In an additional aspect, a container can be configured for use with an attachment for mixing and dispensing a solution. The container can include an outlet opening for flow out of the container, a container valve that is configured to control the flow out of the outlet opening, and a neck that defines a first attachment shelf and a second attachment shelf. The first and second attachment shelves can define a first container width along a first axis of the neck and a second container width, smaller than the first container width, along a second axis of the neck.

These and other features, aspects, and advantages of the present invention will become better understood upon consideration of the following detailed description and drawings.

BRIEF DESCRIPTION OF THE DRAWINGS

Like reference numerals will be used to refer to like parts from FIG. to FIG. in the following detailed description.

DETAILED DESCRIPTION OF THE INVENTION

As used herein, unless otherwise limited or defined, "upstream" and "downstream" indicate direction with respect to a flow of liquid along a flow path during normal operation of the relevant system or device. Unless otherwise noted, it will be understood that such terms are not intended to limit the possible directions of flow along any particular flow path.

Also as used herein, unless otherwise limited or defined, directional indicators such as "top," "bottom," "right," "left," "clockwise," and "counterclockwise" are used for convenience only, with respect to the orientation of the relevant system or device in the relevant figure or figures. Unless otherwise noted, it will be understood that such terms are not intended to exclude alternative (e.g., reversed or upended) orientations.

As used herein to designate motion, unless otherwise limited or defined, the terms "clockwise" and "counterclockwise" indicate motion with and against, respectively, the normal movement of analog clock arms. As used herein to designate relative disposition of structural features, unless otherwise limited or defined, the term "clockwise" indicates a feature that can be reached by traveling counterclockwise along a reference structure or line. For example, a clockwise end of a groove extending 180 degrees around a cylinder is the end reached by traveling counterclockwise along the groove (i.e., the end from which clockwise travel along the groove is possible). Similarly, as used herein to designate relative disposition of structural features, unless otherwise limited or defined, the term "counterclockwise" indicates a feature that can be reached by traveling clockwise along a reference structure or line. For example, a counterclockwise end of a groove extending 180 degrees around a cylinder is the end reached by traveling clockwise along the groove (i.e., the end from which counterclockwise travel along the groove is possible).

Figure 1:
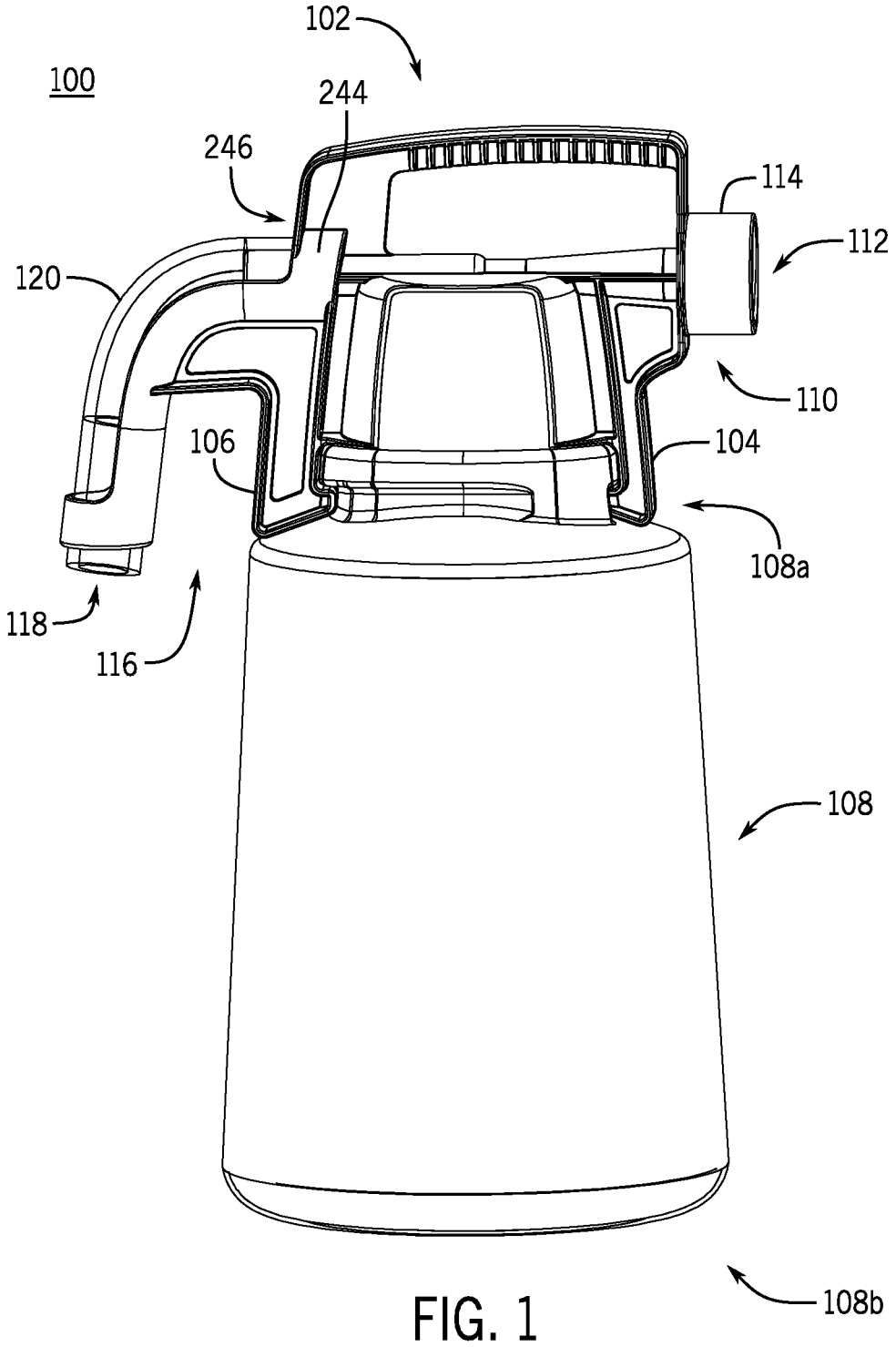
FIG. 1 is a left perspective view of one embodiment of a mixing and dispensing system in accordance with the present disclosure, including a chemical concentrate container and a mixing and dispensing attachment.
Figure 2:
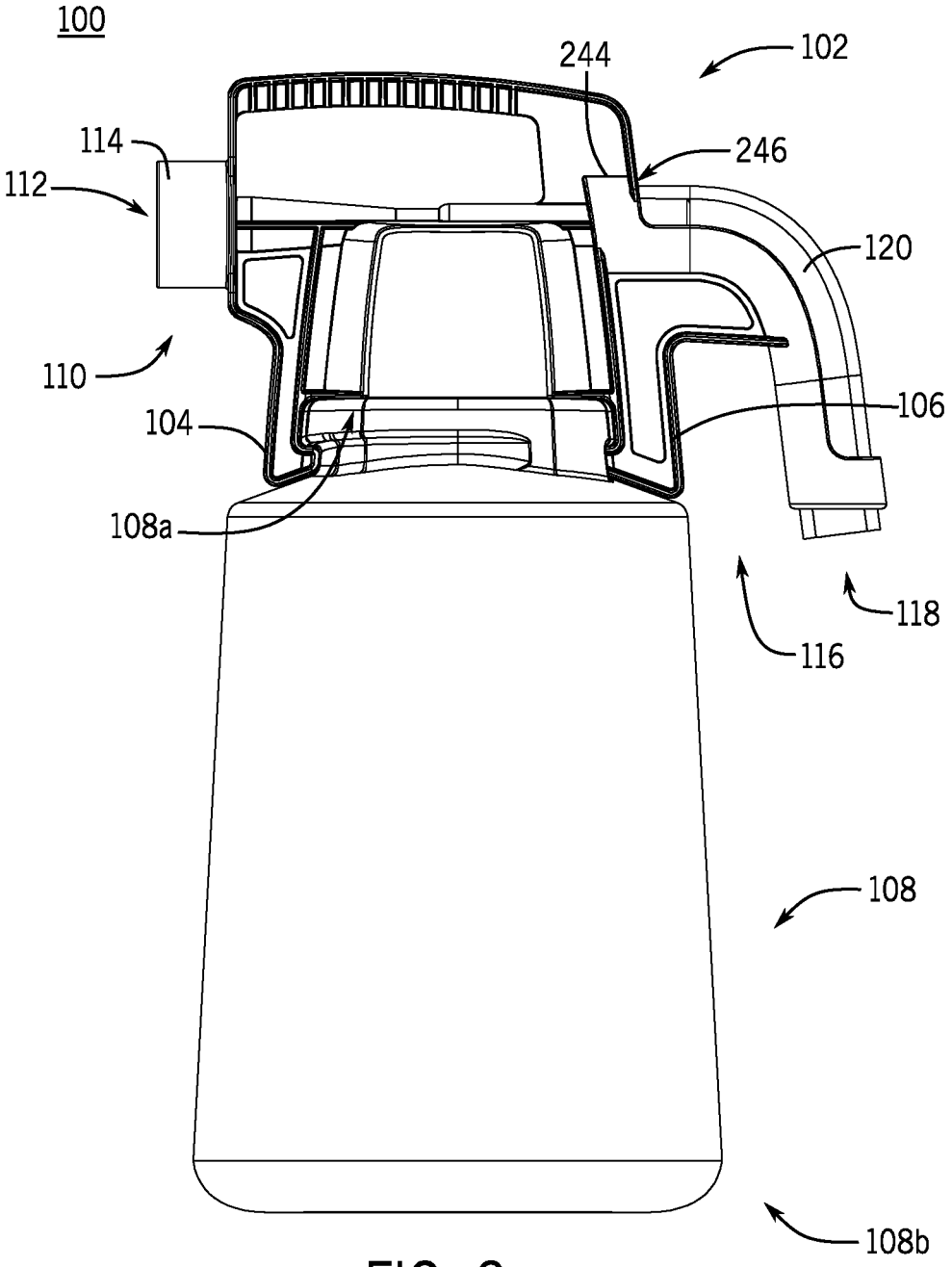
FIG. 2 is right elevational view of the system of FIG. 1.

FIGS. 1 and 2 illustrate an example system 100 for mixing and dispensing cleaning solution (or other solutions), according to one aspect of this disclosure. The mixing and dispensing system 100 includes a mixing and dispensing attachment 102 configured as a unitary body. The attachment 102 includes attachment arms 104 and 106 configured to securely, but removably, attach the attachment 102 to a top end 108*a* of a chemical concentrate container 108. A diluent, such as liquid water, is received at an inlet end 110 of the attachment 102 from a remotely disposed source, via an inlet port 112 surrounded by an inlet socket 114. The diluent travels from the inlet port 112 through the attachment 102, where the diluent is mixed with chemical concentrate drawn from the container 108. The resulting mixture of diluent and chemical concentrate is then dispensed from an outlet end 116 of the attachment 102, via an outlet port 118 in a dispensing tube 120.

The chemical concentrate contained by the container 108 (also, herein, simply "concentrate") can be selected such that when the concentrate is diluted with the diluent, any number of different fluid products is formed. Non-limiting example products include general purpose cleaners, kitchen cleaners, bathroom cleaners, dust inhibitors, dust removal aids, floor and furniture cleaners and polishes, glass cleaners, anti-bacterial cleaners, fragrances, deodorizers, disinfectants, soft surface treatments, fabric protectors, laundry products, fabric cleaners, fabric stain removers, tire cleaners, dash-board cleaners, automotive interior cleaners, other automotive industry cleaners or polishes, insecticides and/or insect repellants.

Figure 3:
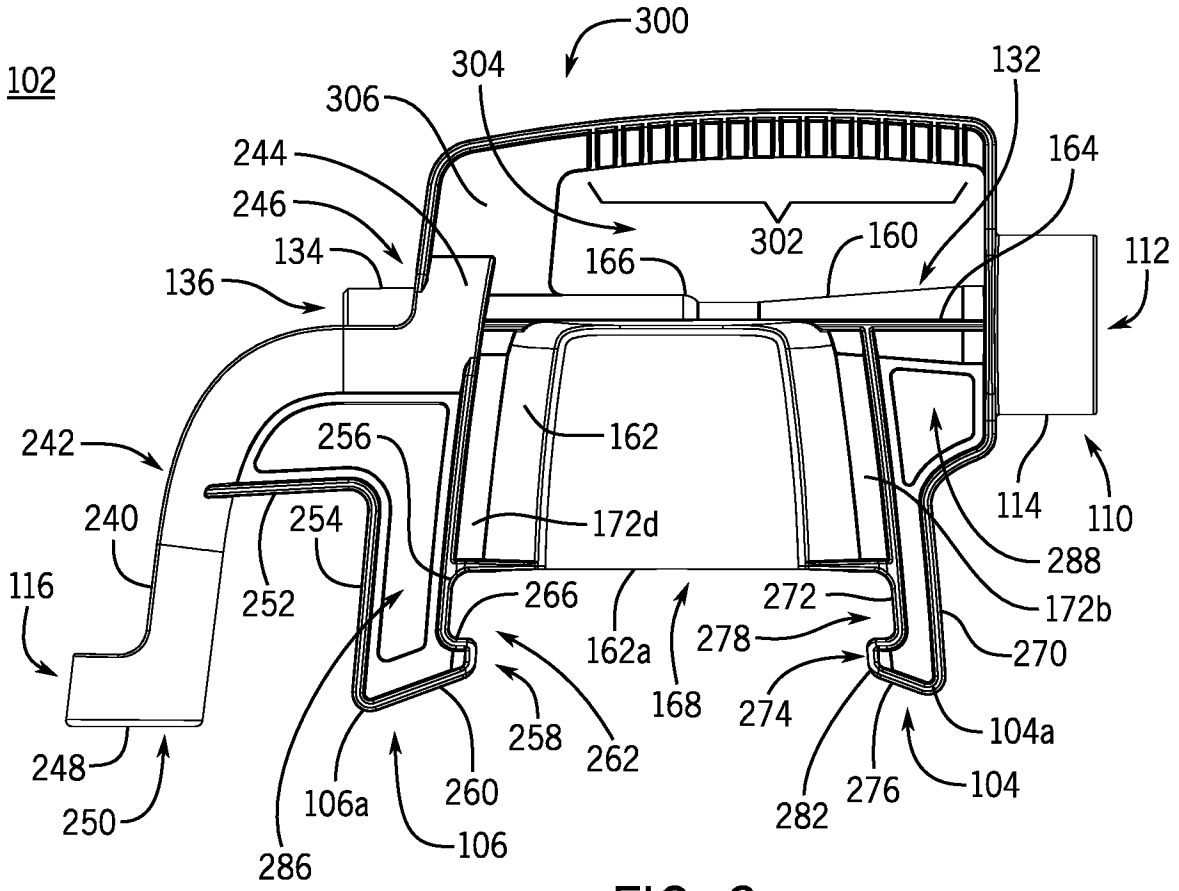
FIG. 3 is a left elevational view of the mixing and dispensing attachment of FIG. 1.
Figure 4:
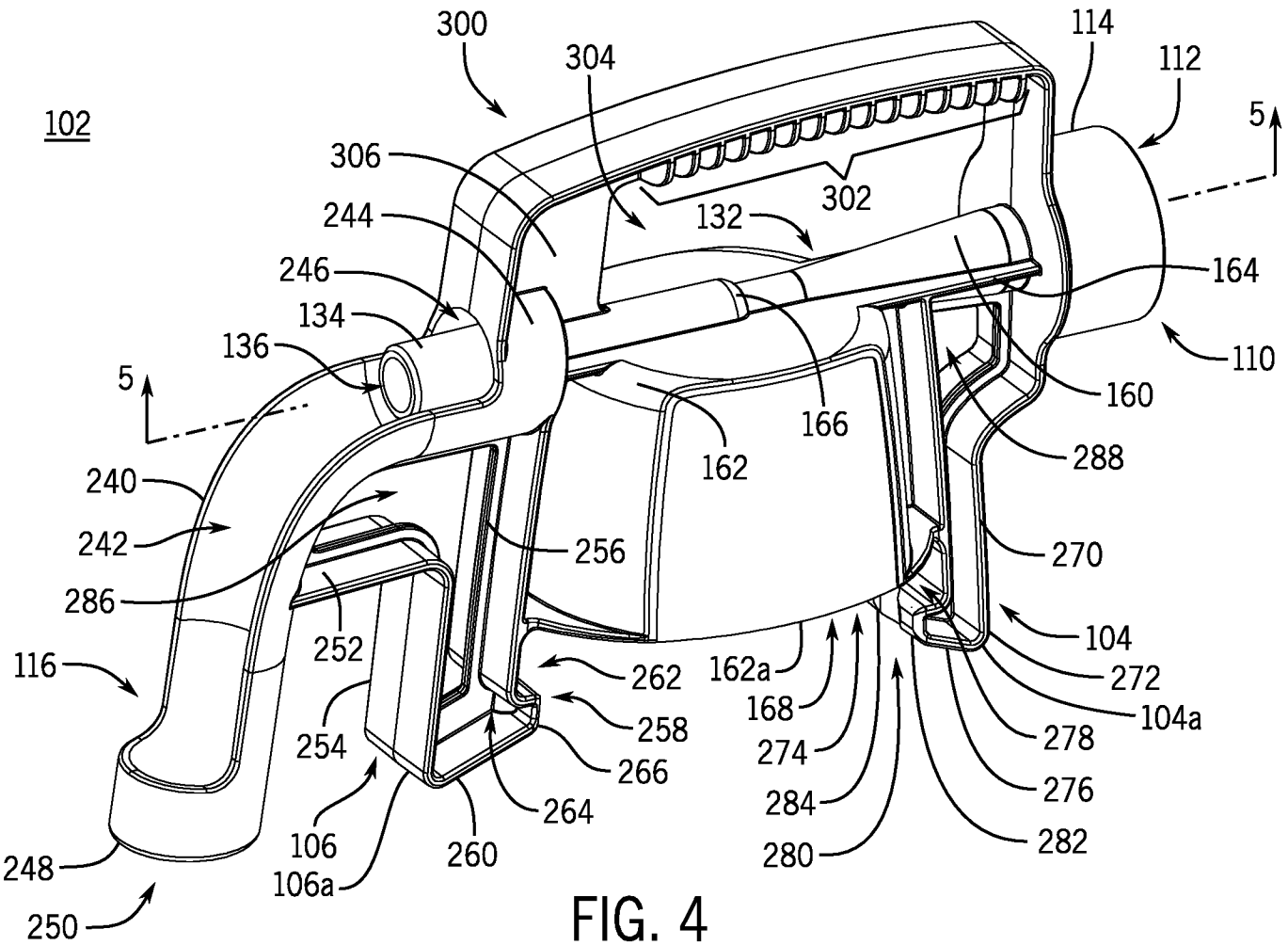
FIG. 4 is top, left, front perspective view of the mixing and dispensing attachment of FIG. 1.
Figure 5:
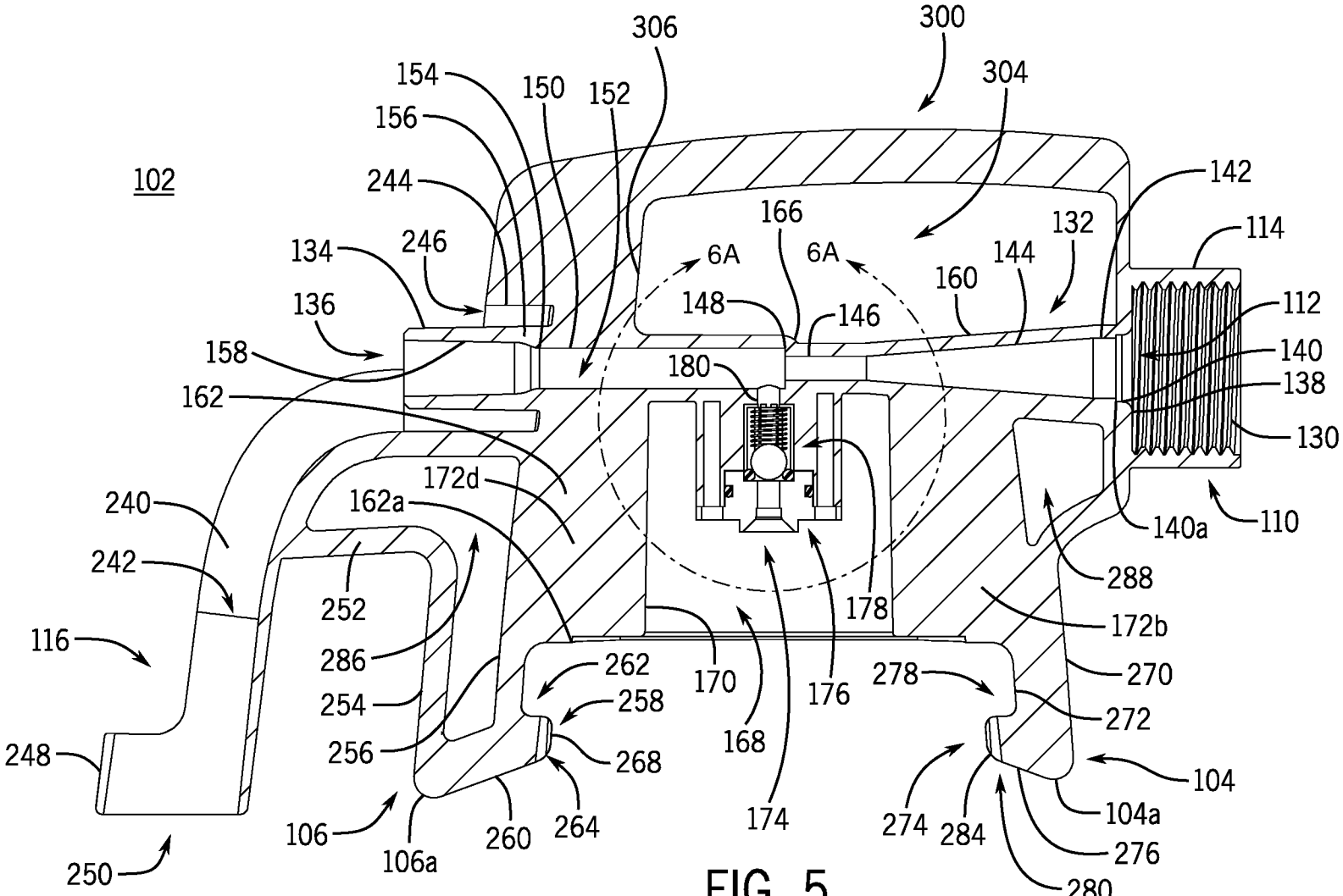
FIG. 5 is a cross-sectional view of the mixing and dispensing attachment of FIG. 1, taken along line 5-5 of FIG. 4.

FIGS. 3 through 5 and FIG. 7 illustrate various details of the construction of the mixing and dispensing attachment 102. As illustrated in FIG. 5, the inlet socket 114 surrounding the inlet port 112 includes internal threads 130 configured to receive complimentary threads on a diluent conduit, such as a flexible hose with a threaded end (not shown). In this way, for example, a diluent such as liquid water can be easily directed from an external source (e.g., a faucet) to the attachment 102 using a hose or other conduit. In the embodiment depicted, the inlet socket 114 can be integrally formed with the attachment 102. In other embodiments, the inlet socket 114 can be separately formed, such that the socket 114 can rotate to screw onto the threaded end of a conduit. In some embodiments, other types of connection devices can be used to attach a diluent conduit to the attachment 102, including snap-fit connection devices, quick-release fittings, or others.

The inlet port 112 is disposed within the socket 114 at the downstream end of the threads 130, and is generally in communication with a primary flow passage 132. The flow passage 132 extends from the inlet port 112 to a cylindrical end coupling 134 that defines a cylindrical flow passage outlet 136. Immediately downstream of the inlet port 112, the flow passage 132 includes an inwardly tapering channel 138, ending in an annular groove 140 defining a shoulder 140*a*. As discussed below, the tapered channel 138 and annular groove 140 of the flow passage 132 (as well as the interior of the socket 114) can be configured to receive inserts or fittings, such as flow restrictors or backflow preventers.

Downstream of the shoulder 140*a*, the flow passage 132 includes a cylindrical channel 142, followed by an extended, inwardly tapered channel 144, and another generally cylindrical channel 146 of generally smaller diameter than the cylindrical channel 142. At a downstream end of the cylindrical channel 146, a shoulder 148 marks an expansion of the flow passage 132 to a cylindrical channel 150 of somewhat wider diameter, which generally defines a mixing chamber 152. The cylindrical channel 150 (and mixing chamber 152) transition, at a downstream end, through successive outwardly tapered portions 154 and 156, to an outlet channel 158 of the flow passage 132 that is surrounded by the end coupling 134.

In some embodiments, the flow passage 132 can be disposed such that a portion of the exterior walls of the flow passage 132 is visible from the exterior of the attachment 102. As illustrated in FIGS. 3 through 5, for example, an outer wall 160 of the flow passage 132 extends generally above a body 162 of the attachment 102, as well as to the front and rear of the body 162 (i.e., to the left and right of the body 162, from the perspective of FIG. 3). In this regard, various ribs or other structures (e.g., a rib 164) can be provided to assist in supporting and strengthening the flow passage 132. Such ribs or other structures can be internal or external structures, with regard to the supported feature, or can be disposed both internally and externally.

In some embodiments, the contours of the outer wall 160 can generally reflect the interior contours of the flow passage 132. In some embodiments, however, aspects of the outer wall 160 can deviate from the interior contours of the flow passage 132, including for structural, aesthetic, ergonomic or other reasons. For example, in the embodiment depicted, the outer wall 160 includes a generally rounded expansion portion 166 corresponding to the stepped internal shoulder 148 (see, e.g., FIG. 5).

The flow passage 132 is configured as a venturi tube, tending to positively accelerate fluid as the fluid moves from the inlet port 112 toward the mixing chamber 152. By principles of conservation of energy, the resulting increase in velocity of the fluid reduces the local pressure of the fluid as the fluid approaches the mixing chamber 152. As described below, this reduction in pressure can be exploited to draw concentrated chemicals into the diluent for mixing within the mixing chamber 152.

Figure 7:
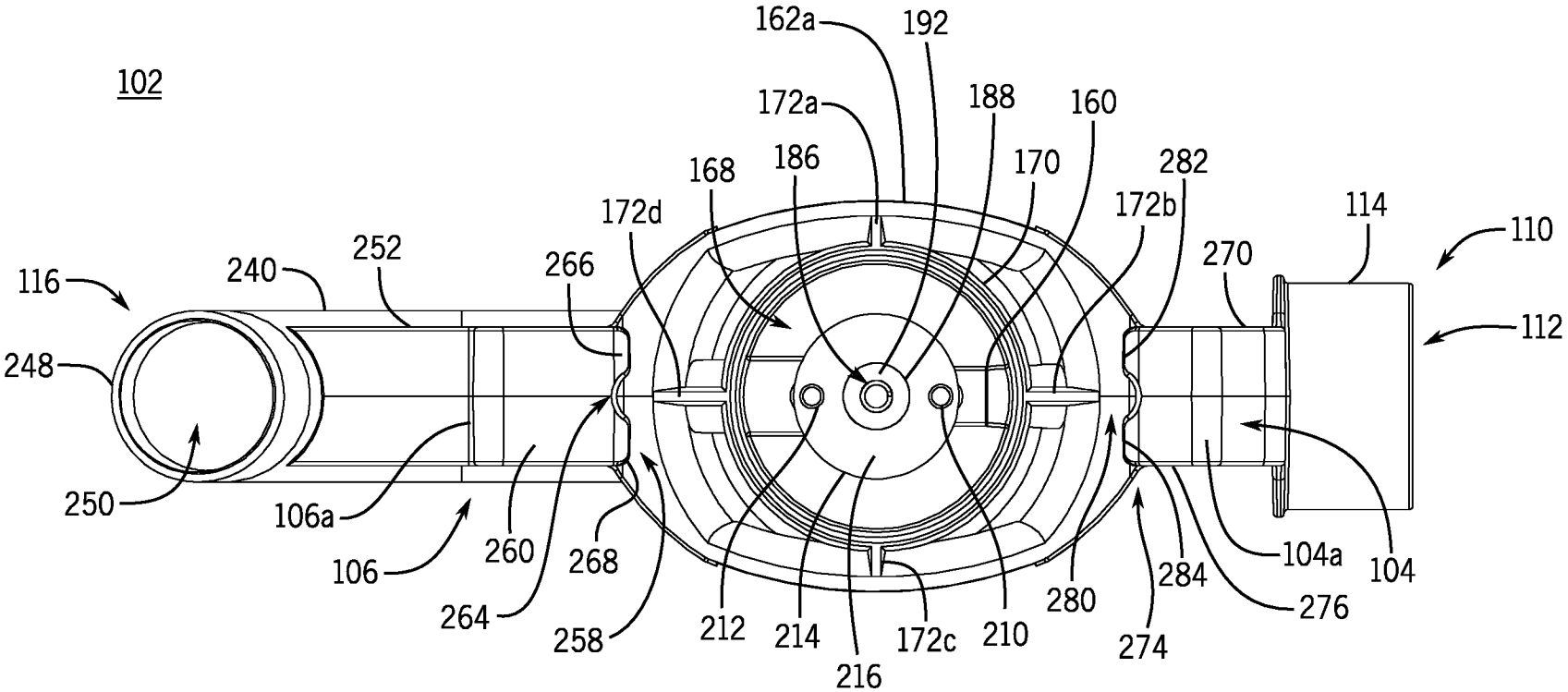
FIG. 7 is a bottom plan view of the mixing and dispensing attachment of FIG. 1.

To help receive concentrated chemicals, and as illustrated in particular in FIGS. 5 and 7, the body 162 of the attachment 102 contains a generally cylindrical bore 168, defined by a cylindrical shell 170 that is supported with respect to the body 162 by various ribs 172*a* through 172*d*. Within the bore 168, and supported by the body 162, is a concentrate receiving assembly 174 for directing and regulating a flow of concentrate from the container 108 to the mixing chamber 152. As also discussed below, the receiving assembly 174 can generally include an inlet assembly for initially receiving the flow of concentrate (e.g., an inlet assembly 176), one or more valve assemblies for regulating the flow of concentrate (e.g., a valve assembly 178), and a connecting flow passage (e.g., a connecting flow passage 180) to direct the concentrate into the mixing chamber 152.

Generally, therefore, when the attachment 102 is in communication with an appropriate source (e.g., the container 108), concentrate can enter the receiving assembly 174 via the inlet assembly 176, flow from the inlet assembly 176 through the valve assembly 178, and then pass along the flow passage 180 to the mixing chamber 152. Within the mixing chamber 152, the concentrate mixes with diluent moving along the flow passage 132 (i.e., as received via the inlet port 112). The resulting mixture of diluent and concentrate is then directed toward the outlet port 136 (e.g., via the outlet channel 158 of the flow passage 132 and the dispensing tube 120 (see, e.g., FIG. 1)) for use external to the attachment 102.

Figure 6A:
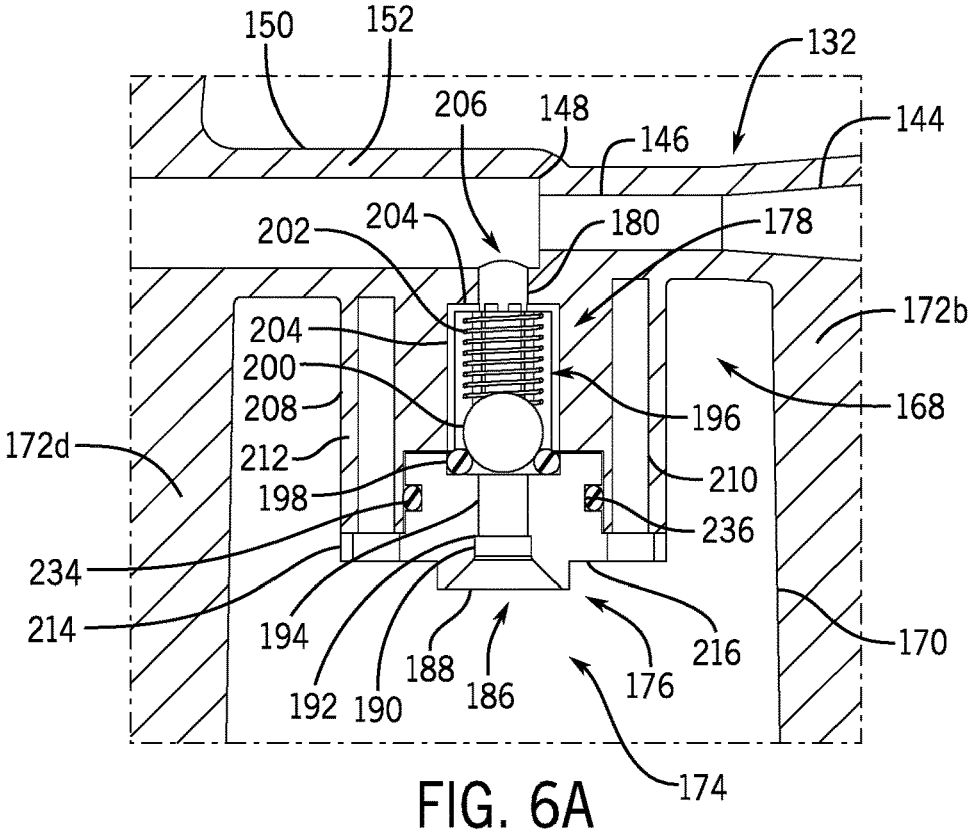
FIG. 6A is an enlarged view of the region 6A-6A of FIG. 5.

FIG. 6A illustrates an example configuration for the concentrate receiving assembly 174. Generally, the concentrate receiving assembly 174 can be configured so that when the attachment 102 is moved axially toward a concentrate container (i.e., downward, from the perspective of FIG. 6A), the receiving assembly 174 can cause a valve of the concentrate container to open, so that concentrate can flow through the receiving assembly 174 to the mixing chamber 152. In the embodiment depicted in FIG. 6A, the inlet assembly 176 includes an inlet opening 186 at the downstream end of an inwardly tapered inlet 188. Moving downstream through the inlet assembly 176, the tapered inlet 188 transitions to a cylindrical bore 190, which is separated by a shoulder 192 from a cylindrical flow passage 194. As also described below, the tapered inlet 188 can help to guide a valve stem of a valve assembly of the container 108 into the inlet assembly 176, and the cylindrical bore 190 and the shoulder 192 can help to retain the valve stem within the inlet assembly 176 while also providing a seal against concentrate leakage.

At the downstream end (i.e., upper end, as illustrated in FIG. 6A) of the inlet assembly 176, the cylindrical flow passage 194 opens into an inner chamber 196 of the valve assembly 178. In the embodiment depicted, the valve assembly 178 is configured as a spring-biased check valve, with an inlet o-ring 198, a ball 200 biased toward the inlet assembly 176 by a spring 202, and various flow channels 204 configured as grooves in the side and upper end walls of the chamber 196. The downstream end of the chamber 196 transitions to the flow passage 180, which has an outlet 206 at the mixing chamber 152. Accordingly, when fluid flows upward through the inlet assembly 176, as driven by a sufficient pressure differential between the inlet 188 and the outlet 206, the fluid flow moves the ball 200 upward against the biasing force of the spring 202. Fluid can accordingly flow through the concentrate receiving assembly 174 (including via the flow channels 204 within the inner chamber 196) to the mixing chamber 152. When pressure at the mixing chamber 152 exceeds pressure at the inlet 188, however, or when the pressure differential between the mixing chamber 152 and the inlet 188 is insufficient for flow to overcome the biasing force of the spring 202, fluid cannot flow through the concentrate receiving assembly 174. In this way, for example, backflow from the mixing chamber 152 to the inlet 188 can be generally prevented, as can leakage out of the attachment 102 through the inlet assembly 176. In other embodiments, other configurations for backflow prevention are possible, including check valves not using balls, and backflow preventers not configured as check valves. In some embodiments, no backflow preventer may be used in the receiving assembly 174.

In the embodiment depicted, a body 208 of the valve assembly 178, which includes the chamber 196, can be integrally formed with the body 162 of the attachment 102. To facilitate relatively simple insertion of the ball 200, spring 202, and other components, the inlet assembly 176 can be formed separately, and attached to the valve assembly 178 (and the body 162 of the attachment 102) via screw holes 210 and 212 extending through a mounting flange 214 on a body 216 of the inlet assembly 176. An o-ring 234 can be positioned between the body 216 and the body 208, in a groove 236, in order to further prevent leakage of fluid from the assembly 174.

Figure 6B:
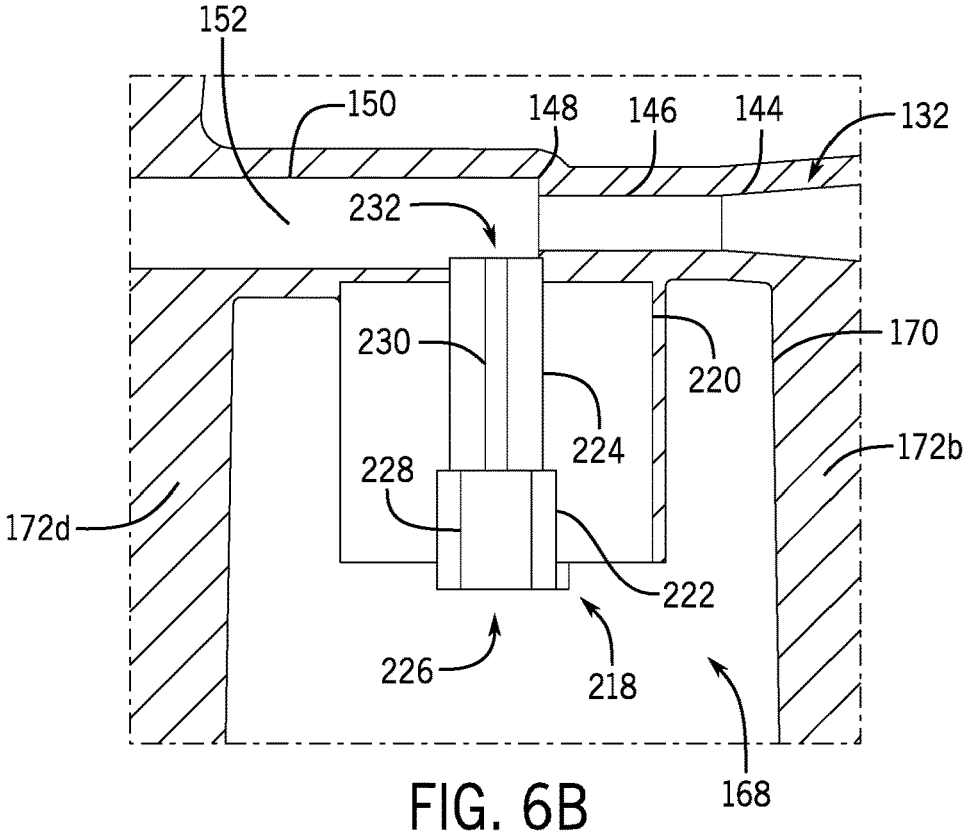
FIG. 6B is a similar view to FIG. 6A, showing an alternative flow-path configuration.

In other embodiments, other configurations of a concentrate receiving assembly are possible. As illustrated by a generic concentrate receiving assembly 218 in FIG. 6B, some such configurations include a generic body 220 of one or more pieces (e.g., one piece, integrally formed with the body 162 of the attachment 102) configured to support a generic inlet assembly 222 and a generic routing assembly 224. Generally, the inlet assembly 222 defines an inlet 226 to receive concentrate from the container 108 and direct the concentrate, via an internal passage 228, to the routing assembly 224. In some embodiments, as described below, for example, with regard to the receiving assembly 174, the generic receiving assembly 218 can be configured also to actuate a valve associated with the container 108 when moved (e.g., axially) into engagement with the container 108.

Upon receiving concentrate from the receiving assembly 218, the routing assembly 224 directs the concentrate along an internal flow path 230, to an outlet 232 that leads to the mixing chamber 152. In some embodiments, such as described above with regard to the valve assembly 178, the routing assembly 224 can include components to regulate the flow of concentrate (or other flows through the assembly 224), in addition to structures for routing the flow of concentrate to the mixing chamber 152. In some embodiments, the routing assembly 224 can be integrated with the inlet assembly 222, such that structures configured to receive concentrate from the container 108 also directly route the flow of concentrate to the mixing chamber 152.

Referring again to FIGS. 3 through 5 and 7, to facilitate use of the attachment 102 with a receptacle such as a bucket or other reservoir (not shown), the outlet end 116 of the attachment 102 includes a downwardly curving outlet trough 240, which defines an outlet channel 242 with a generally semi-circular profile. At an upper end, the trough 240 transitions into a holding collar 244 that partially surrounds the end coupling 134 of the flow passage 132 and thereby defines an annular recess 246 between the collar 244 and the coupling 134. At a lower end, the trough 240 transitions into a holding ring 248, with a generally circular bore 250 extending therethrough. When the system 100 is to be used with a bucket (or other reservoir) the trough 240 can be hooked over an upper edge or lip of the bucket (or other aspect of a reservoir fill-opening), such that the lower end of the trough 240, including the ring 248, is disposed to direct flow into the bucket (or other reservoir). Struts 252 and 254 (see FIGS. 3-5) of the attachment arm 106 (or other feature, such as the container 108) can then contact the upper edge and exterior of the bucket (or aspects of the other reservoir), respectively, in order to assist in holding the system 100 in a generally upright orientation and to ensure that the lower end of the trough 240 remains appropriately oriented to direct flow into the bucket (or other reservoir).

As illustrated in FIGS. 1 and 2, the dispensing tube 120 can be disposed within the trough 240, with an upper end of the dispensing tube 120 slotted into the holding collar 244 and a lower end of the dispensing tube 120 extending through the bore 250 of the ring 248. In this way, the lower end of the dispensing tube 120 can define the outlet port 118 and can route the mixture of concentrate and diluent from the flow passage 132 to the outlet port 118. Therefore, for example, with the trough 240 hooked over an edge of a bucket, as described above, the dispensing tube 120 can cause the bucket to be filled with the mixture of concentrate and diluent. In some embodiments, the tube 120 can be formed from relatively transparent material, such that a user can observe the flow of the mixture through the tube 120. In some embodiments, the tube 120 can be formed from relatively flexible material, in order to assist with installation of the tube 120 on the attachment 102.

As noted above, the attachment arms 104 and 106 of the attachment 102 can be configured to securely, but removably, attach the attachment 102 to the container 108 (or other similarly configured containers). As illustrated in particular in FIGS. 3 through 5, the arm 106 extends downward from the body 162 of the attachment 102, as supported by the struts 252 and 254, as well as by an inner strut 256. A lower end 106*a* of the arm 106 includes a hook 258, at the junction of the inner strut 256 and an upwardly angled surface 260. In conjunction with a lower end 162*a* of the body 162, the hook 258 generally defines a recess 262. As illustrated in particular in FIGS. 4 and 7, an inner side of the hook 258 includes a rounded notch 264 defining two protrusions 266 and 268.

Turning to FIG. 3 again, the arm 104 is constructed similarly to the arm 106, extending downward from the body 162 of the attachment 102, as supported by struts 270 and 272. A lower end 104*a* of the arm 104 includes a hook 274, at the junction of the strut 272 and an upwardly angled surface 276. In conjunction with the lower end 162*a* of the body 162, the hook 274 generally defines a recess 278. As illustrated in particular in FIGS. 4 and 7, an inner side of the hook 274 includes a rounded notch 280, defining two protrusions 282 and 284.

Generally, the attachment arms 104 and 106 can be formed from selected materials and with selected structures, such that the arms 104 and 106 can be used to securely hold the container 108 to the attachment 102. For example, in the embodiment depicted, the various struts 252, 254, 256, 270, and 272 are formed with a "T" cross-section, in order to provide the struts 252, 254, 256, 270 and 272 with appropriate rigidity without the use of excessive material. In some embodiments, other features can also be provided. For example, the arms 104 and 106 include, respectively, cutouts or openings 286 and 288, which can provide various ergonomic, aesthetic, material-saving, and other benefits.

To facilitate easy transport and other maneuvering of the attachment 102, and the system 100 in general, the attachment 102 includes a handle 300, with ribs 302 to provide structural strength to the handle 300 as well as to provide a grip region for a user of the system 100 (see, e.g., FIGS. 3-5). The handle 300 generally defines a handle opening 304 above the body 162 of the attachment 102 and the outer wall 160 of the flow passage 132, as supported by one or more rib support structures, such as a rib 306.

Figure 8A:
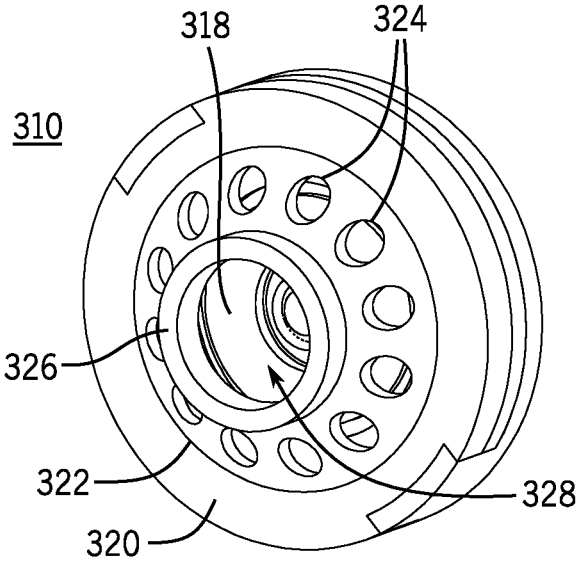
FIG. 8A is a top, left, front perspective view of a flow regulator for use with the mixing and dispensing attachment of FIG. 1.
Figure 8B:
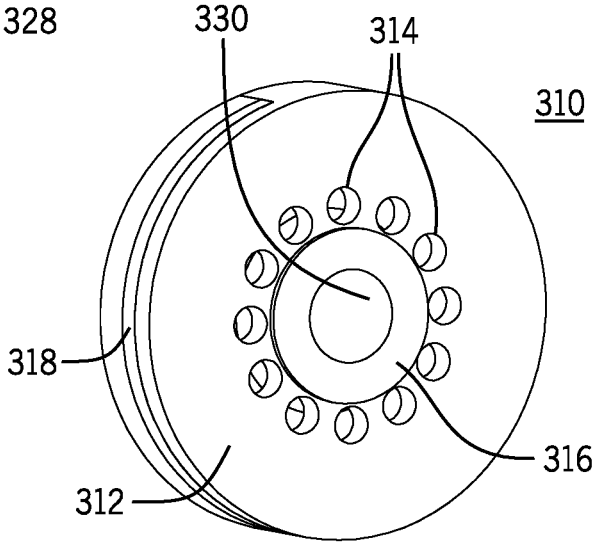
FIG. 8B is a top, left, rear perspective view of the flow regulator of FIG. 8A.
Figure 8C:
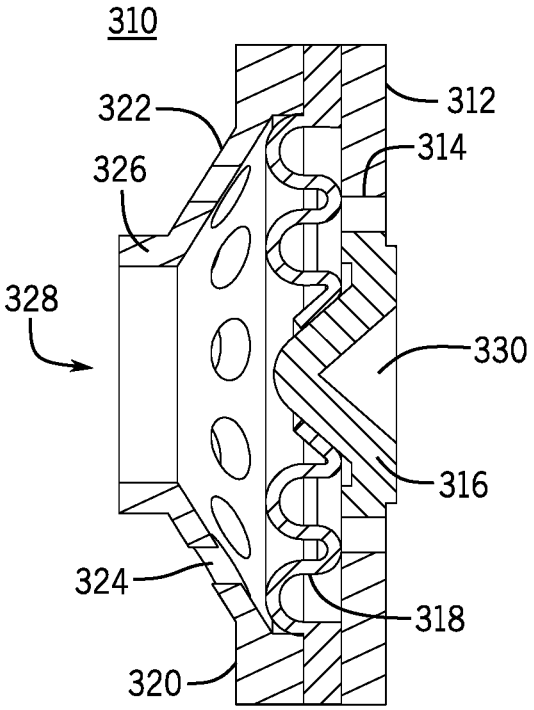
FIG. 8C is a cross-sectional view of the flow regulator of FIG. 8A, taken along a diameter of the flow regulator.
Figure 9:
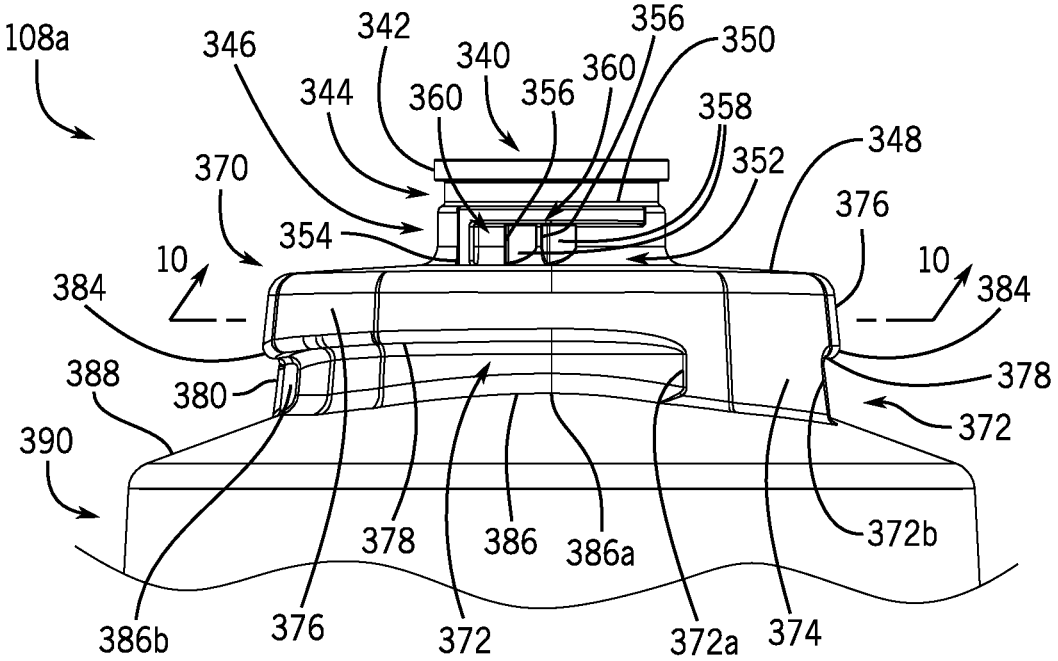
FIG. 9 is a partial, left elevational view of a top portion of the chemical concentrate container of FIG. 1.
Figure 10:
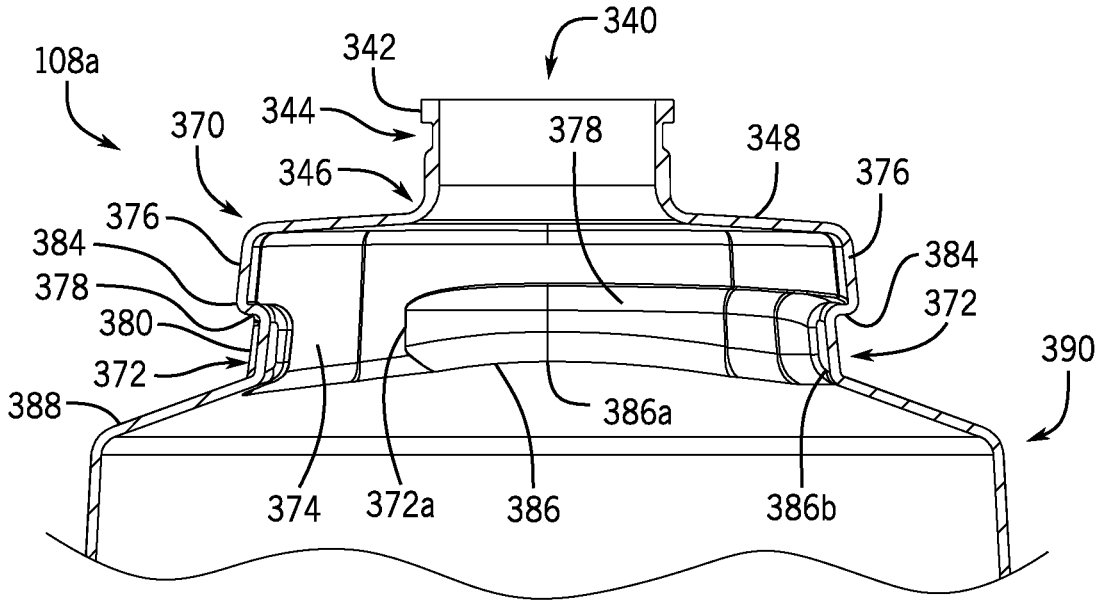
FIG. 10 is a cross-sectional view of the top portion of the chemical concentrate container of FIG. 9, taken along line 10-10 of same.

As noted above, in some embodiments, the attachment 102 can be configured to receive various inserts, such as flow regulators, backflow preventers, and so on. FIGS. 8A through 8C depict an example flow regulator 310 configured for insertion into the inlet socket 114 of the attachment 102. As shown in FIG. 8B, a front face 312 of the flow regulator 310 includes a set of inlet openings 314 (only select openings 314 labeled in the figures) surrounding a cylindrical boss 316 with a conical recess 330. A flexible, convolute gasket 318 is disposed between the front face 312 and a rear face 320 (see FIG. 8A). A conical protrusion 322 on the rear face 320 includes a set of vents 324 (only select vents 324 labeled in the figures) surrounding a cylindrical boss 326 with an outlet opening 328. As also described below, the rear cylindrical boss 326 of the flow regulator 310 is sized to fit securely within the tapered channel 138 of the flow passage 132 of the attachment 102 (see, e.g., FIG. 5), such that the flow regulator 310 can regulate flow through the inlet port 112 and thereby ensure a more stable flow rate into the attachment 102. In other embodiments, inserts such as the flow regulator 310 can be disposed at other locations, including locations outside the attachment body 162. In some embodiments, it may be generally useful to dispose the flow regulator 310 at locations that are upstream of the mixing chamber 152 (see, e.g., FIG. 5), in order to help provide an appropriate dilution ratio within the mixing chamber 152.

Referring now to FIGS. 9 through 13B, the container 108 is configured with various features to facilitate attachment of a valve assembly to the container 108, as well as the securing of the container 108 to the attachment 102 for operation of the system 100. The top end 108*a* of the container 108 includes an outlet opening 340 surrounded by a radially extending flange 342. An annular groove 344 is disposed below the flange 342, and generally between the flange 342 and an upper neck 346 of the container. The upper neck 346 extends downward away from the groove 344, with a generally cylindrical profile that curves outwardly, near the bottom of the upper neck 346, to intersect an upper mounting face 348 of the container 108. A pair of locking shelves 350 are disposed on the upper neck 346 just below the groove 344, with each of the shelves 350 generally defining a locking groove 352 that is bounded by an end wall 354 and at least partly interrupted by two locking ribs 356. The clockwise sides of the locking ribs 356 (viewing the container 108 from above) include generally curved faces 358, and the ribs 356 and the end wall 354 collectively define two locking recesses 360 within the locking groove 352.

Below the mounting face 348, the container 108 includes a lower neck 370. A set of two attachment grooves 372 are disposed on the lower neck 370, with the grooves 372 separated from each other by side wall portions 374. Each of the attachment grooves 372 generally extends below an attachment flange 376 on the lower neck 370, with a respective attachment shelf 378 at the bottom of each attachment flange 376 extending into the respective attachment groove 372. From a reference frame starting at respective clockwise ends 372*a* of the attachment grooves 372 (as viewed from above), moving along the attachment grooves 372 in the clockwise direction, the attachment grooves 372 taper inwardly from the respective sidewall portion 374, such that the respective shelves 378 initially exhibit increasing depth into the container 108, with respect to the outer boundary of the lower neck 370.

Figure 11:
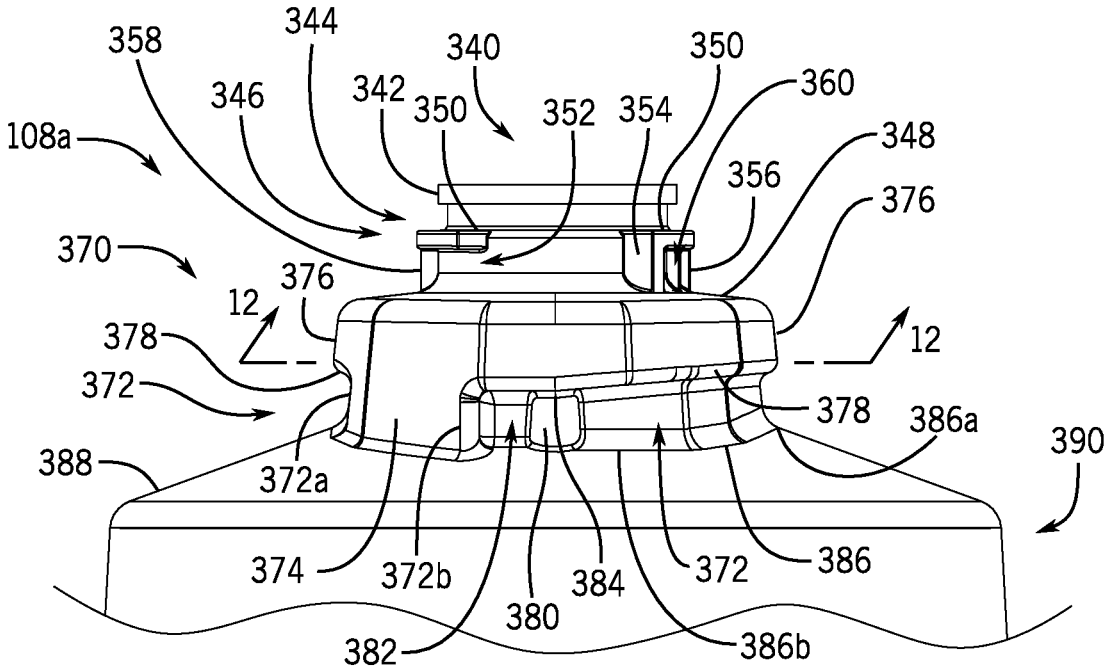
FIG. 11 is a partial, front elevational view of the top portion of the chemical concentrate container of FIG. 9.
Figure 12:
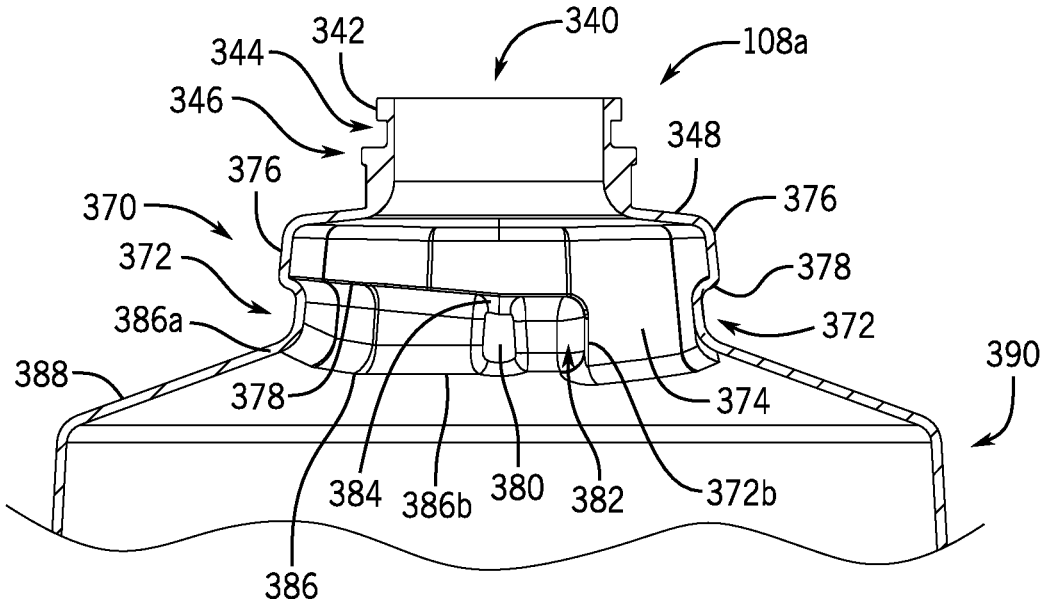
FIG. 12 is a cross-sectional view of the top portion of the chemical concentrate container of FIG. 11, taken along line 12-12 of same.

Referring in particular to FIGS. 11 and 12, near respective counterclockwise ends 372*b* of the attachment grooves 372 (again, as viewed from above), each of the attachment grooves 372 is partially interrupted by a respective detent 380. Each detent 380 is configured as a rounded protrusion extending outward from the inner surface of the respective attachment groove 372 and extending vertically over substantially all of the local height of the respective attachment groove 372 (as measured vertically, from the perspective of FIG. 11). The attachment grooves 372 continue beyond the detents 380, in the clockwise direction, to the counterclockwise ends 372*b* of the attachment grooves 372 at the side wall portions 374. At the counterclockwise side of the detents 380, respective locking recesses 382 are thus defined, as part of the attachment grooves 372, between the detents 380 and the counterclockwise ends 372*b* of the attachment grooves 372 (as defined by the side wall portions 374).

In some embodiments, a shelf of an attachment flange can exhibit a generally horizontal profile. In the embodiment illustrated in FIGS. 9 through 13B, from a reference frame moving counterclockwise along the attachment grooves 372, the shelves 378 exhibit changes in elevation, as measured relative to a lower end 108*b* of the container 108 (see, e.g., FIG. 1) or relative to the top of the outlet flange 342. Again referring in particular to FIGS. 11 and 12, from a reference frame moving counterclockwise along the attachment grooves 372, the shelves 378 taper downwardly away from the mounting face 348, to a minimum elevation at points 384 that are vertically aligned with the respective detents 380. Accordingly, the attachment grooves 372 generally exhibit a larger height toward the clockwise ends 372*a* of the attachment grooves 372, and exhibit a minimum height at or near the detent 380.

The height of the attachment grooves 372 can also vary based upon variations in the lower profile of the attachment grooves 372. For example, moving counterclockwise along the attachment grooves 372, an extended intersection 386 is defined between the attachment grooves 372 and an upper portion 388 of a main body 390 of the container 108. Along its length, the intersection 386 can also vary in elevation relative to a lower end 108*b* (see, e.g., FIG. 1) of container 108 or relative to the top of the outlet flange 342. In the embodiment depicted, the elevation of the intersection 386 varies from a point 386*a* of local maximum elevation, near the clockwise ends 372*a* of the attachment grooves 372 (see, e.g., FIG. 9) at the left and right sides of the container 108, to an extended minimum-elevation contour 386*b* near the counterclockwise ends 372*b* of the attachment grooves 372 (see, e.g., FIG. 11) at the front and rear sides of the container 108.

In this light, the elevation of the intersections 386 and of the shelves 378 can be varied, in different embodiments, in order to vary the disposition and height of the attachment grooves 372 along the length of the attachment grooves 372. In the embodiment depicted, the bottom edges of the attachment grooves 372, as defined by the intersection 386, generally track downwards, moving from the clockwise ends 372*a* to the counterclockwise ends 372*b*. The attachment grooves 372 also generally exhibit diminishing height, moving from the clockwise ends 372*a* to the counterclockwise ends 372*b*.

Figure 13A:
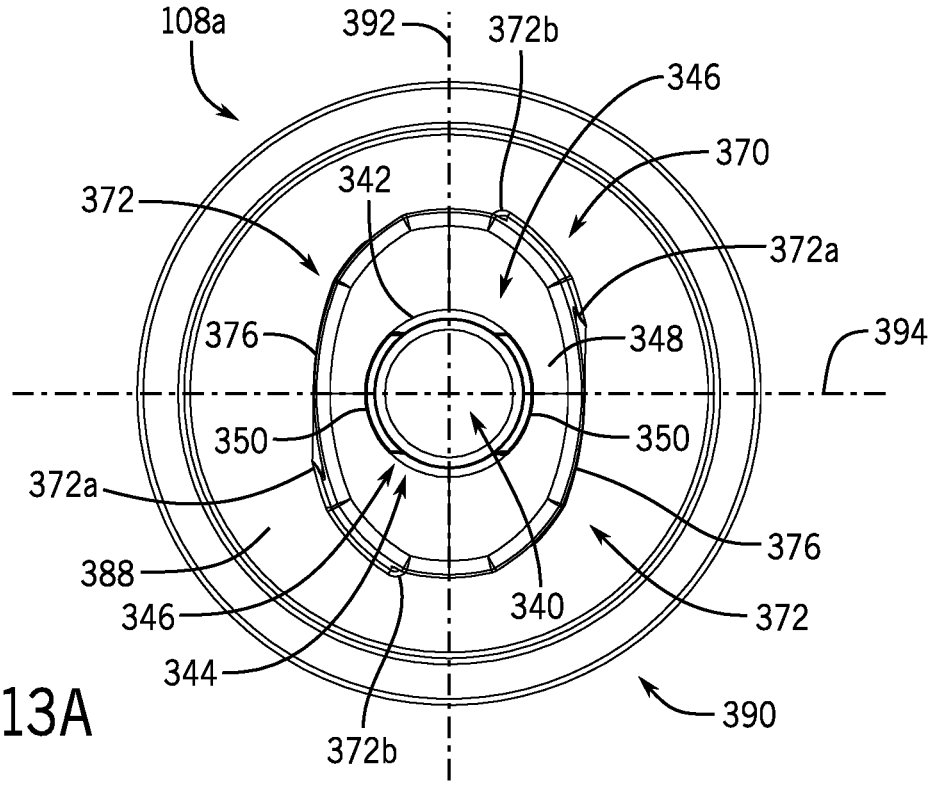
FIG. 13A is a top plan view of the top portion of the chemical concentrate container of FIG. 1.
Figure 13B:
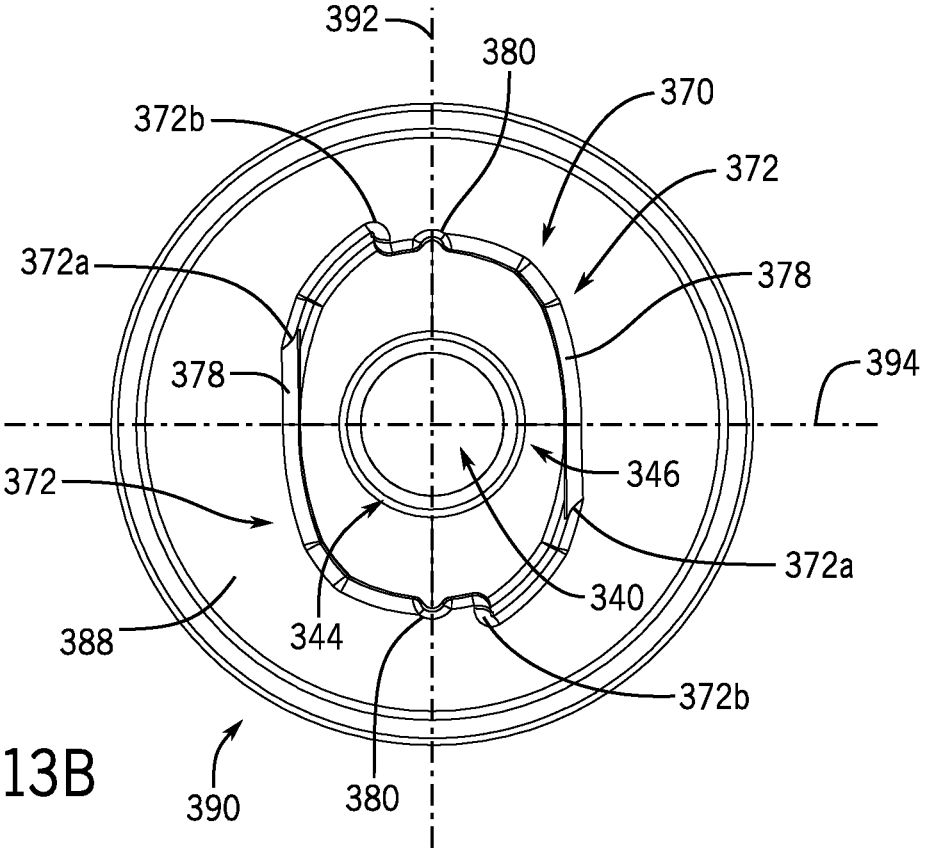
FIG. 13B is a bottom perspective view of the interior of the top portion of the chemical concentrate container of FIG. 13A.

In view of the discussion above, it will be clear that the disposition of the attachment grooves 372 also depends on the general configuration of the lower neck 370. Referring in particular to FIGS. 13A and 13B, in the embodiment depicted, the lower neck 370 exhibits a generally oblong shape, with a length of the lower neck 370 along a front-to-back axis 392 being generally longer than a length of the lower neck 370 along a right-to-left axis 394. Accordingly, portions of the attachment grooves 372 that are aligned with or otherwise near to the axis 392 (e.g., at the location of the detents 380 and the locking recesses 382) are generally disposed a greater distance from a centerpoint of the outlet opening 340 than portions of the attachment grooves 372 that are aligned with or otherwise near to the axis 394. Likewise, other features disposed on the front or back sides of the lower neck 370 (i.e., to the top or bottom in FIG. 13A) are generally disposed a greater distance from a centerpoint of the outlet opening 340 than similar features that are disposed on the right or left sides of the lower neck 370 (i.e., to the right or left in FIG. 13A).

Figure 14A:
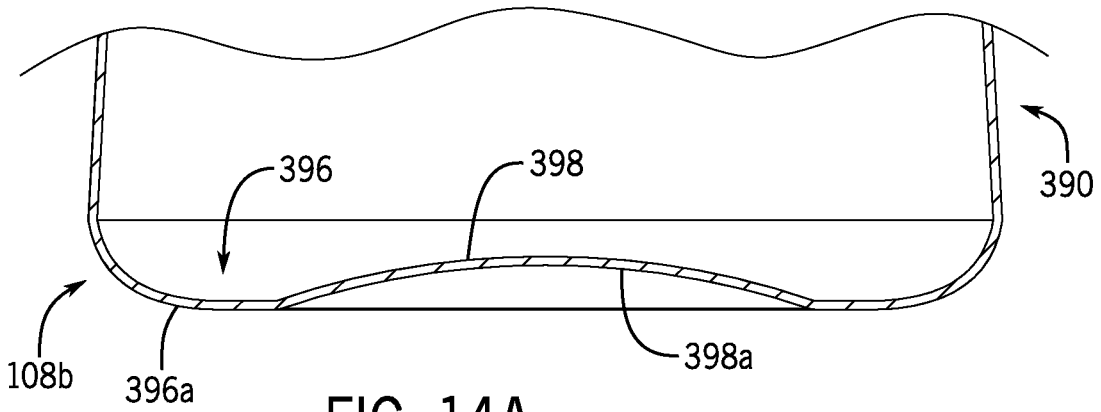
FIG. 14A is a cross-sectional view of a bottom portion of the chemical concentrate container of FIG. 1, taken along a similar line to the line 10-10 of FIG. 9.
Figure 14B:
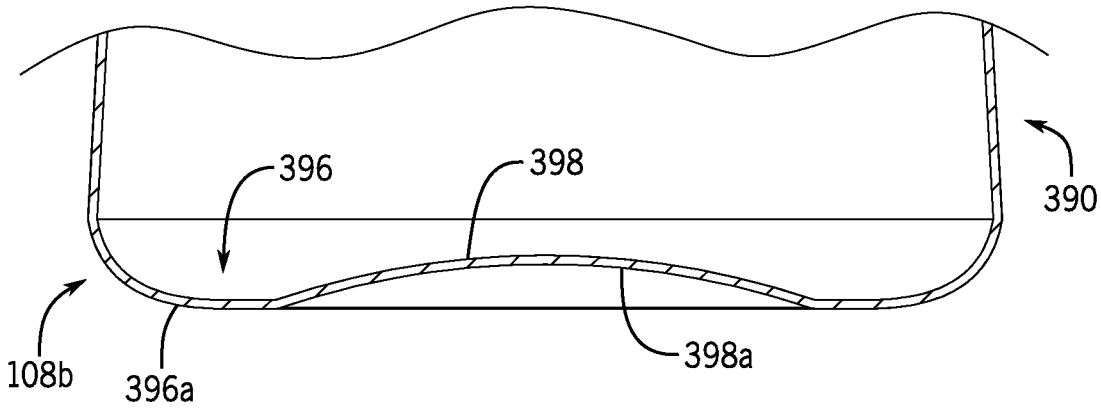
FIG. 14B is a cross-sectional view of the bottom portion of the chemical concentrate container of FIG. 1, taken along a similar line to the line 12-12 of FIG. 11.

Other portions of the container 108 can also be contoured in useful ways. For example, FIGS. 14A and 14B illustrate a generally annular internal well 396 around a raised central portion 398, at the lower end 108*b* of the container 108. The well 396 and raised central portion 398 can be useful, for example, in order to allow a dip tube (not shown in FIGS. 14A and 14B) to gather even relatively small remaining amounts of concentrate from the container 108. The external profiles 396*a* and 398*a* of the well 396 and raised central portion 398 can also contribute to stability of the container 108, and the system 100 generally, when the container 108 is resting on its lower end 108*b*. In some embodiments (not shown), the lower end 108*b* of the container 108 can be somewhat wider measured front-to-back (see FIG. 14A) than measured right-to-left (see FIG. 14B), or vice versa. Such asymmetry could be useful, for example, to help a user orient the container 108 relative to the attachment 102 for assembly of the system 100.

Figure 15:
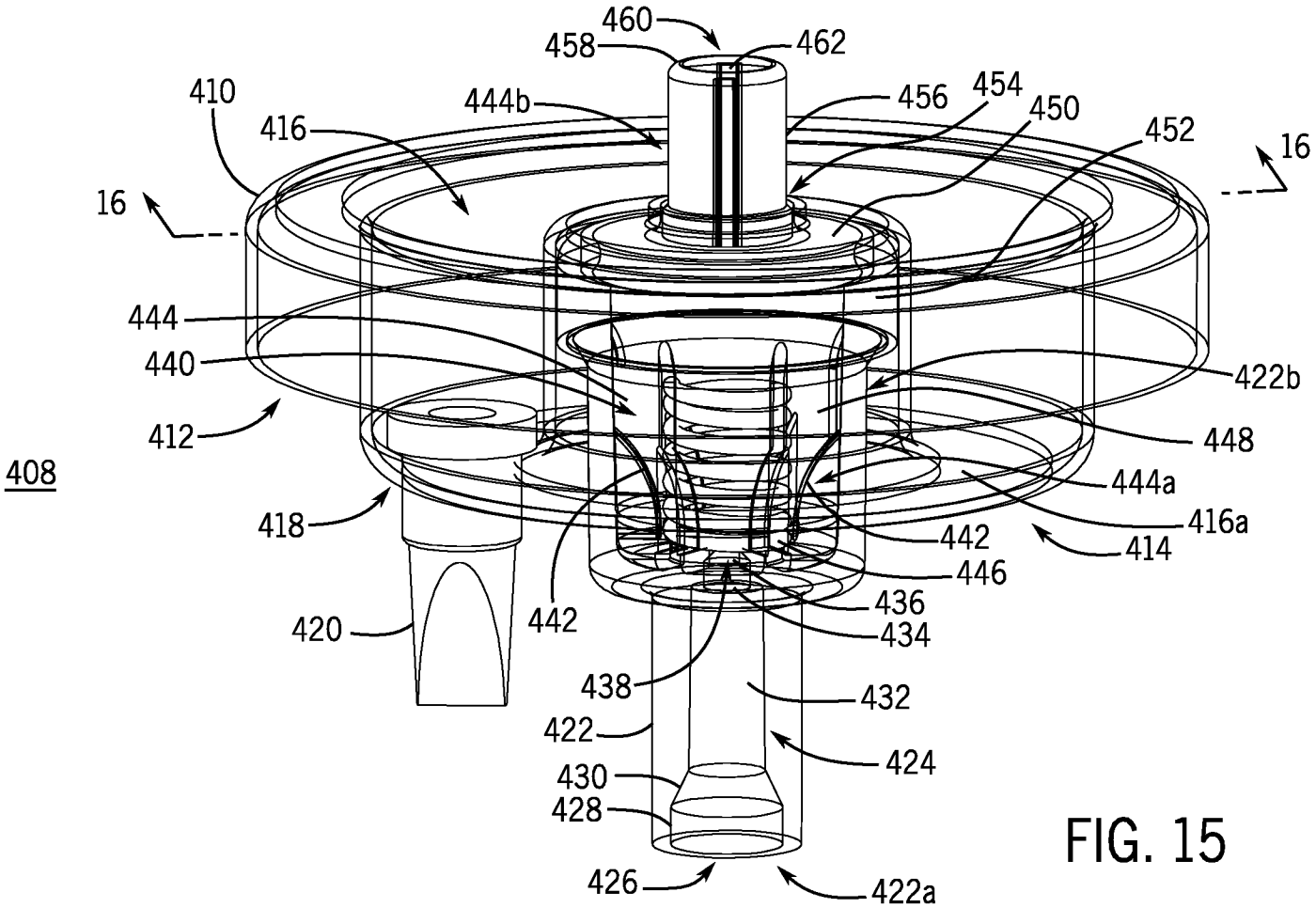
FIG. 15 is top, left, front perspective view of a valve assembly for use with the chemical concentrate container of FIG. 1, with certain exterior components of the valve assembly depicted in transparent relief.
Figure 16:
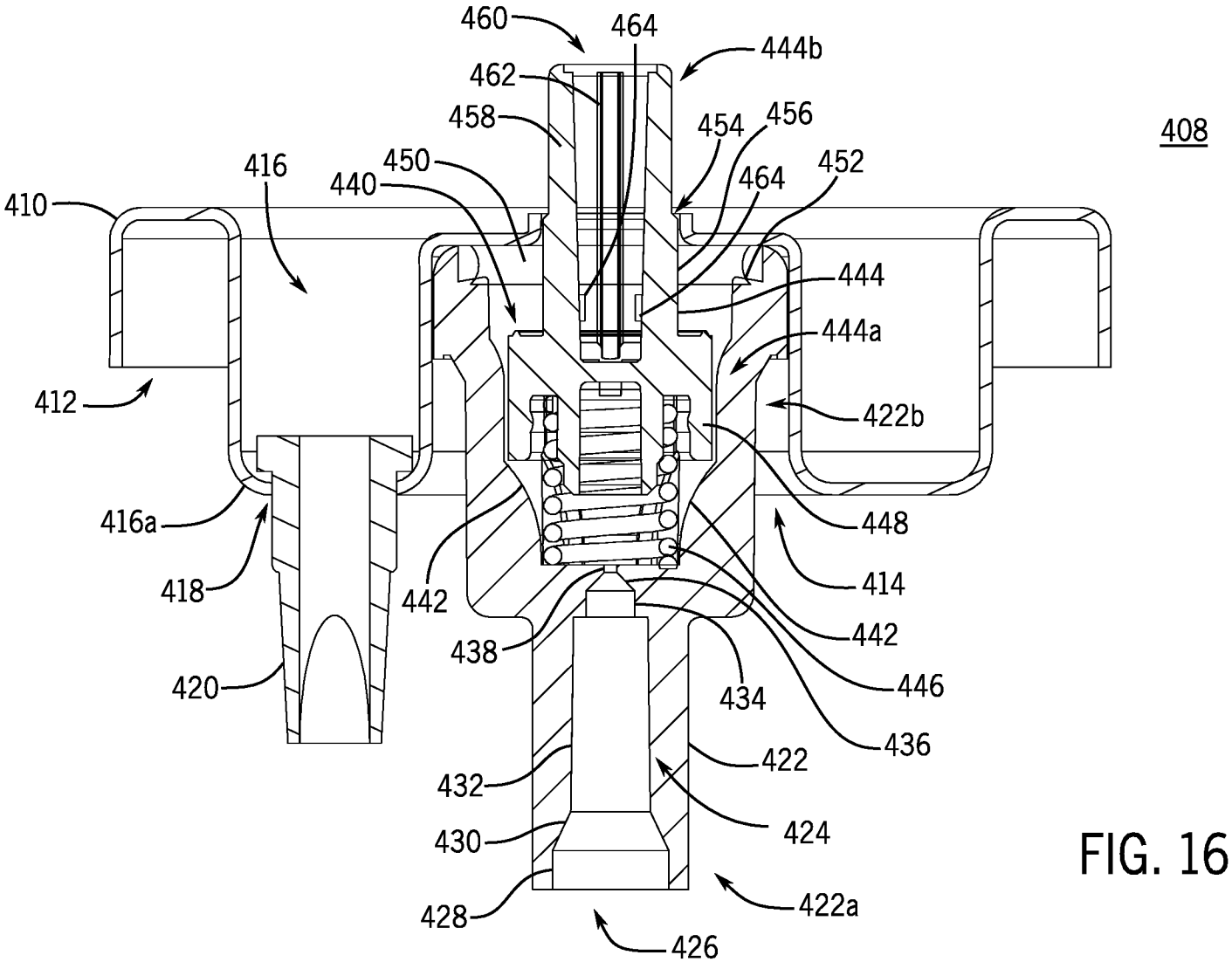
FIG. 16 is a cross-sectional view of the valve assembly of FIG. 15, taken along line 16-16 of FIG. 15.

Referring now to FIGS. 15 and 16, an example valve assembly 408 is depicted, which can be attached to the container 108 in order to regulate flow of concentrate out of the container 108. A valve cup 410 includes outer and inner upwardly extending wells 412 and 414, respectively. The outer well 412 can be configured to receive the outlet flange 342 of the container 108 (see, e.g., FIG. 9), and can be crimped around the outlet flange 342 in order to secure the valve cup 410 to the container 108.

A downwardly extending well 416 is disposed between the outer and inner wells 412 and 414. A hole 418 is disposed in a bottom surface 416*a* of the well 416, and a valve for admitting air into the container 108 can be seated within the hole 418. In the embodiment depicted, a one-way duck-billed valve 420 is seated (e.g., press fit) within the hole 418, such that the valve 420 can prevent concentrate from leaving the container 108 through the hole 418, and can also admit air into the container 108 when the ambient pressure is elevated sufficiently above the internal pressure of the container 108.

A valve body 422 can be seated (e.g., press fit) within the inner well 414, such that an inlet end 422*a* of the valve body 422 protrudes into the container 108 when the valve cup 410 is secured to the container 108. Accordingly, with the valve cup 410 in place on the container 108, a concentrate inlet 426 at the end of a hollow channel 424 defined by the inlet end 422*a* of the valve body 422 also extends into the container 108. In the embodiment depicted, the inlet end 422*a* of the valve body includes, moving downstream from the inlet 426, a cylindrical bore 428 and an inwardly tapered portion 430, which transition downstream to a narrower cylindrical bore 432, followed by a still narrower cylindrical bore 434, an inwardly tapered portion 436, and a restriction orifice 438. The cylindrical bore 428 and tapered portion 430 can be configured to guide a dip tube (see, e.g., FIG. 18) into the bore 434, where a restriction fit can secure the dip tube to the valve body 422. The restriction orifice 438 can be configured to permit an appropriate flow of concentrate upward through the valve body 422. For example, in some embodiments, the restriction orifice 438 can be configured to permit a flow of concentrate through the valve body 422 in order to provide a range of mixing ratios between about 1:18 and about 1:512, or a range of mixing ratios between about 1:18 and about 1:256, at an example target flow rate at the outlet port (see, e.g., FIG. 1) of approximately 4 gallons per minute.

An outlet end 422*b* of the valve body 422 defines a valve cavity 440, with various ribs 442 to strengthen the valve body 422, to secure and align various components, and to guide flow of fluid through the valve cavity 440. A valve stem 444 is inserted into the valve cavity 440, with a compression spring 446 secured within a cup 448 at a lower end 444*a* of the valve stem 444. The spring 446 is also secured, at an opposite end of the spring 446, between the ribs 442 at a lower end of the cavity 440. An annular gasket 450 is seated on an internal shoulder 452 at an upper end of the valve cavity 440, with an upper end 444*b* of the valve stem 444 extending through the gasket 450 and through a hole 454 through the upper wall of the well 414.

The upper end 444*b* of the valve stem 444 includes a cylindrical post 456 enclosing a cylindrical channel 458 leading to an outlet 460 of the valve stem 444. Various ribs 462 extend axially along the channel 458. Valve stem orifices 464 extend through the side walls of the cylindrical channel 458, such that when the valve stem 444 suitably compresses the spring 446 (e.g., as shown in FIG. 16), the valve orifices 464 are open to the cavity 440. Accordingly, with the spring 446 suitably compressed, the valve orifices 464 complete a flow path between the concentrate inlet 426 and the outlet 460 of the valve stem 444, and concentrate can flow from the container 108 out of the valve stem 444. In contrast, when the spring 446 is released from compression, the valve orifices 464 are moved into alignment with the gasket 450, such that the gasket 450 blocks flow of concentrate from the concentrate inlet 426 to the outlet 460 of the valve stem 444. Other valve assemblies, including those similar to the valve assembly 408, are disclosed in U.S. Patent Publication 2014/0061233.

Figure 17A:
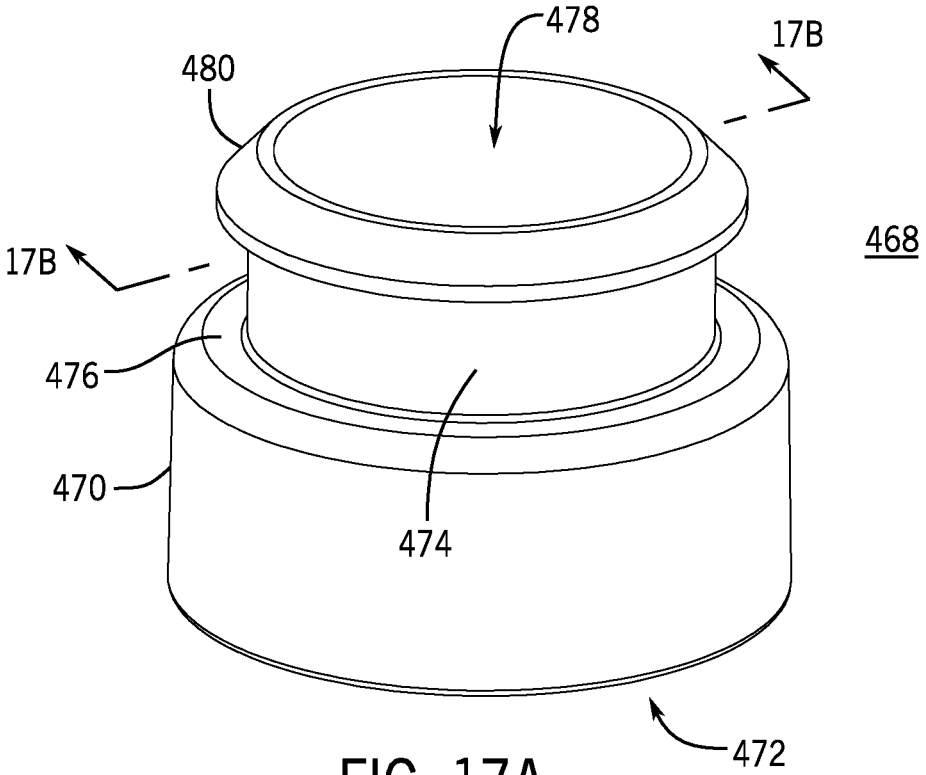
FIG. 17A is a top, left, front perspective view of a collar for use with the valve assembly of FIG. 15 and the chemical concentrate container of FIG. 1.
Figure 17B:
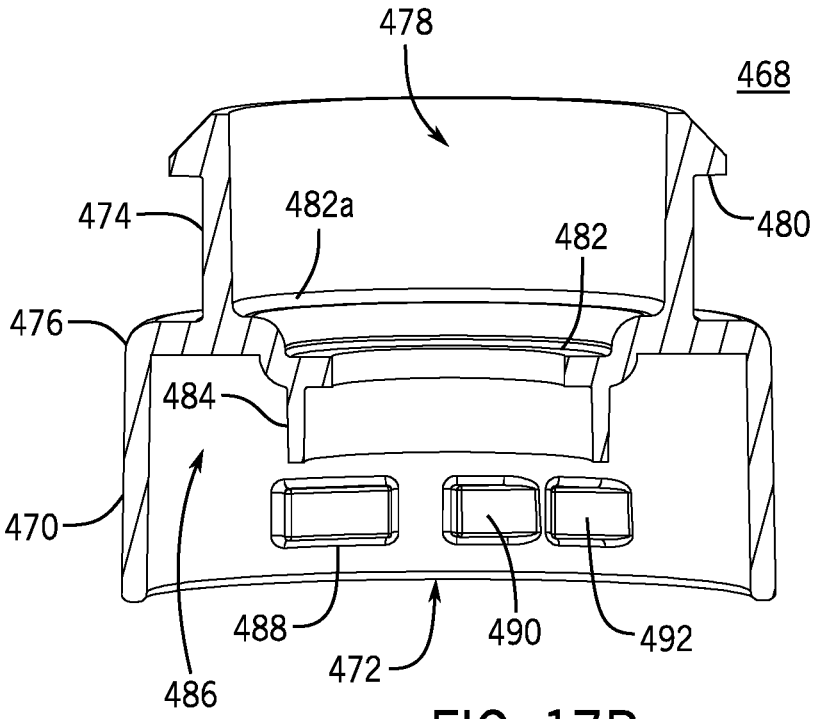
FIG. 17B is a cross-sectional view of the collar of FIG. 17A, taken along line 17B-17B of FIG. 17A.

As illustrated in FIGS. 17A and 17B, a collar 468 for the valve assembly 408 includes a hollow cylindrical base 470 defining a lower well 472. A hollow upper cylinder 474 is separated from the base 470 by a rounded shoulder 476, and defines an upper well 478 that is smaller in diameter than the lower well 472. An angled flange 480 extends radially away from a top end of the upper cylinder 474. An internal flange 482 with a convolute shoulder 482*a* supports a skirt 484 extending into the lower well 472 to define an annular space 486. Three locking lugs 488, 490, and 492 are disposed on an interior wall of the base 470, with the lug 488 being generally longer (as measured circumferentially around the base 470) than the lugs 490 and 492. Generally, the lugs 488, 490, and 492 can have heights that are similar to the height of the locking groove 352 in the upper neck 346 of the container 108 (see, e.g., FIG. 9). Further, the lugs 490 and 492 can have lengths (measured circumferentially with respect to the cylinder 474) that allow the lugs 490 and 492 to be seated within the locking recesses 360 of the upper neck 346 of the container 108. An opposite side of the interior wall of the base 470 (not shown in FIGS. 17A and 17B) includes a similar set of three locking lugs, for engagement with the other set of locking recesses 360.

Figure 18:
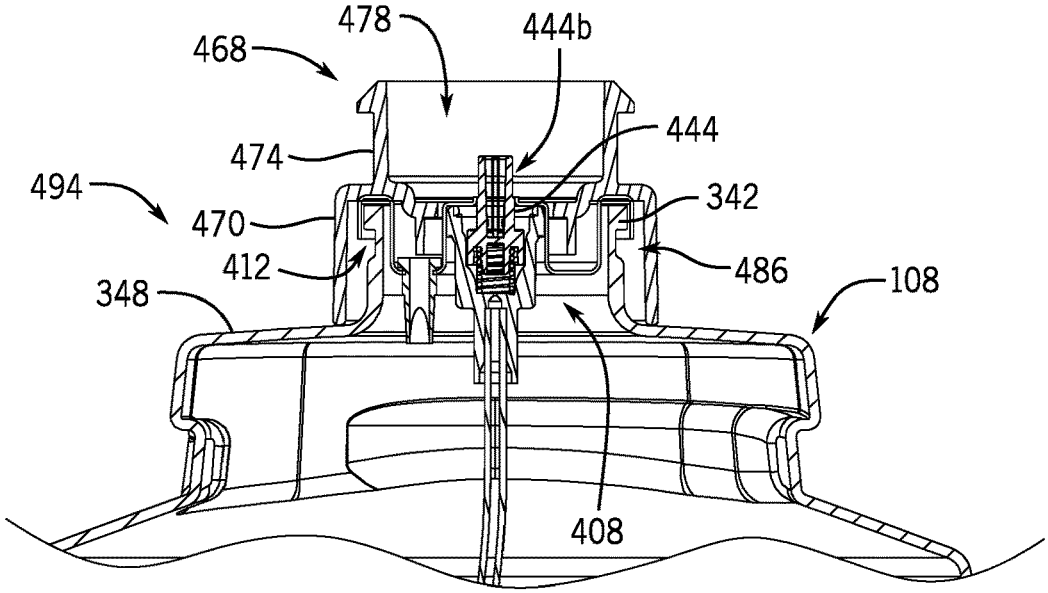
FIG. 18 is a cross-sectional view of the top portion of the chemical concentrate container of FIG. 1, with the valve assembly components of FIG. 15 and the collar of FIG. 17A attached to the chemical concentrate container, taken from a similar perspective to FIG. 10.

As illustrated in FIG. 18, with the valve assembly 408 secured to the container 108, the collar 468 can be placed over the valve assembly 408, such that the upper end 444*b* of the valve stem 444 extends within the upper well 478 of the collar 468, and the outer well 412 of the valve cup 410 (and the outlet flange 342 of the container 108) extends within the annular space 486. The collar 468 can then be twisted clockwise in order to seat the lugs 488, 490, and 492 (not shown in FIG. 18) within the locking groove 352 (not shown in FIG. 18), and, in particular, to seat the lugs 490 and 492 within the locking recesses 360 (see, e.g., FIG. 9). With the valve assembly 408 and the collar 468 secured to the container 108 in a collective assembly 494, the assembly 494 can thereby provide a generally disposable refill, multiple instances of which can be used in succession with the attachment 102, then discarded once exhausted of concentrate. In other embodiments, as also discussed below, a collar similar to the collar 468 can be attached via a snap-fit or other connection, rather than (or in addition to) via twisting.

Figure 19:
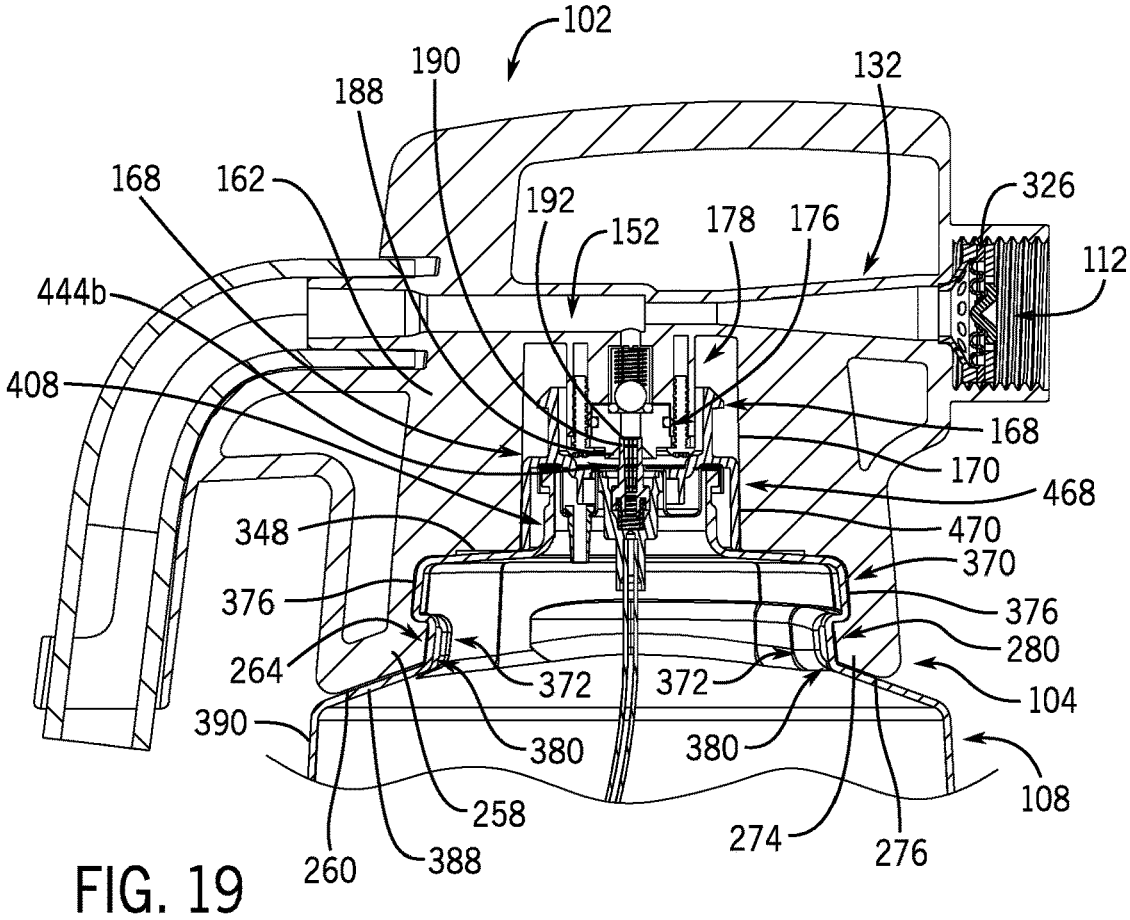
FIG. 19 is a cross-sectional view of the top portion of the chemical concentrate container of FIG. 1, with the valve assembly components of FIG. 15, the collar of FIG. 17A, and the mixing and dispensing attachment of FIG. 1 attached to the chemical concentrate container, taken from a similar perspective to FIG. 10.

Referring also to FIG. 19, in order to secure the assembly 494 to the attachment 102, the attachment 102 can be rotated such that the attachment arms 104 and 106 are generally aligned with the left and right sides of the container 108. For example, the attachment 102 can be oriented with the hooks 258 and 274 generally aligned with the side-to-side axis 394 of the container 108 (see, e.g., FIGS. 13A and 13B). The attachment 102 can then be moved axially toward the container 108 (i.e., downward, from the perspective of FIG. 19) such that the cylindrical base 470 of the collar 468 is inserted into the cylindrical bore 168 of the cylindrical shell 170 of the attachment body 162. With the interaction of the cylindrical base 470 and the bore 168 serving as a guide, the attachment can be moved axially farther toward the container 108, until the angled surfaces 260 and 276 near the hooks 258 and 274 come into contact with the upper portion 388 of the main body 390 of the container 108, and the hooks 258 and 274 are generally aligned with the respective attachment grooves 372. In the embodiment depicted, complimentary contours for the angled surfaces 260 and 276 and the upper portion 388 of the main container body 390 can help to ensure appropriate seating of the surfaces 260 and 276 on the portion 388. Notably, with the attachment 102 thus oriented, as guided by the base 470 and the bore 168, the upper end 444*b* of the valve stem 444 is received within the tapered inlet 188 of the inlet assembly 176 (and the receiving assembly 174, generally). In this way, for example, the valve assembly 408 can be generally opened to the flow of concentrate from the container 108 by way of the axial movement of the attachment 102 to seat the attachment 102 on the container 108.

The attachment 102 can then be rotated in a clockwise direction, such that the hooks 258 and 274 translate along the respective attachment grooves 372. As illustrated in FIG. 19, when the hooks 258 and 274 reach the counter-clockwise ends 372*b* of the respective attachment grooves 372 (see, e.g., FIGS. 9 and 12 for the ends 372*b*), the notches 264 and 280 on the hooks 258 and 274 can engage the respective detents 380 on the container 108, with the protrusions 266, 268, 282 and 284 of the hooks 258 and 274 inserted into the respective locking recesses 382 (see, e.g., FIGS. 11 and 13B for the locking recesses 382). In this way, via engagement of the hooks 258 and 274 with the attachment grooves 372, the arms 104 and 106 can be used to securely attach the attachment 102 to the container 108.

As also discussed below, the lower neck 370 of the container 108, and particularly as measured at the attachment flanges 376, is somewhat narrower along the side-to-side axis 394 (see, e.g., FIG. 13A), or at least only slightly larger, than an attachment clearance measured between the hooks 258 and 274. Accordingly, with the hooks 258 and 274 aligned with the left and right sides of the upper neck 370 of the container 108, the hooks 258 and 274 can be moved into alignment with the attachment grooves 372 without requiring substantial deformation of the hooks 258 and 274 or of the container 108. In contrast, the lower neck 370 of the container 108, particularly as measured at the attachment flanges 376, is somewhat wider than the attachment clearance. Accordingly, when the attachment 102 has been rotated to dispose the hooks 258 and 274 within the attachment grooves 372 at the front and rear sides of the container 108 (i.e., as illustrated in FIG. 19), the attachment flanges 376 prevent the attachment 102 from being removed from the container 108 in a vertical direction.

Further, as the hooks 258 and 274 are moved along the attachment groove 372 toward the detents 380, the changes in elevation of the attachment shelves 378 (e.g., as discussed above) cause the hooks 258 and 274 to be moved downward with respect to the container 108. Accordingly, turning the attachment 102 to move the hooks 258 and 274 along the attachment grooves 372 can cause the attachment 102 to be drawn generally downward toward the container 108 (or the container 108 to be drawn generally upward toward the attachment 102), such that the body 162 of the attachment 102 can be more firmly seated against the mounting face 348 of the container 108, and such that the angled surfaces 260 and 276 are more firmly seated against the upper portion 388 of the main body 390 of the container 108. Correspondingly, the inlet assembly 176 is pressed more firmly onto the valve stem 444, such that the upper end 444*b* of the valve stem 444 can be pressed firmly into the cylindrical bore 190 until the valve stem 444 is seated on the shoulder 192. In this way, as the inlet assembly 176 is pressed onto the valve stem 444, the valve stem 444 can be suitably (e.g., further) depressed, such that the valve stem orifices 464 clear the gasket 450 (see, e.g., FIG. 16) and concentrate can flow from the container 108 into the inlet assembly 176, the valve assembly 178, and the mixing chamber 152.

Because the container 108 is non-pressurized, concentrate may not immediately flow from the container 108, even once the valve stem orifices 464 have cleared the gasket 450. When diluent flows along the flow passage 132, however, the narrowing flow path defined by the flow passage 132 causes an acceleration of the diluent, such that the diluent travels at a greater velocity at the inlet to the mixing chamber 152 than at the inlet port 112. The corresponding relative decrease in pressure at the inlet to the mixing chamber 152 causes concentrate to be drawn from the container 108, through the valve assembly 408, the inlet assembly 176, and the valve assembly 178 and into the mixing chamber 152, where it is mixed with the diluent. The resulting mixture then flows out of the flow passage outlet 136, through the dispensing tube 120 and out of the outlet port 118.

Figure 20A:
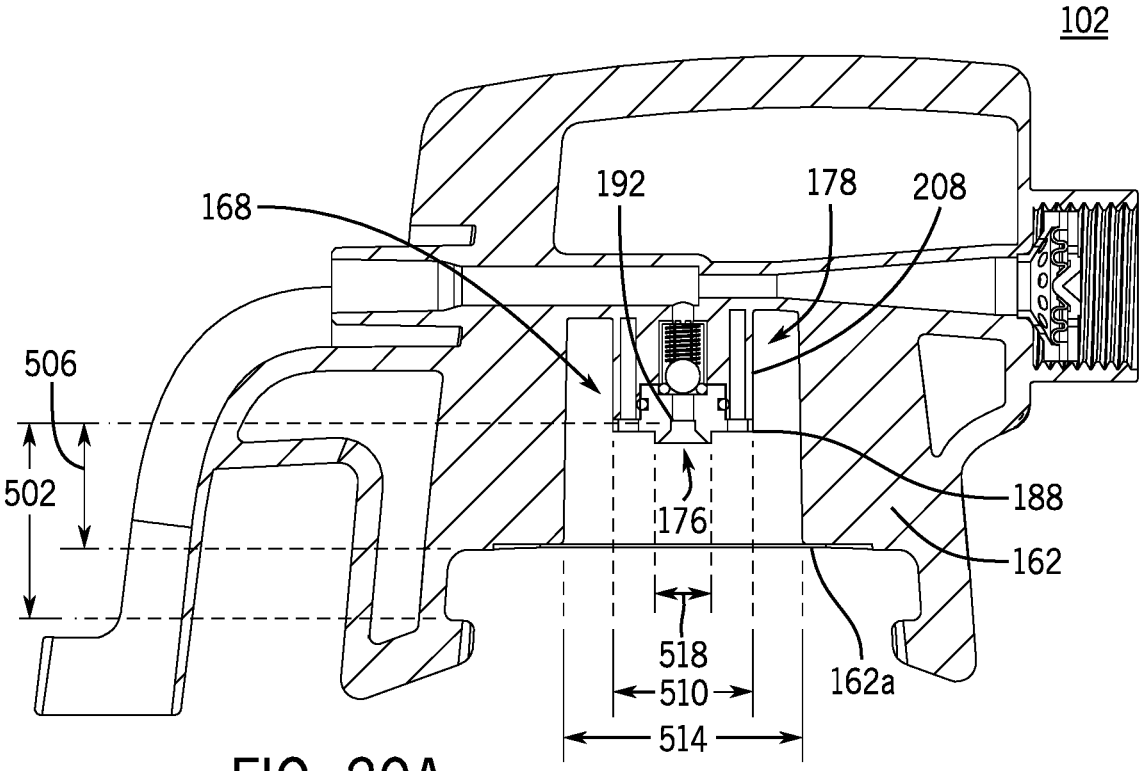
FIG. 20A is a cross-sectional view of the mixing and dispensing attachment of FIG. 1, similar to the view of FIG. 5.
Figure 20B:
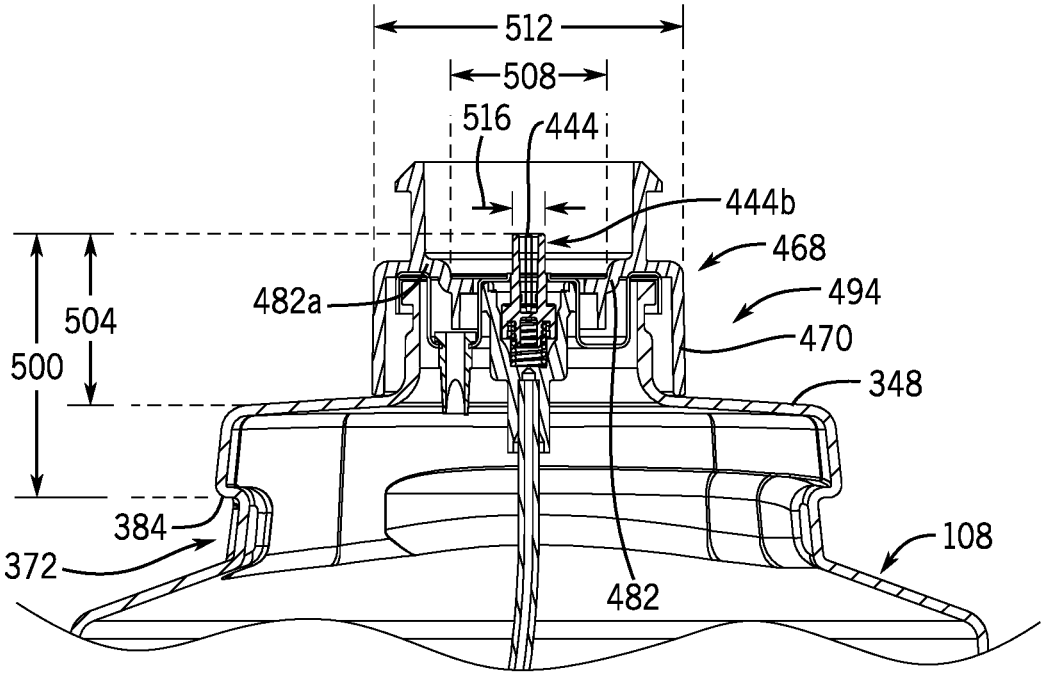
FIG. 20B is a cross-sectional view of the top portion of the chemical concentrate container of FIG. 1, with the valve assembly components of FIG. 15 and the collar of FIG. 17A attached to the chemical concentrate container, similar to the view of FIG. 18.

In view of the discussion above, it will be understood that various dimensional relationships between the components of the system 100 can contribute to effective operation of the system. As illustrated in FIGS. 20A and 20B, for example, when the valve stem 444 is sufficiently depressed to cause the valve stem orifices 464 to clear the gasket 450, a height 500 is defined between the points 384 of minimum elevation of the attachment grooves 372 and the upper limit of the valve stem 444. A height 502 is defined between the upper surface of the hook 258 (or the hook 274) and the shoulder 192 in the inlet assembly 176.

In order to ensure that the valve stem 444 is appropriately depressed when the notch 264 in the hook 258 (or the notch 280 in the hook 274) is seated on the detent 380 in the attachment groove 372 (see, e.g., FIG. 19), the height 500 can be configured to be substantially equal to the height 502. Accordingly, when the hooks 258 and 274 are firmly secured at the counter-clockwise ends of the attachment grooves 372, and the attachment 102 is correspondingly secured to the container 108 (i.e., as described above), the concentrate is appropriately permitted to flow into the mixing chamber 152.

Similar dimensional considerations can also apply with regard to the lower end 162*a* of the body 162 of the attachment 102 and the area of the mounting face 348 of the container 108 that contacts the body 162. In this regard, for example, a height 504 is defined between the lower end 162*a* of the body 162 and the shoulder 192, and a height 506 is defined between the mounting face 348 and the top of the upper end 444*b* of the valve stem 444, when the valve stem 444 is sufficiently depressed to cause the valve stem orifices 464 to clear the gasket 450. In the embodiment depicted, the lower end 162*a* of the body 162 and the mounting face 348 are not necessarily planar surfaces. It will be understood, in this regard, that the heights 504 and 506 can be defined with respect to any given point at which the body 162 contacts (i.e., is seated on) the mounting face 348.

Again, in order to ensure that the valve stem 444 is appropriately depressed when the body 162 is firmly seated against the mounting face 348, the height 504 can be configured to be substantially equal to the height 506. Accordingly, when the lower end 162*a* of the body 162 is firmly seated on the mounting face 348 (see, e.g., FIG. 19), and the attachment 102 is correspondingly secured to the container 108 (i.e., as described above), the concentrate is appropriately permitted to flow into the mixing chamber 152.

Diametrical dimensional considerations can also be relevant. For example, a diameter 508 is defined at the internal shoulder 482*a* of the internal flange 482 of the collar 468, and a diameter 510 is defined at the outer edge of the body 208 of the valve assembly 178. The diameter 508 can be configured to be substantially equal to the diameter 510, such that the shoulder 482*a* engages the body 208 to help secure the attachment 102 to the container 108.

Similarly, a diameter 512 is defined at the outer surface of the cylindrical base 470 of the collar 468 and a diameter 514 is defined by the cylindrical bore 168 of the attachment 102. Further, a diameter 516 is defined by the radially outer surface of the upper end 444*b* of the valve stem 444, and a diameter 518 is defined by the radially outer limits of the tapered inlet 188 of the inlet assembly 176 (and the receiving assembly 174, generally). In order to ensure appropriate alignment between the tapered inlet 188 (and the receiving assembly 174, generally) and the valve stem 444, the diameter 512 can be configured in various ways with respect to the diameter 514. In some embodiments, the diameter 512 can be configured to be substantially equal to the diameter 514, such that only a minimal clearance is provided between the cylindrical bore 168 and the collar 468. In some embodiments, the diameter 512 can be configured to be smaller than the diameter 514, but by no more than the difference between the diameter 516 and the diameter 518. In this way, for example, even if the collar 468 is inserted into the cylindrical bore 168 with the centerline of the collar 468 at a maximum offset from the centerline of the bore 168, the tapered inlet 188 can still capture the valve stem 444 and guide the valve stem 444 toward the cylindrical bore 190 and the shoulder 192.

Figure 21:
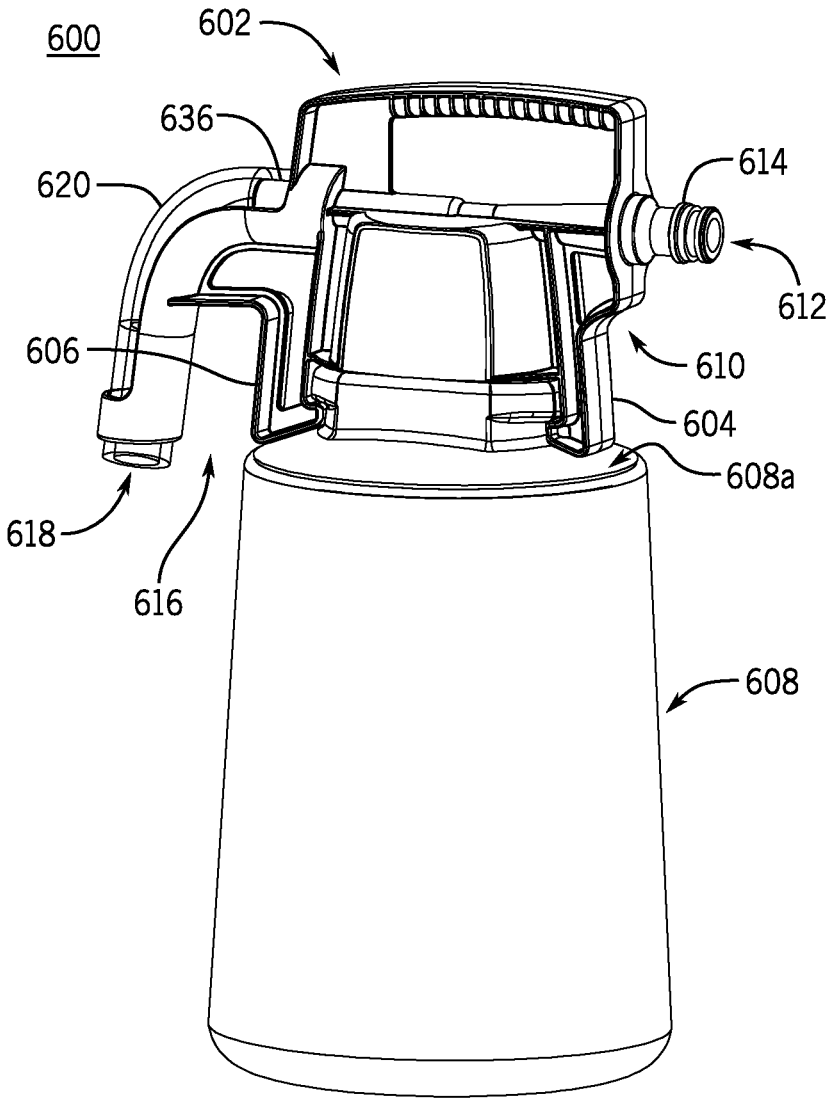
FIG. 21 is a left, rear perspective view of another embodiment of a mixing and dispensing system in accordance with the present disclosure, including another chemical concentrate container and another mixing and dispensing attachment.

In some embodiments, some of the features discussed above can vary from the configurations already discussed. In this regard, FIG. 21 illustrates another example mixing and dispensing system 600. In many ways, the system 600 is structured and operated similarly to the system 100. As such, discussion below will focus on various differences between the systems 100 and 600.

Similar to the system 100, the system 600 includes a mixing and dispensing attachment 602 configured as a unitary body. The attachment 602 includes attachment arms 604 and 606 configured to securely, but removably, attach the attachment 602 to a top end 608*a* of a chemical concentrate container 608. A diluent, such as liquid water, is received at an inlet end 610 of the attachment 602 from a remotely disposed source, via an inlet port 612. In contrast to the inlet port 112, however, the inlet port 612 is included within a fitting 614 configured for insertion into a diluent conduit. Once received at the fitting 614, the diluent travels from the inlet port 612 through the attachment 602, where the diluent is mixed with concentrate drawn from the container 608. The resulting mixture of diluent and chemical concentrate (also, herein, simply "concentrate") is then dispensed from an outlet end 616 of the attachment 602, via an outlet port 618 in a dispensing tube 620.

Figure 22:
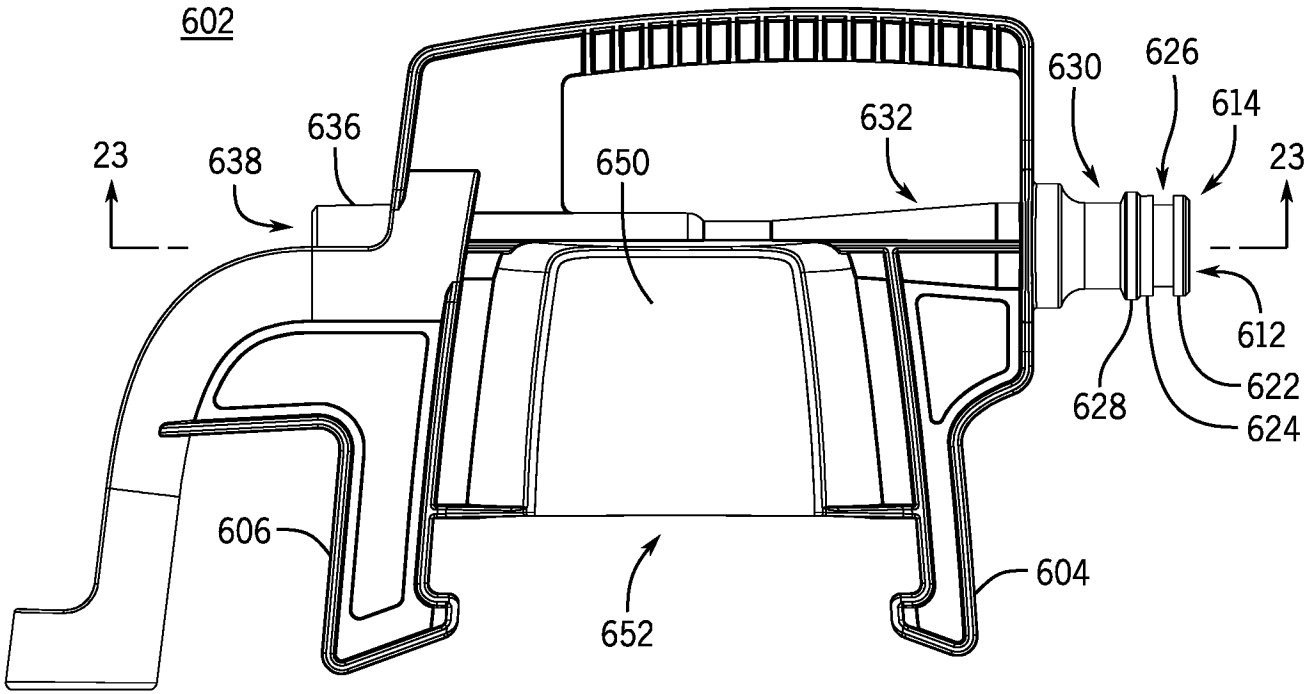
FIG. 22 is a left elevational view of the mixing and dispensing attachment of FIG. 21.
Figure 23:
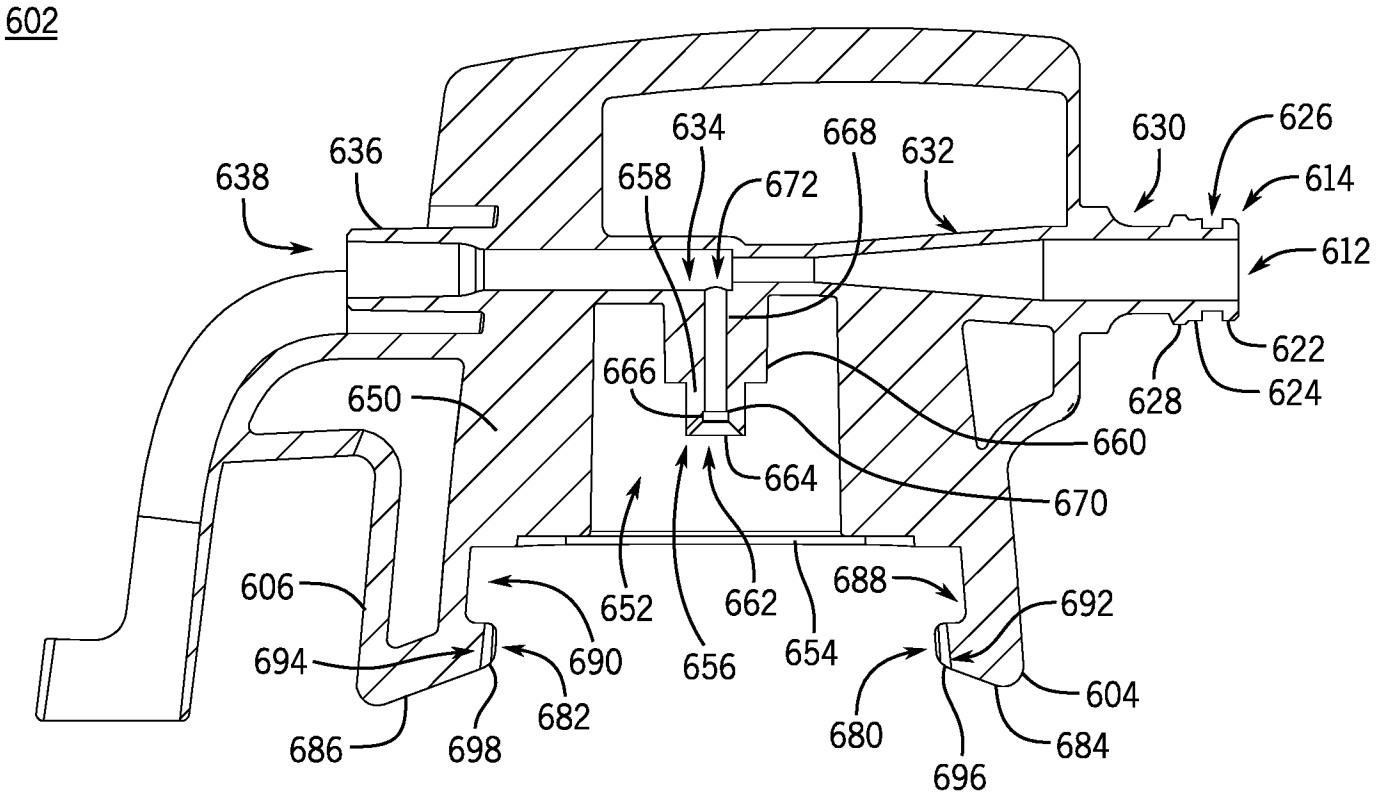
FIG. 23 is a cross-sectional view of the mixing and dispensing attachment of FIG. 21, including a concentrate receiving structure, taken along line 23-23 of FIG. 22.
Figure 24:
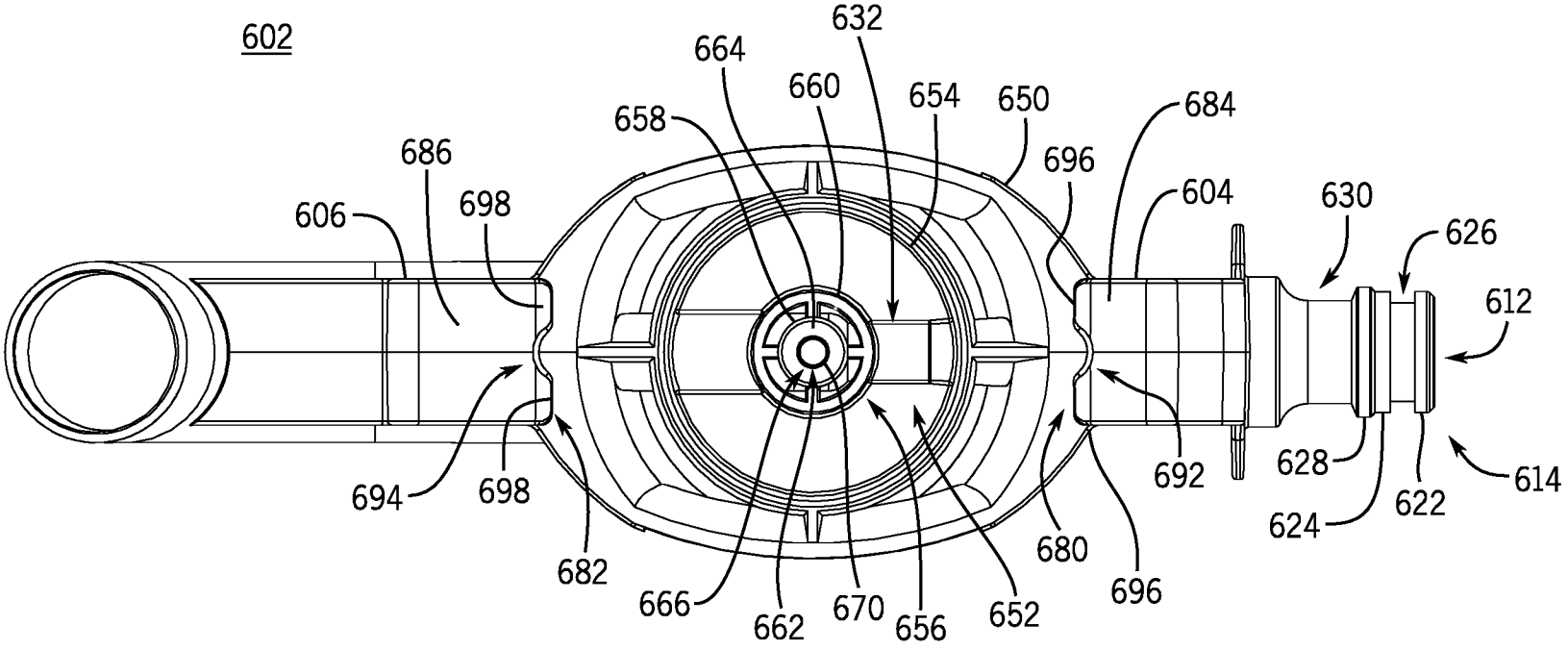
FIG. 24 is a bottom plan view of the mixing and dispensing attachment of FIG. 21.
Figure 25:
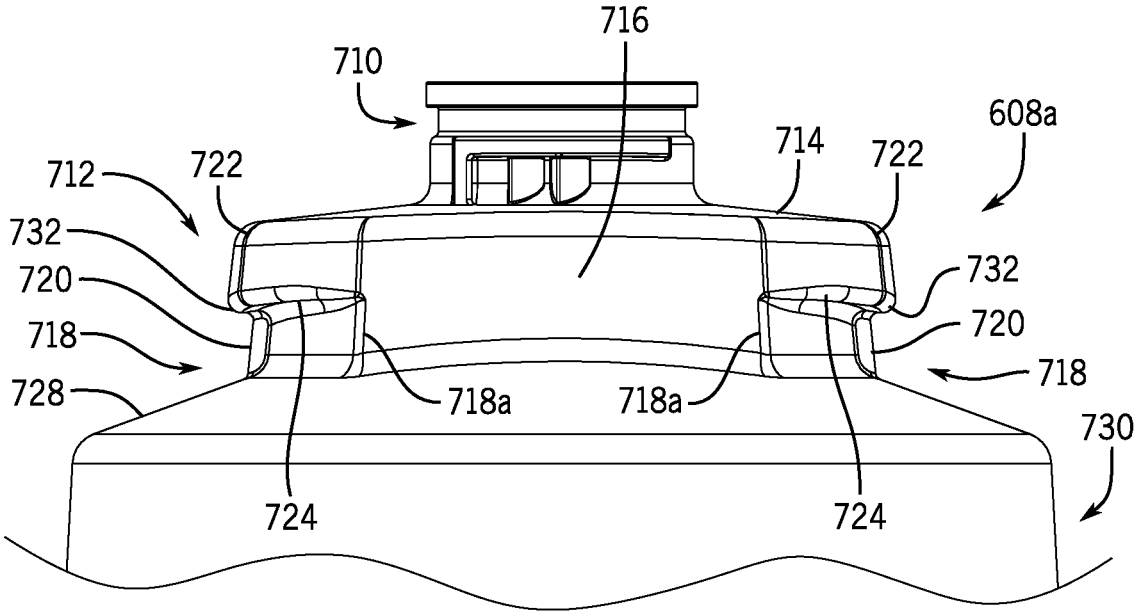
FIG. 25 is a partial, left elevational view of a top portion of the chemical concentrate container of FIG. 21.
Figure 26:
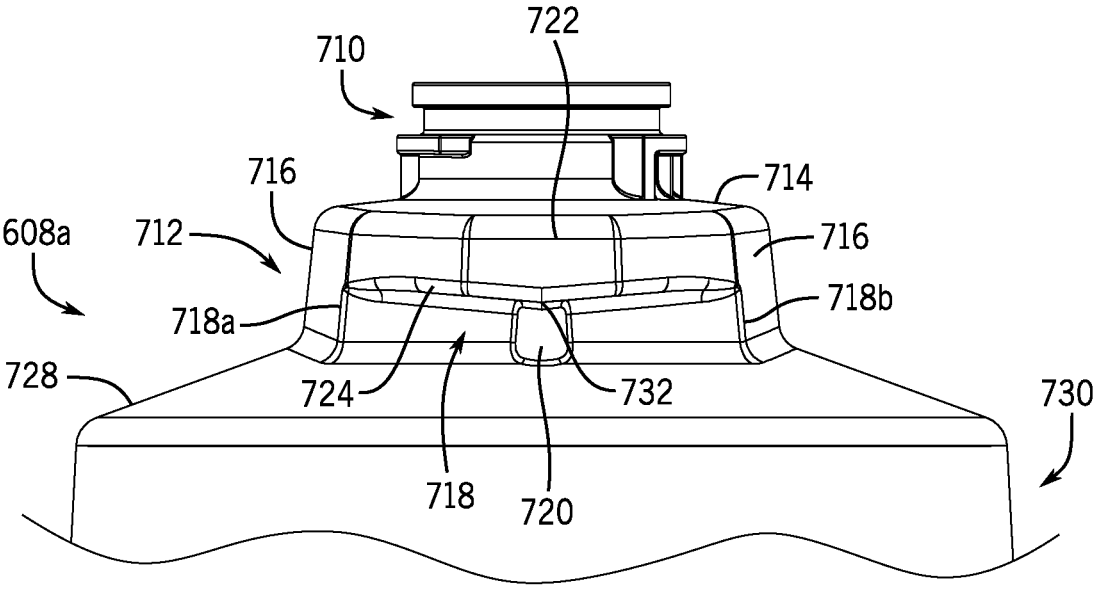
FIG. 26 is a partial, front elevational view of the top portion of the chemical concentrate container of FIG. 25.

FIGS. 22 through 24 illustrate various details of the construction of the mixing and dispensing attachment 602, with discussion herein again focusing on particular differences between the attachment 602 and the attachment 102. As illustrated in FIG. 22, the inlet fitting 614 includes an inlet flange 622 separated from a stop flange 624 by an annular groove 626. The stop flange 624 includes a radially extended downstream portion 628, as may be useful to indicate a stopping point for insertion of the fitting 614 into a conduit. In some embodiments, an o-ring or similar seal (not shown) can be seated in the annular groove 626, in order to provide a fluid seal with a conduit (not shown) into which the fitting 614 has been inserted. The flanges 622 and 624 are disposed at the upstream end of a neck 630, in order to facilitate easy attachment (and removal) of a conduit to (and from) the fitting 614.

The inlet port 612 on the inlet fitting 614 is generally in communication with a primary flow passage 632, which exhibits a similar segmented and tapering profile as the flow passage 132, and similarly includes a mixing chamber 634. The flow passage 632 extends from the inlet port 612 to a cylindrical end coupling 636 that defines a cylindrical flow passage outlet 638. The dispensing tube 620 can be seated over the end coupling 636 (see, e.g., FIG. 21), in order to route the mixture of diluent and concentrate from the flow passage 632 to the outlet port 618.

Similarly to the flow passage 132, the flow passage 632 is configured as a venturi tube, tending to positively accelerate fluid as the fluid moves from the inlet port 612 toward the mixing chamber 634. By principles of conservation of energy, the resulting increase in velocity of the fluid reduces the local pressure of the fluid as the fluid approaches the mixing chamber 634. As also described above, this reduction in pressure can be exploited to draw concentrated chemicals into the diluent for mixing within the mixing chamber 634.

With reference to FIG. 23, to help receive concentrated chemicals, a body 650 of the attachment 602 contains a generally cylindrical bore 652, defined by a cylindrical shell 654 that is supported with respect to the body 650 by various ribs. Within the bore 652, and supported by the body 650, is a concentrate receiving structure 656 for directing and regulating a flow of concentrate from the container 608 to the mixing chamber 634. The structure includes a cylindrical body 658 supported with respect to the body 650 by a cylindrical shell 660 and various ribs. A lower end of the cylindrical body 658 defines an inlet opening 662 at the upstream end of an inwardly tapered inlet 664. A cylindrical bore 666 is disposed downstream of the inlet 664 and is separated from a cylindrical flow passage 668 by a shoulder 670. At a downstream end of the flow passage 668, an outlet 672 of the flow passage 668 opens into the mixing chamber 634.

Generally, therefore, when the attachment 602 is in communication with an appropriate source (e.g., the container 608), concentrate can enter the receiving structure 656 via the inlet opening 662, and flow through the flow passage 668 to the mixing chamber 634. As also described above, this flow can be motivated by a decrease in pressure in diluent flowing through the flow passage 632, as effected by the venturi-tube structure of the flow passage 632. Within the mixing chamber 634, the concentrate mixes with diluent, and the resulting mixture is directed toward the outlet port 618.

As noted above, the attachment arms 604 and 606 of the attachment 602 can be configured to securely, but removably, attach the attachment 602 to the container 608 (or other similarly configured containers). As illustrated in particular in FIGS. 23 and 24, lower ends of the arms 604 and 606 include respective hooks 680 and 682, disposed at the end of respective angled surfaces 684 and 686, and configured similarly to the hooks 258 and 274. In conjunction with the lower end of the body 658, the hooks 680 and 682 generally define recesses 688 and 690, which are scaled to receive an attachment flange (see below). As illustrated in particular in FIG. 24, inner sides of the hooks 680 and 682 include rounded notches 692 and 694 defining respective sets of protrusions 696 and 698.

Referring now to FIGS. 25 through 27B, aspects of the container 608 are configured similarly to aspects of the container 108, in order to facilitate attachment of a valve assembly to the container 608. For example, an upper neck 710 of the container 608 is configured similarly to the upper neck 346 of the container 108 (see, e.g., FIGS. 9 through 13), in order to receive a valve assembly and collar configured similarly to the valve assembly 408 and collar 468 (see, e.g., FIGS. 15 through 18).

A lower neck 712 of the container 608, however, is configured somewhat differently from the lower neck 370 of the container 108. Similar to the lower neck 370 of the container 108, the lower neck 712 of the container 608 is generally oblong and extends below a mounting face 714. In contrast to the lower neck 370, however, right and left sides of the lower neck 712 exhibit generally smooth walls 716, without attachment grooves or other recessed features. Attachment grooves 718 are instead substantially disposed at the front and rear sides of the lower neck 712. The attachment grooves 718 are arranged symmetrically about central detents 720 and have generally smooth transitions to the smooth walls 716 at either end 718*a* and 718*b* of the grooves 718. The grooves 718 generally define attachment flanges 722, extending outward at the front and rear sides of the lower neck 712 and including attachment shelves 724 for engagement of the hooks 680 and 682. The attachment flanges 722, as also noted above, are scaled to fit within the recesses 688 and 690 defined by the hooks 680 and 682. The detents 720 are scaled to fit within the notches 692 and 694 on the hooks 680 and 682.

Figure 27A:
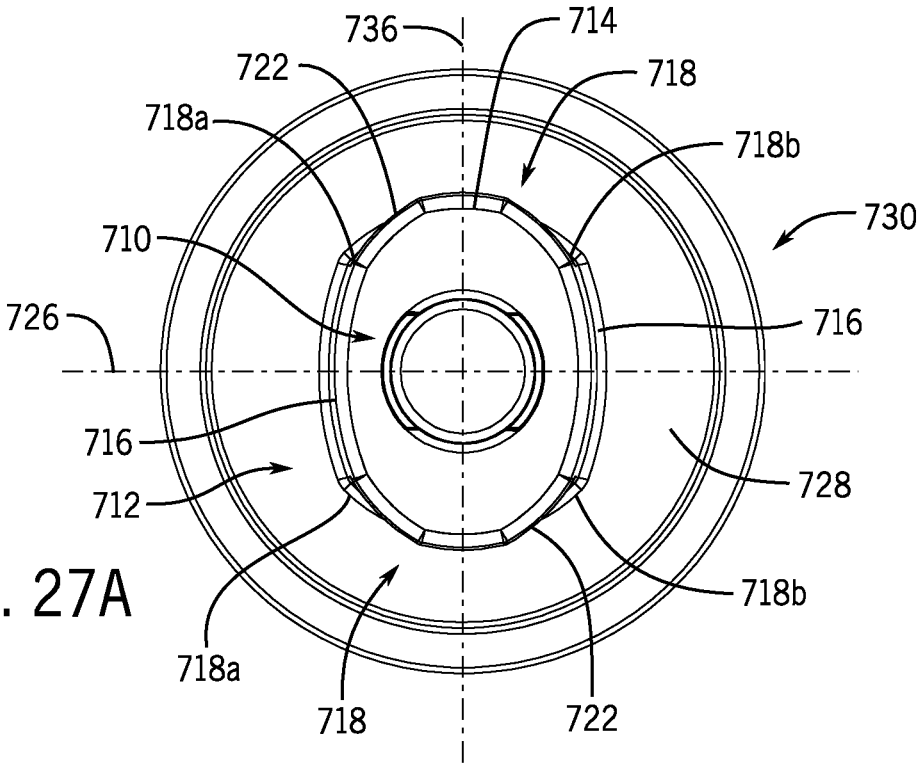
FIG. 27A is a top plan view of the top portion of the chemical concentrate container of FIG. 21.
Figure 27B:
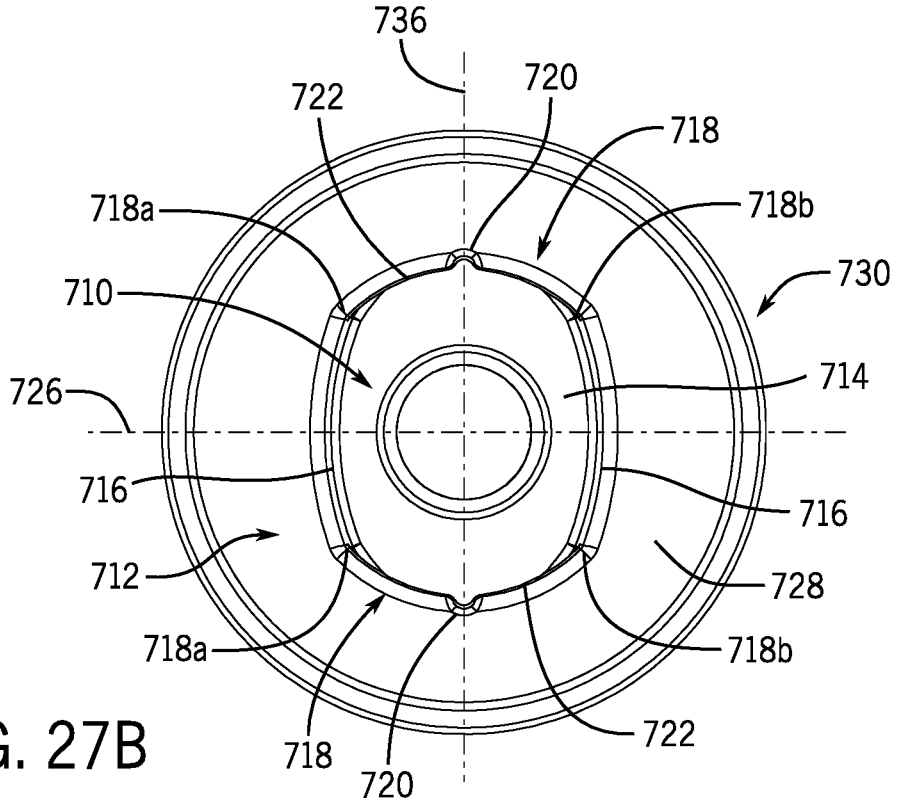
FIG. 27B is a bottom perspective view of the interior of the top portion of the chemical concentrate container of FIG. 27A.

Referring in particular to FIGS. 27A and 27B, a width of the lower neck 712 along a right-to-left axis 726 (i.e., a width between the smooth walls 716) is generally smaller than an attachment clearance between the inner ends of the hooks 680 and 682 (see, e.g., FIG. 23). Accordingly, with the hooks 680 and 682 generally aligned with the smooth walls 716, the attachment 602 can be slid axially (e.g., downward) onto the upper end 608*a* of the container 608 until the angled surfaces 684 and 686 of the attachment arms 604 and 606 are seated on an upper surface 728 of a body 730 of the container 608. The attachment 602 can then be rotated, similarly to the attachment 102 on the container 108, until the notches 692 and 694 are seated on the respective detents 720. Also similarly to the container 108, a length of the lower neck 712 along a front-to-back axis 736, as measured at the outer edges of the attachment flanges 722 is larger than the attachment clearance, but on the same order of the attachment clearance plus the length of the two recesses 688 and 690 (see, e.g., FIG. 23). Accordingly, with the hooks 680 and 682 aligned with the detents 720, interaction between the attachment shelves 724 and the hooks 680 and 682 prevents vertical separation of the container 608 and the attachment 602.

As with the attachment shelves 378 (see, e.g., FIGS. 9 through 12), the attachment shelves 724 exhibit a reduced elevation at points 732 (see FIGS. 25 and 26) that are generally aligned with the detents 720. Accordingly, as the attachment 602 is rotated to move the hooks 680 and 682 toward the detents 720, the interaction of the shelves 724 and the hooks 680 and 682 causes the attachment 602 to be seated more and more firmly on the container 608.

Figure 28:
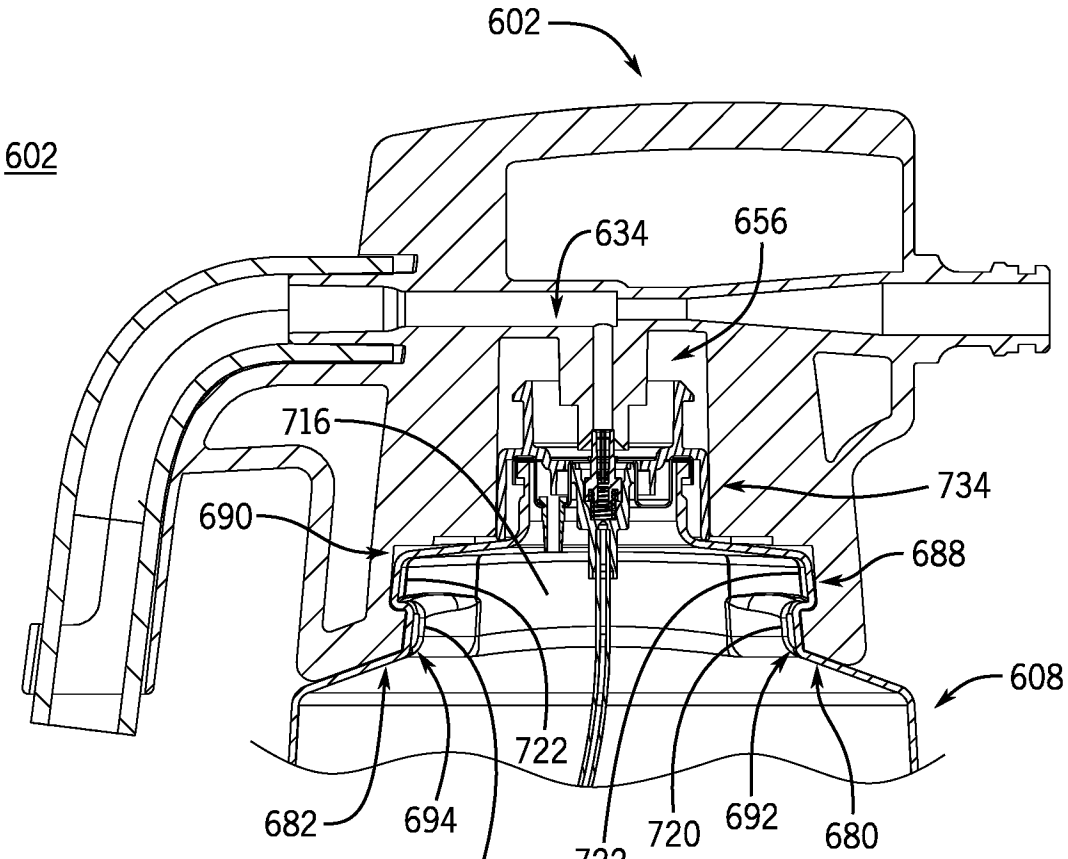
FIG. 28 is a cross-sectional view of the top portion of the chemical concentrate container of FIG. 21, with valve assembly components similar to those of FIG. 15, a collar similar to that of FIG. 17A, and the mixing and dispensing attachment of FIG. 1 attached to the chemical concentrate container, taken from a similar perspective to FIG. 23.

FIG. 28 illustrates the attachment 602 secured to the container 608 with the notches 692 and 694 of the hooks 680 and 682 seated on the respective detents 720 and the attachment flanges 722 extending into the recesses 688 and 690. As illustrated, with the attachment 602 and the container 608 secured together in this way, the receiving structure 656 engages a valve assembly 734 similar to the engagement of the valve assembly 408 by the receiving assembly 174 (see, e.g., FIG. 19), such that concentrate can flow from the container 608 into the mixing chamber 634. In some embodiments, as also described above, the receiving structure 656 can be caused to open the valve assembly 734 via a purely axial movement of the attachment 602 toward the container 608 (i.e., a purely downward movement, from the perspective of FIG. 28). The attachment 602 can then be rotated relative to the container 608 to secure the hooks 680 and 682 within the attachment grooves 718.

It will be understood that dimensional considerations similar to those discussed above with regard to the system 100 may also apply with regard to the system 600, as well as other embodiments of the invention. For example, diametrical and height relationships similar to those discussed with respect to FIGS. 20A and 20B may also apply with respect to corresponding features in the system 600.

Figure 29:
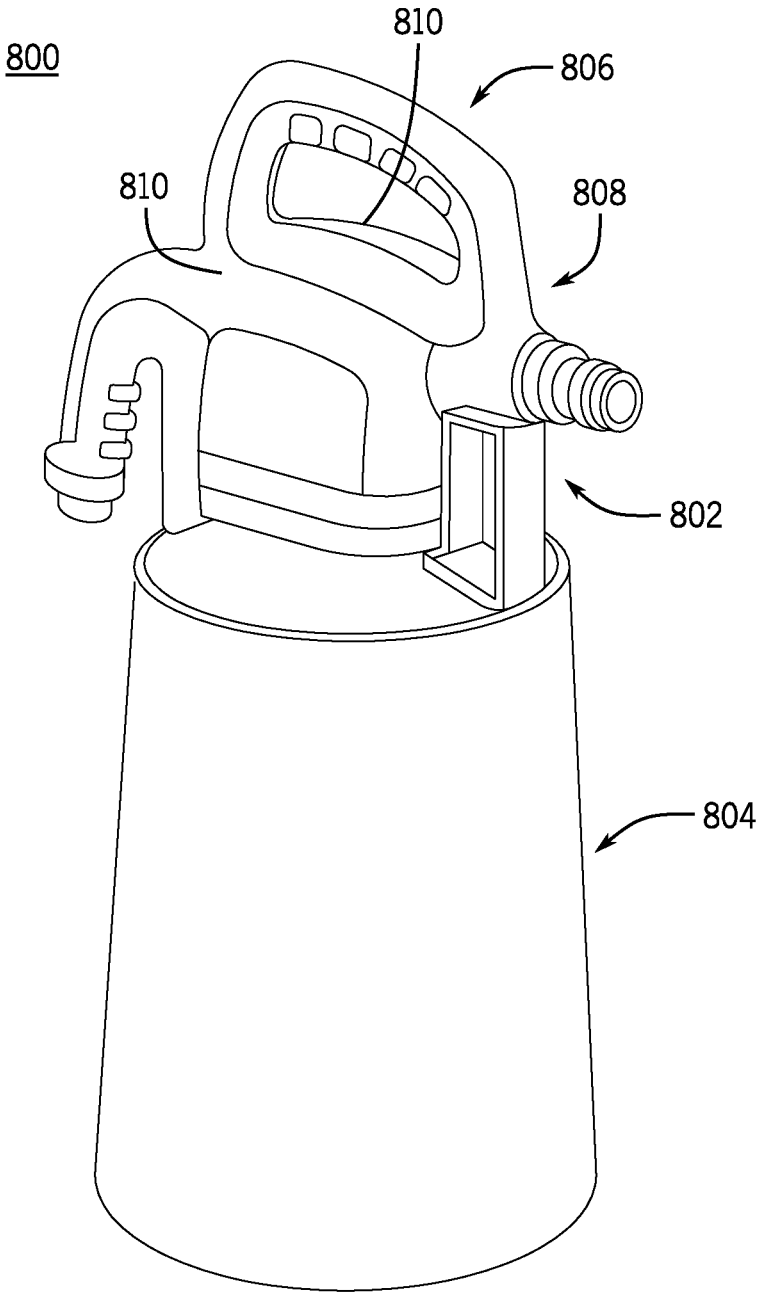
FIG. 29 is a top, left, rear perspective view of still another embodiment of a mixing and dispensing system in accordance with the present disclosure, including still another chemical concentrate container, still another mixing and dispensing attachment, and a shell for the mixing and dispensing attachment.

In some embodiments, outer shells can be provided to at least partly surround certain components of a mixing and dispensing system. Such shells can provide ergonomic, aesthetic, or functional benefits, depending on the particular configuration. As one example, FIG. 29 illustrates a mixing and dispensing system 800, with a mixing and dispensing attachment 802 configured similarly to the attachments 102 and 602. A chemical concentrate container 804 can be secured to the attachment 802 in a similar manner as the containers 108 and 608, with respect to the attachments 102 and 602. To provide a handle 806 with particular ergonomic characteristics, as well as other benefits, a two-piece, axially symmetric shell 808, formed from similar half-shells 810, can be secured over the attachment 802. The half-shells 810 can be secured over the attachment 802 with a snap-fit or other interface, or with fasteners. The half-shells 810 can be secured to each other such that the resulting shell 808 is secured to the attachment 802, or can be secured directly to the attachment 802. In other embodiments, other configurations of a shell can be used, including shells with greater or lesser coverage of the corresponding attachment, shells with a greater or fewer number of pieces, shells with non-symmetrical components, and so on.

Figure 30:
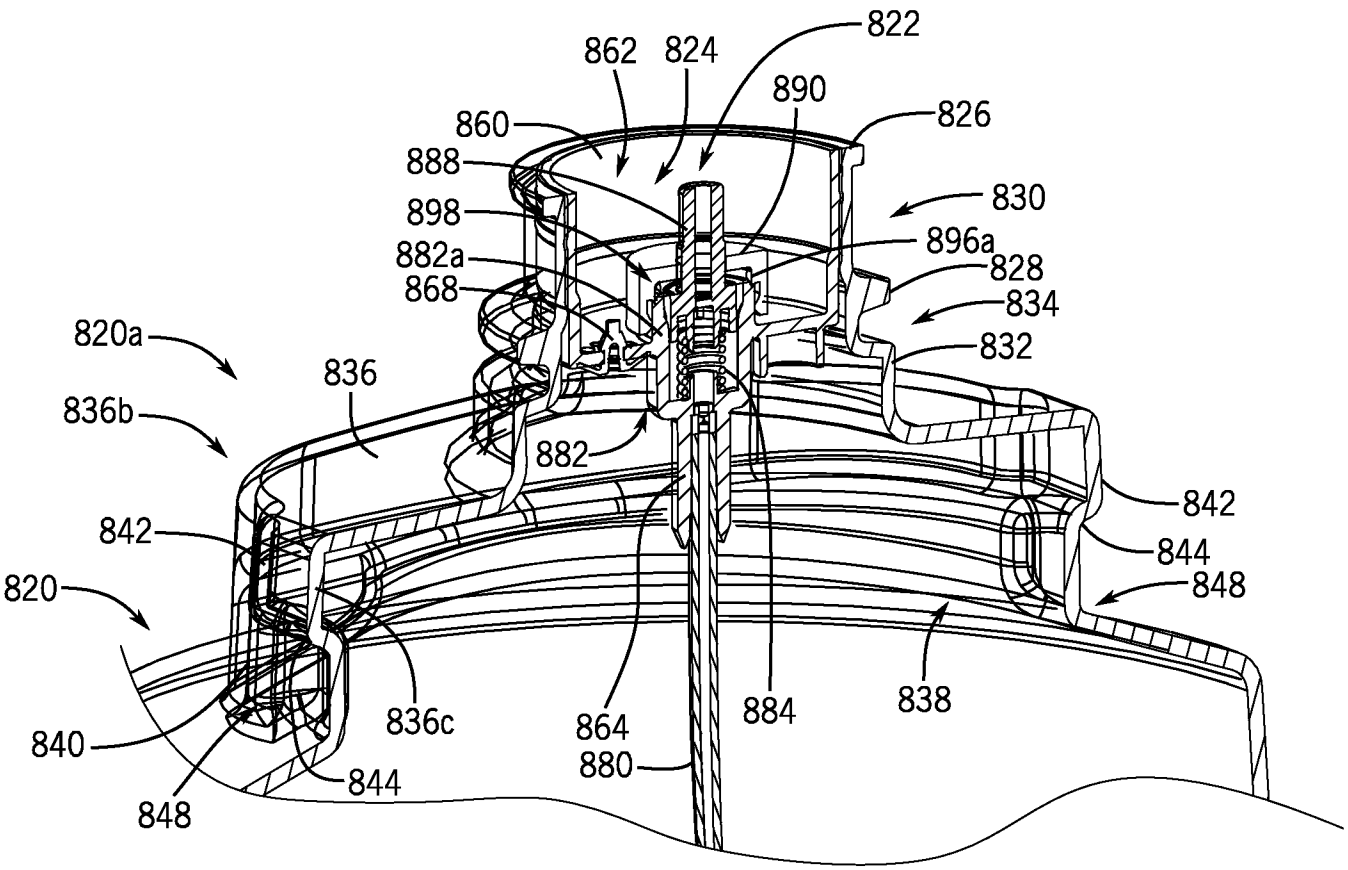
FIG. 30 is a partial, front, left, top perspective sectional view of a top portion of another embodiment of a chemical concentrate container for a mixing and dispensing system in accordance with the present disclosure, including a valve assembly.

In other embodiments, other configurations are possible. For example, FIG. 30 illustrates a top end 820*a* of a chemical concentrate container 820, with a valve assembly 822, according to another embodiment of the invention. Generally, the container 820 is configured similarly to the container 108 (see, e.g., FIG. 9) and can be used with a variety of mixing and dispensing attachments (e.g., attachments configured similarly to the attachment 102). In the embodiment illustrated, the valve assembly 822 is formed mainly from plastic components (and a metal spring), although other materials can be used.

Figure 31A:
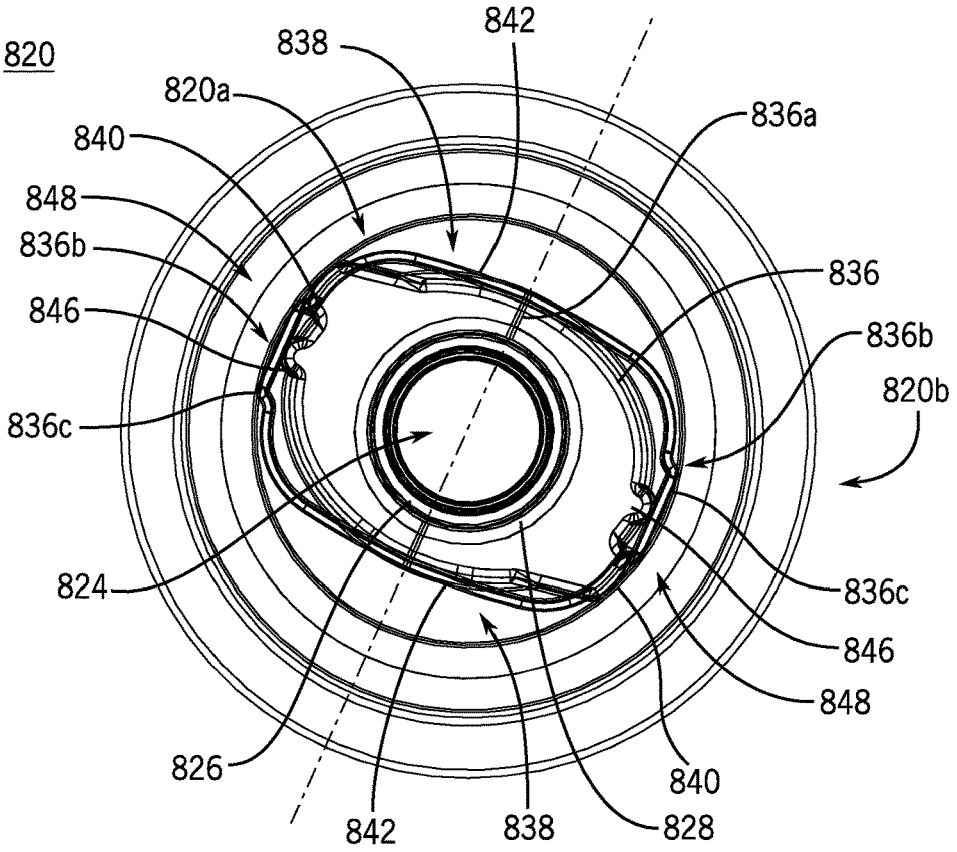
FIG. 31A is a top plan view of the chemical concentrate container of FIG. 30, without the valve assembly.
Figure 31B:
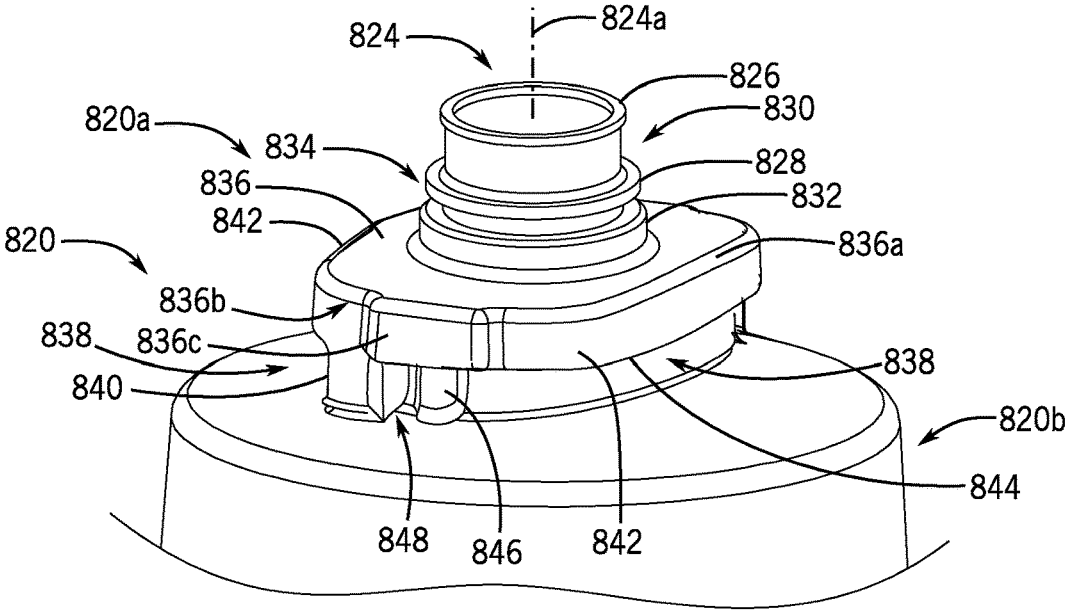
FIG. 31B is a front, left, top perspective view of the chemical concentrate container of FIG. 30, without the valve assembly.

FIGS. 31A and 31B illustrate the container 820 with the valve assembly 822 removed. Generally, the container 820 is configured with various features to facilitate attachment of the valve assembly 822 to the container 820, as well as the securing of the container 820 to a mixing and dispensing attachment (e.g., the attachment 102) for mixing and filling (or other) operations. For example, the top end 820*a* of the container 820 includes an outlet opening 824 surrounded by a radially extending flange 826. Another radially extending flange 828 is separated from the flange 826 by an annular groove 830. The flange 828 is also separated from still another radially extending flange 832 by another annular grove 834. Generally, the flanges 828 and 832 exhibit the same radial extension (e.g., from a centerline of the opening 824), which is somewhat larger than the radial extension of the flange 826.

The flange 832 includes a generally cylindrical profile that curves outwardly, near the bottom of the flange 832, to merge into an upper container face 836 of the container 820. In the embodiment illustrated, the upper container face 836 exhibits a rounded, elongate, generally rectangular geometry, with a slight downward slope from a centerline 836*a* (see FIG. 31A) to opposite edges 836*b*. At the edges 836*b*, the profile of the upper container face 836 includes a set of protrusions 836*c* that extend beyond the generally rectangular geometry noted above.

Generally below the container face 836, the container 820 includes a set of two attachment grooves 838, which are separated from each other by side wall portions 840. Each of the attachment grooves 838 generally extends below an attachment flange 842, with an attachment shelf 844 at the bottom of each attachment flange 842 extending into the respective attachment groove 838.

Near respective counterclockwise ends of the attachment grooves 838 (as viewed from above), each of the attachment grooves 838 is partially interrupted by a respective detent 846. Each detent 846 is configured as a rounded protrusion extending outwardly from the inner surface of the respective attachment groove 838 and extending vertically over substantially all of the local height of the respective attachment groove 838 (as measured vertically, from the perspective of FIG. 31B). The attachment grooves 838 continue beyond the detents 846, in the clockwise direction, to the side wall portions 840 (and the counterclockwise ends of the attachment grooves 838). At the counterclockwise sides of the detents 846, respective locking recesses 848 are thus defined, as part of the attachment grooves 838, between the detents 846 and the counterclockwise ends of the attachment grooves 838 (as defined by the side wall portions 840). Generally, the detents 846 and the locking recesses 848 are disposed below, and are overhung by, the protrusions 836*c* of the upper container face 836.

In the embodiment illustrated in FIGS. 31A and 31B, from a reference frame moving counterclockwise along the attachment grooves 838 (i.e., with regard to the top-down perspective of FIG. 31A), the shelves 844 are generally horizontal, with little or no changes in elevation, as measured relative to a lower end of the container 820 or relative to the top of the flange 826. However, due to the curvature of a top portion of a body 820*b* of the container 820, the grooves 838 generally exhibit increasing height from a perspective moving from central areas of the grooves 838 (i.e., areas near the centerline 836*a*) in either the clockwise or the counterclockwise direction. Accordingly, the attachment grooves 838 generally exhibit a maximum height near the detents 846 and the side wall portion 840, and a minimum height at or near the centerline 836*a*.

Due to the oblong configuration of the upper container face 836, portions of the attachment grooves 838 that are aligned with or otherwise near to the protrusions 836*c* of the upper container face 836 (e.g., at the location of the detents 846 and the locking recesses 848) are generally disposed a greater distance from a centerpoint of the outlet opening 824 (e.g., an intersection of a longitudinal axis 824*a* with the opening 824 (see FIG. 31B)) than are portions of the attachment grooves 838 that are aligned with or otherwise near to the centerline 836*a* of the upper container face 836. Likewise, the attachment flanges 842, and other similarly disposed features, generally extend a greater distance from a centerpoint of the outlet opening 824 at locations near the protrusions 836*c* of the upper container face 836 than at locations that are near the centerline 836*a* of the upper container face 836.

Referring again to FIG. 30, the valve assembly 822 is generally configured to selectively permit fluid flow out of the container 820, while also selectively permitting air flow into the container 820 to equalize the internal pressure of the container 820. To this end, the valve assembly 822 includes a valve housing 860 configured to seat within the outlet opening 824 of the container 820 (e.g., with a press-fit connection, an adhesive-based connection, an ultrasonic weld connection, or with other types of connections). As also illustrated in FIGS. 32A and 32B, the valve housing 860 includes a downwardly extending, generally cylindrical well 862, with an axially extending valve seat 864 that extends from within the well 862 into the interior of the container 820 when the valve housing 860 is seated in the outlet opening 824.

Figure 32B:
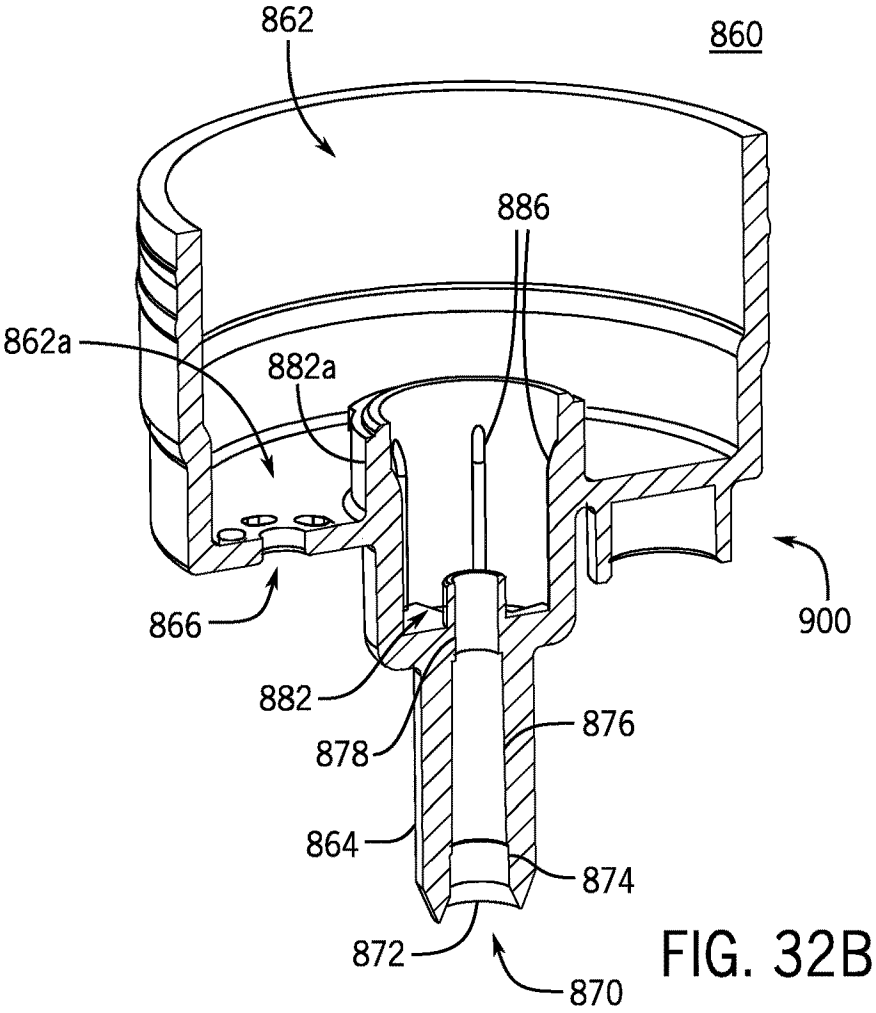
FIG. 32B is a front, left, top perspective sectional view of the valve housing of FIG. 32A, taken along line 32B-32B of FIG. 32A.
Figure 32A:
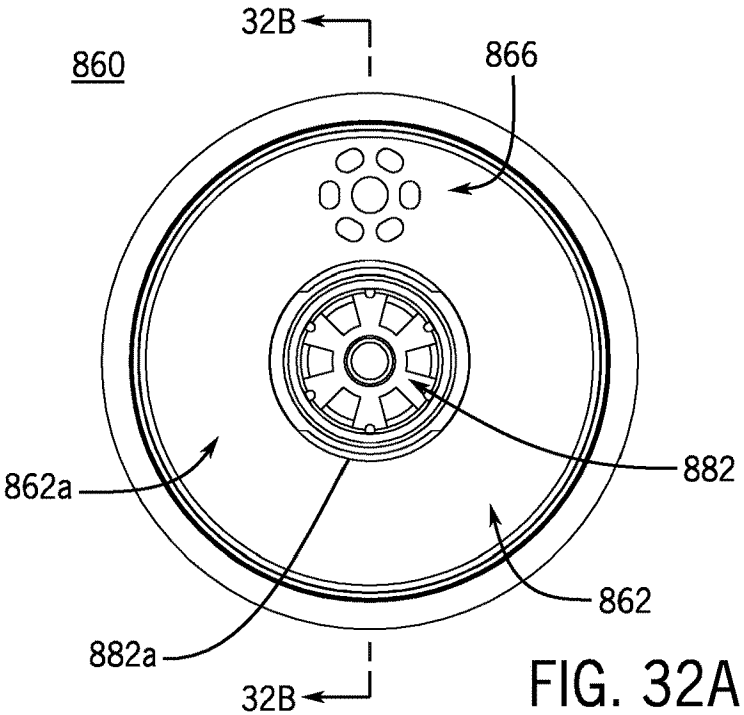
FIG. 32A is a top plan view of a valve housing for the valve assembly of FIG. 30.
Figure 32C:
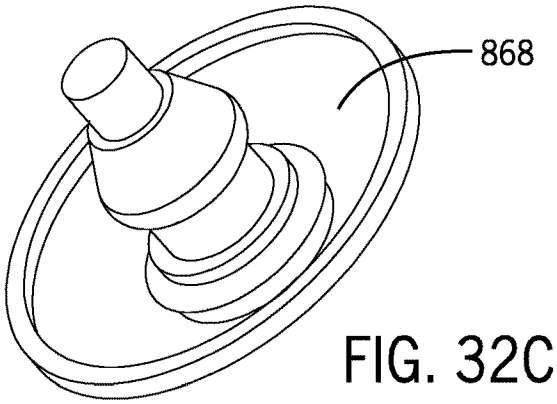
FIG. 32C is a perspective view of an umbrella valve for the valve assembly of FIG. 30.

As illustrated in particular in FIG. 32B, an annular upper wall of the valve seat 864 generally defines an annular space 862*a* within the well 862. To help equilibrate pressure within the container 820 during operation, the annular space 862*a* can include one or more features to allow air to vent into the container 820. In the embodiment illustrated, for example, the annular space 862*a* includes a set of apertures 866 configured to receive an umbrella valve, such as the umbrella valve 868 illustrated in FIG. 32C.

The valve seat 864 is generally configured to receive fluid from inside of the container 820 and appropriately direct the received fluid to a mixing and dispensing attachment. As illustrated in FIG. 32B in particular, the valve seat 864 includes, moving downstream from an inlet opening 870 (i.e., generally upwards, from the perspective of FIG. 32B), an inwardly tapered entrance 872, and first, second, and third cylindrical bores 874, 876, and 878 with successively smaller respective diameters. The tapered entrance 872 can be configured to guide a dip tube 880 (see FIG. 30) into the first cylindrical bore 874, where a restriction fit (or other connection type) can secure the dip tube 880 to the valve seat 864 and to the valve housing 860 generally.

In some embodiments, the respective diameters of one or more of the cylindrical bores 874, 876, and 878 can be selected to provide a desired mixing ratio (or range of mixing ratios) for a particular flow rate of diluent. In some embodiments, a restriction orifice (e.g., similar to the restriction orifice 438 illustrated in FIG. 15) can be provided.

In the embodiment illustrated, the third cylindrical bore 878 extends into a valve cavity 882 of the valve seat 864 to define a generally annular seat for a spring 884 (see FIG. 30) between the cylindrical bore 878 and an extended annular wall 882*a* of the valve cavity 882. Similar to the valve cavity 440 (see, e.g., FIG. 16), the valve cavity 882 includes a set of ribs 886 to generally strengthen the valve housing 860, to secure and align the spring 884 or other components, and to generally guide flow of fluid through the valve cavity 882.

A valve housing for the valve assembly 822 can also include other features. For example, as illustrated in FIG. 32B in particular, the valve housing 860 includes an annular protrusion 900 disposed generally opposite the valve seat 864 from the apertures 866. The protrusion 900 can be useful, for example, to support an alternative equalization valve, such as a vent valve (e.g., a GORE® vent), a check valve, or a duck-billed valve similar to the duck-billed valve 420 (see, e.g., FIG. 15). (Gore is a registered trademark of W. L. Gore & Associates in the United States and/or other jurisdictions.) The protrusion 900 can also be useful during manufacturing, including as a locating feature for automated assembly operations.

As illustrated in FIG. 30, in order to regulate flow of concentrate from the container 820, a valve stem 888 is inserted into the valve cavity 882 to engage the spring 884. Generally, the valve stem 888 is configured and can operate similarly to the valve stem 444 (see, e.g., FIG. 16). In the embodiment illustrated, however, a valve cap 890 is secured to the upper end of the wall 882*a* to secure the valve stem 888 within the valve cavity 882.

Figure 33A:
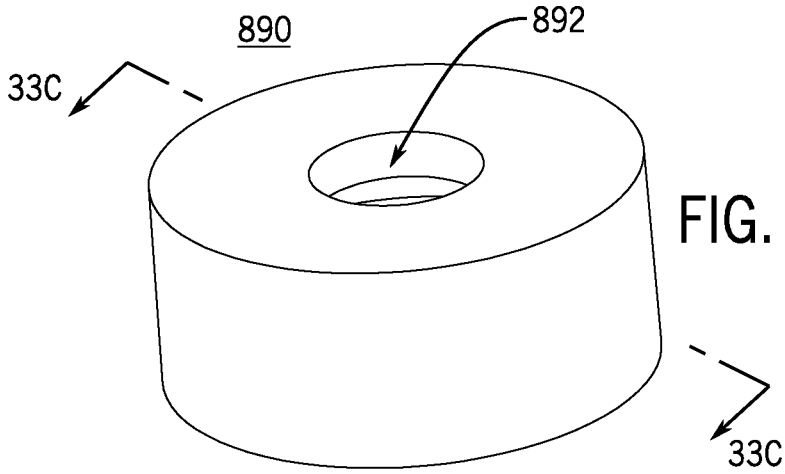
FIG. 33A is a front, left, top perspective view of a valve cap for the valve assembly of FIG. 30.
Figure 33B:
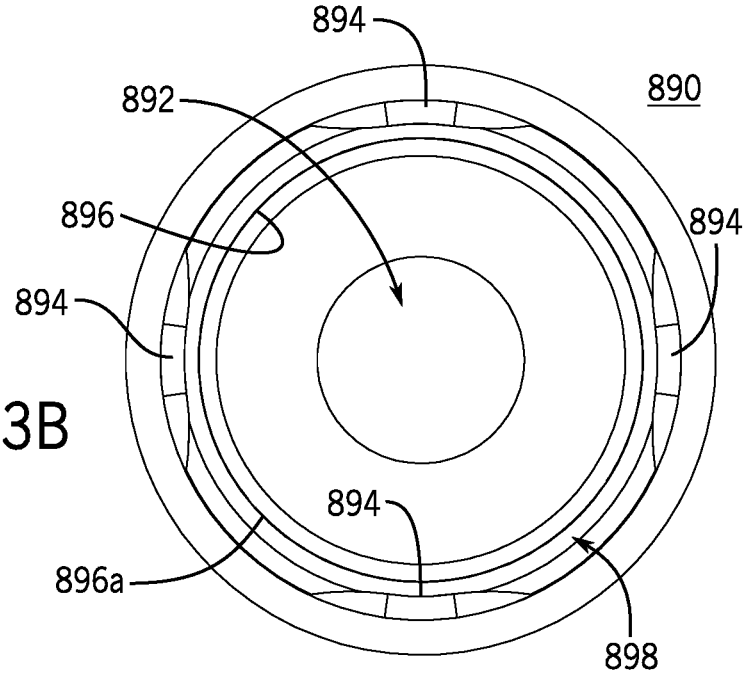
FIG. 33B is a top plan view of the valve cap of FIG. 33A.
Figure 33C:
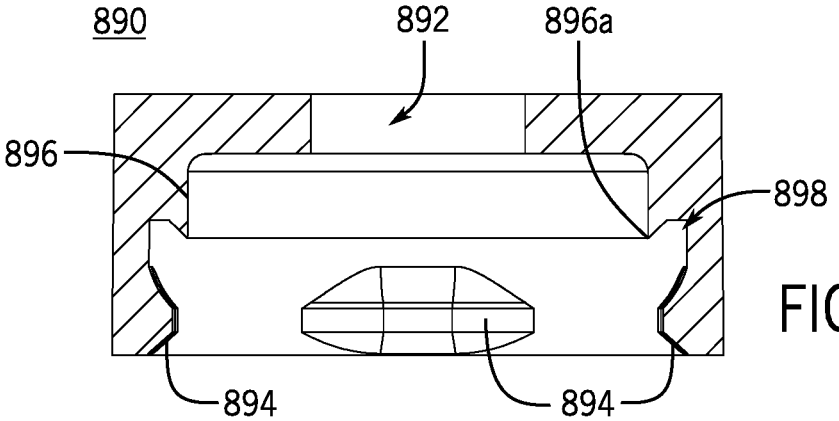
FIG. 33C is a left cross-sectional view of the valve housing of FIG. 33A, taken along line 33C-33C of FIG. 33A.

As illustrated in FIGS. 33A through 33C in particular, the valve cap 890 includes a generally annular body, with a central opening 892, and a set of angled protrusions 894 that extend radially inward within the interior of the valve cap 890 (see FIGS. 33B and 33C). The protrusions 894 exhibit tapered sides and flattened central portions, and also exhibit upper and lower tapered profiles (see FIG. 33C) to allow the protrusions 894 to be easily pressed into engagement with annular (or other) features via axially directed movement of the valve cap 890. As illustrated in FIG. 33C in particular, a retention rim 896 also extends radially inward within the interior of the valve cap 890, with an angled internal lip 896*a* that defines an annular retention groove 898.

As illustrated in FIG. 30, to secure the valve stem 888 within the valve cavity 882, the valve stem 888 is disposed in the valve cavity 882 and the valve cap 890 is placed over the valve stem 888, with an upper end of the valve stem 888 extending through the central opening 892. The valve cap 890 can then be urged axially toward the valve cavity 882, so that annular wall 882*a* of the valve cavity 882 (and of the valve seat 864, generally) seats within the retention groove 898. In this configuration, the angled lip 896*a* of the retention rim 896 engages a corresponding annular groove at the upper end of the valve seat 864, and the central portions of the protrusions 894 (see, e.g., FIG. 33B) engage the outer wall of the valve seat 864 (e.g., with a press-fit engagement). In some embodiments, the valve cap 890 can be further (or alternatively) attached using ultrasonic welding or in various other ways.

Figure 34:
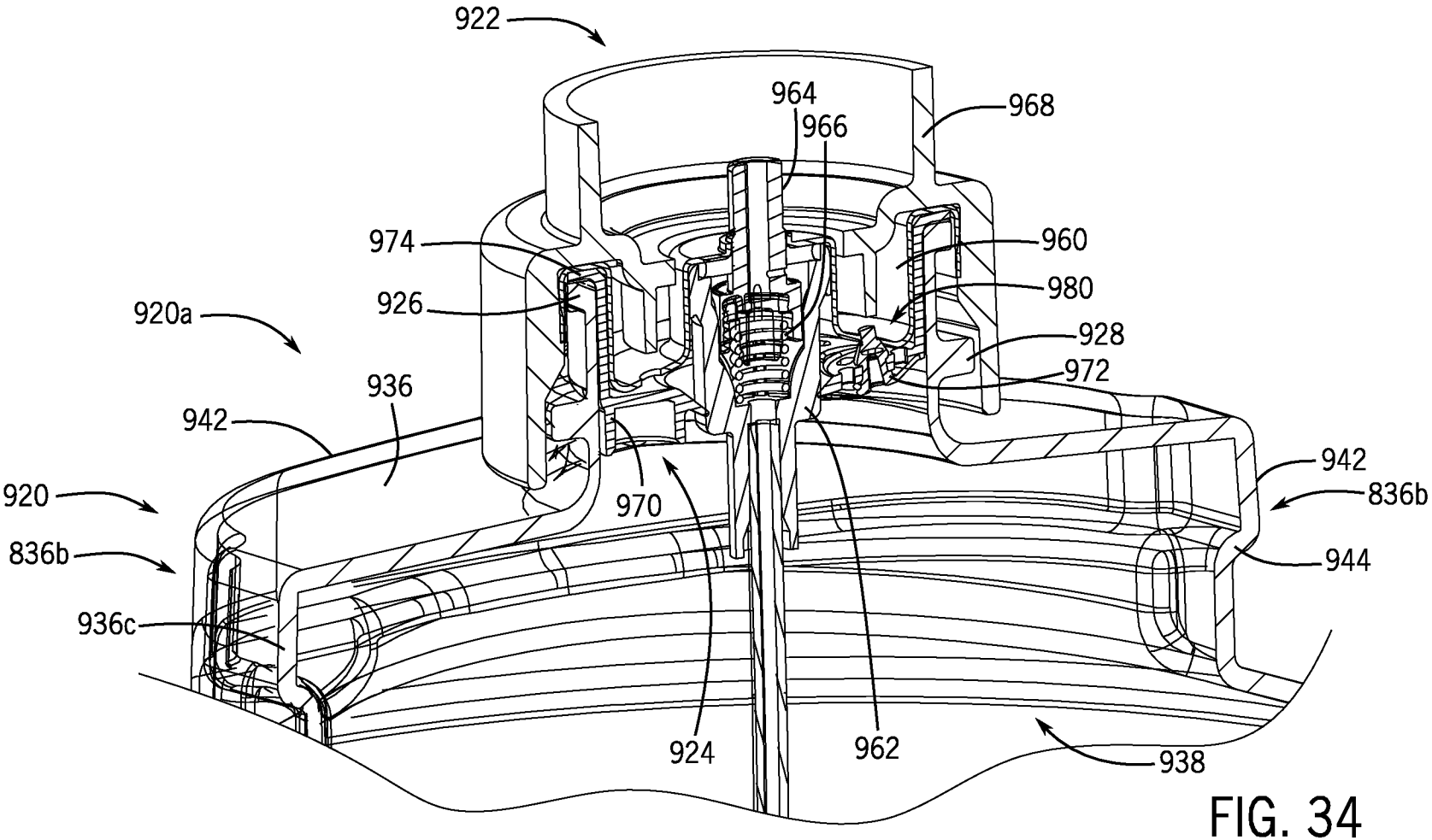
FIG. 34 is a partial, front, left, top perspective sectional view of a top portion of still another embodiment of a chemical concentrate container for a mixing and dispensing system in accordance with the present disclosure, including a valve assembly.

As another example, FIG. 34 illustrates a top end 920*a* of a chemical concentrate container 920, with a valve assembly 922, according to another embodiment of the invention. Generally, the container 920 is configured similarly to the container 108 (see, e.g., FIG. 9) and the container 820 (see, e.g., FIG. 30) and can be used with a variety of mixing and dispensing attachments (e.g., attachments configured similarly to the attachment 102).

Figure 35A:
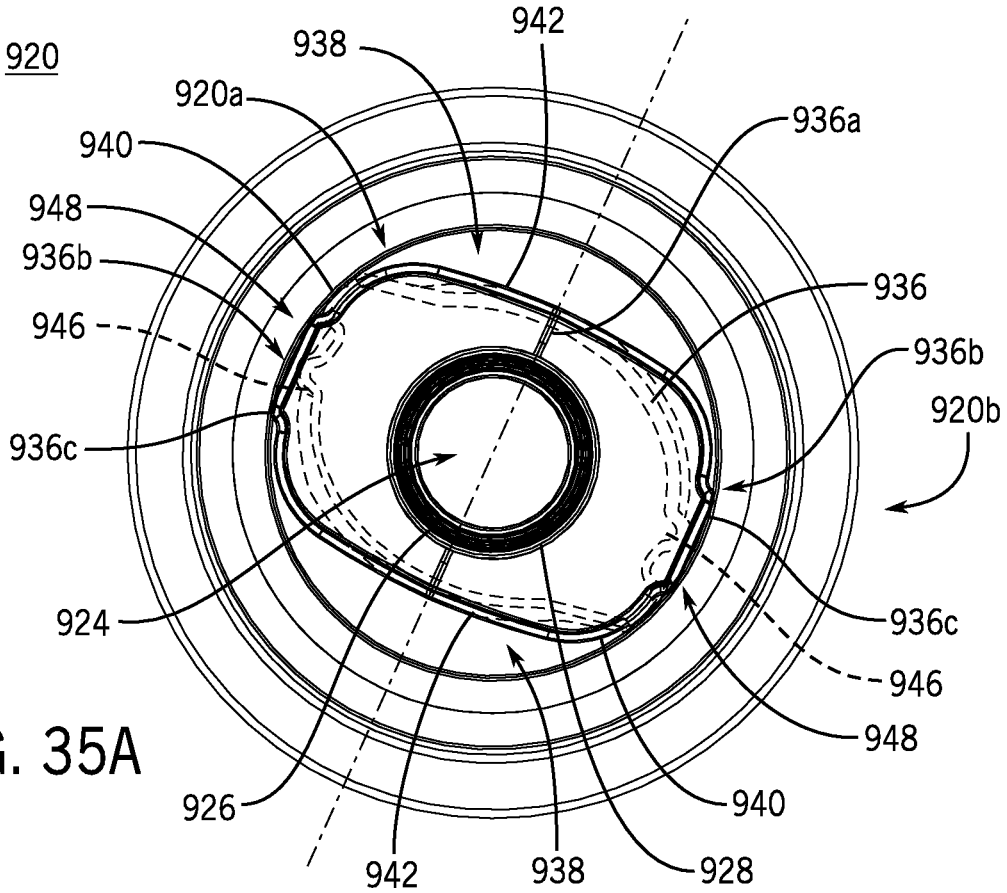
FIG. 35A is a top plan view of the chemical concentrate container of FIG. 34, without the valve assembly.
Figure 35B:
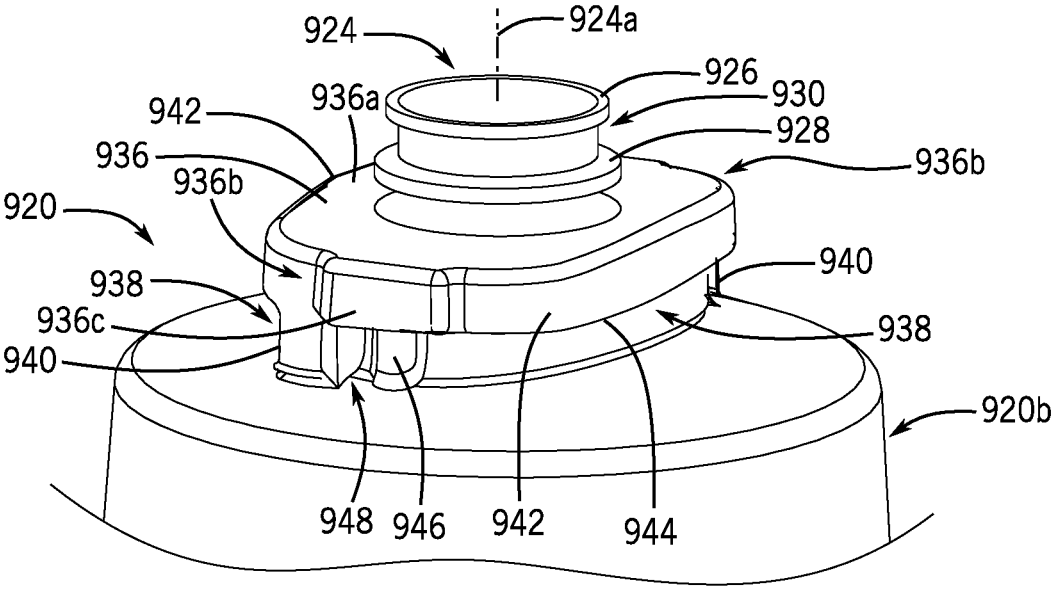
FIG. 35B is a front, left, top perspective view of the chemical concentrate container of FIG. 34, without the valve assembly.

FIGS. 35A and 35B illustrate the container 920 with the valve assembly 922 removed. Generally, the container 920 is configured with various features to facilitate attachment of the valve assembly 922 to the container 920, as well as the securing of the container 920 to a mixing and dispensing attachment (e.g., the attachment 102) for mixing and filling (or other) operations. For example, the top end 920*a* of the container 920 includes an outlet opening 924 surrounded by a radially extending flange 926. Another radially extending flange 928 is separated from the flange 926 by an annular groove 930. Generally, the flange 928 exhibits a somewhat larger radial extension than the flange 926.

Below the flange 926, another groove 932 includes a generally annular profile that curves outwardly, near the bottom of the groove 932, to merge into an upper container face 936 of the container 920. Similar to the upper container face 836, the upper container face 936 exhibits a rounded, elongate, generally rectangular geometry, with a slight downward slope from a centerline 936*a* (see FIG. 35A) to opposite edges 936*b*. At the edges 936*b*, the profile of the upper container face 936 includes a set of protrusions 936*c* that extend outside of the generally rectangular geometry noted above.

Below the container face 936, the container 920 includes a set of two attachment grooves 938, which are separated from each other by side wall portions 940. Each of the attachment grooves 938 generally extends below an attachment flange 942, with an attachment shelf 944 at the bottom of each attachment flange 942 extending into the respective attachment groove 938.

Near respective counterclockwise ends of the attachment grooves 938 (as viewed from above), each of the attachment grooves 938 is partially interrupted by a respective detent 946. Each detent 946 is configured as a rounded protrusion extending outwardly from the inner surface of the respective attachment groove 938 and extending vertically over substantially all of the local height of the respective attachment groove 938 (as measured vertically, from the perspective of FIG. 35B). The attachment grooves 938 continue beyond the detents 946, in the clockwise direction, to side wall portions 940 (and the counterclockwise ends of the attachment grooves 938). At the counterclockwise side of the detents 946, respective locking recesses 948 are thus defined, as part of the attachment grooves 938, between the detents 946 and the counterclockwise ends of the attachment grooves 938 (as defined by the side wall portions 940). Generally, the detents 946 and the locking recesses 948 are disposed below, and are overhung by, the protrusions 936*c* of the upper container face 936.

In the embodiment illustrated in FIGS. 35A and 35B, from a reference frame moving counterclockwise along the attachment grooves 938, the shelves 944 are generally horizontal, with little or no changes in elevation, as measured relative to a lower end of the container 920 or relative to the top of the flange 926. However, due to the curvature of a top portion of a body 920*b* of the container 920, the grooves 938 generally exhibit increasing height from a perspective moving from central areas of the grooves 938 (i.e., near the centerline 936*a*) in either the clockwise or the counterclockwise direction. Accordingly, the attachment grooves 938 generally exhibit a maximum height near the detents 946 and the side wall portion 940, and a minimum height at or near the centerline 936*a*.

Due to the oblong configuration of the upper container face 936, portions of the attachment grooves 938 that are aligned with or otherwise near to the protrusions 936*c* of the upper container face 936 (e.g., at the location of the detents 946 and the locking recesses 948) are generally disposed a greater distance from a centerpoint of the outlet opening 924 (e.g., an intersection of a longitudinal axis 924*a* with the opening 924 (see FIG. 35B)) than are portions of the attachment grooves 938 that are aligned with or otherwise near to the centerline 936*a* of the upper container face 936. Likewise, the attachment flanges 942, and other similarly disposed features generally extend a greater distance from a centerpoint of the outlet opening 924 at locations near the protrusions 936*c* of the upper container face 836 than at locations that are near the centerline 936*a* of the upper container face 936.

Referring again to FIG. 34, the valve assembly 922 is generally configured to selectively permit fluid flow out of the container 920, while also selectively permitting air flow into the container 920 to equalize the internal pressure of the container 920. To this end, the valve assembly 922 is configured generally similarly to the valve assembly 408 (see, e.g., FIG. 15), with a metallic valve cup 960 that can be crimped around the flange 926 of the container 920 to secure the valve assembly 922 to the container 920, and that can also receive and support a valve body 962 to hold a valve stem 964 and a spring 966. Further, a collar 968 similar to the collar 468 (see, e.g., FIGS. 17A and 17B) is configured to seat over the valve cup 960 (e.g., in press-fit engagement with the valve cup 960 at the flange 926).

Despite the noted similarities, in some aspects the valve assembly 922 differs from the valve assembly 408. For example, the valve assembly 922 includes a different arrangement to vent air into the container 920 than does the valve assembly 408 for the container 108. As illustrated in FIG. 34, for example, the valve assembly 922 includes a flexible (e.g. polymer) insert 970 configured to hold an umbrella valve 972 similar to the umbrella valve 868 (see, e.g., FIG. 32C).

Figure 36A:
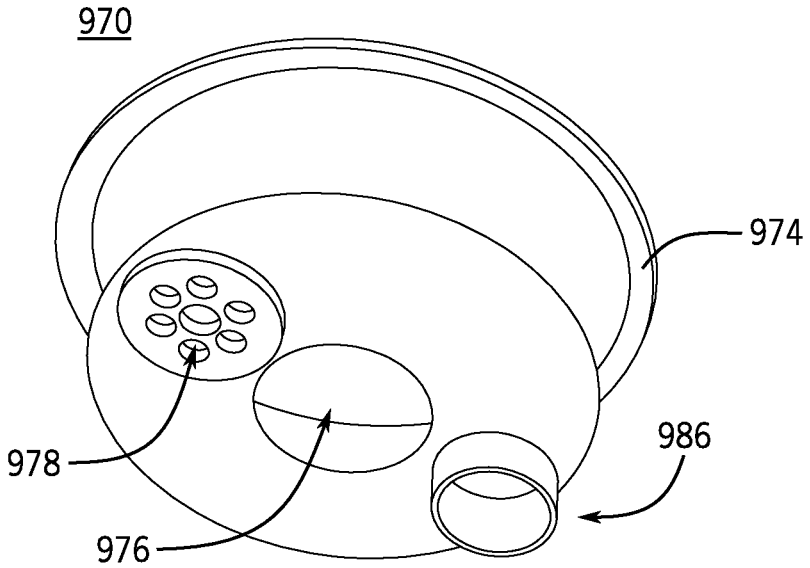
FIG. 36A is a bottom, right, front perspective view of an insert for the valve assembly of FIG. 34.

As illustrated in FIG. 36A in particular, the insert 970 generally defines a cup-shaped profile, with a radially extending flange 974, a central opening 976, and a set of apertures 978 for the umbrella valve 972 (see, e.g., FIG. 34). As illustrated in FIG. 34, when the valve assembly 922 is secured to the container 920, the flange 974 is held between the valve cup 960 and the flange 926 of the container 920, with side walls of the insert 970 generally between side walls of the valve cup 960 and the interior of the neck of the container 920, and with a bottom portion of the insert 970 generally between the bottom portion of the valve cup 960 and the interior of the container 920. To regulate airflow through the valve cup 960 and the insert 970, the umbrella valve 972 extends through a central aperture of the apertures 978 as well as through a vent aperture 980 in the valve cup 960 (see also FIG. 36A). Accordingly, when an exterior pressure sufficiently exceeds a pressure within the container 920, the umbrella valve 972 can be displaced to allow air to flow through the apertures 980 and 978 and into the container 920.

An insert for the valve assembly 922 can also include other features. For example, as illustrated in FIG. 36A in particular, the insert 970 includes an annular protrusion 986 disposed generally opposite the central opening 976 from the apertures 978. The protrusion 986 can be useful, for example, to support an alternative equalization valve, such as vent valve (e.g., a GORE® vent), a check valve, or a duck-billed valve similar to the duck-billed valve 420 (see, e.g., FIG. 15). (Gore is a registered trademark of W. L. Gore & Associates in the United States and/or other jurisdictions.) The protrusion 986 can be useful during manufacturing, including as a locating feature for automated assembly operations.

Figure 36B:
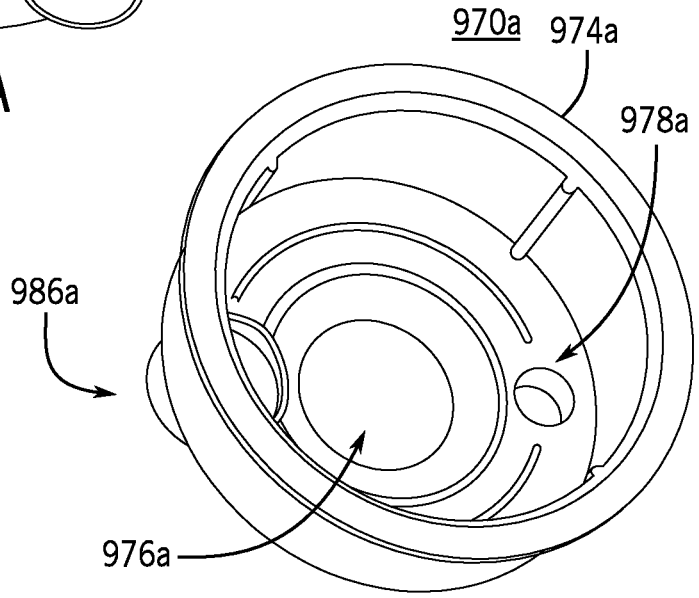
FIG. 36B is a top, left, rear perspective view of another insert for the valve assembly of FIG. 34.
Figure 37:
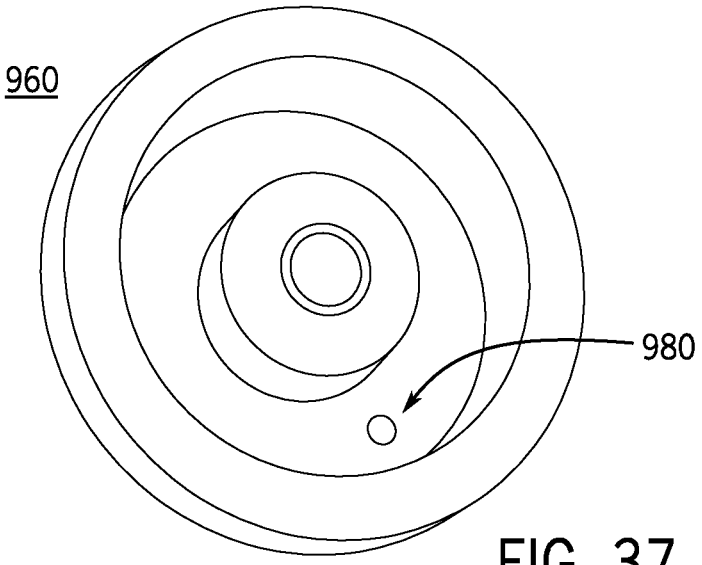
FIG. 37 is a top, left, rear perspective of a valve cup for the valve assembly of FIG. 34.

Another insert 970*a* for use with the valve assembly 922 is illustrated in FIG. 36B. The insert 970*a* is generally similar to the insert 970, with a cup-shaped profile, a radially extending flange 974*a*, a central opening 976*a*, and an annular protrusion 986*a*. Instead of a set of apertures for an umbrella valve, however, the insert 970*a* includes a single, relatively large aperture 978*a* that can receive a valve such as a check valve, a vent valve, or a duck-billed valve (not shown in FIG. 36B).

In some embodiments, the inserts 970 and 970*a* can also provide additional benefits. For example, in some embodiments, either of the inserts 970 and 970*a* can create an annular seal around the valve body 962, as well as at the flange 926, in order to prevent concentrate within the container 920 from contacting the valve cup 960 (see FIG. 34). Accordingly, the inserts 970 and 970*a* can help to protect the metal of the valve cup 960 from corrosion and similar other effects.

In the embodiment illustrated, the valve body 962 also differs somewhat from the valve body 422 (see, e.g., FIG. 16). For example, in contrast to the valve body 422, the valve body 962 does not include a restriction orifice to regulate flow from a dip tube 982 into a valve cavity 984. Nonetheless, in some embodiments, internal dimensions of the valve body 962 (or of the dip tube 982) can be selected to provide a desired mixing ratio (or range of mixing ratios) for a particular flow rate of diluent. In some embodiments, a restriction orifice can be provided.

Figure 38:
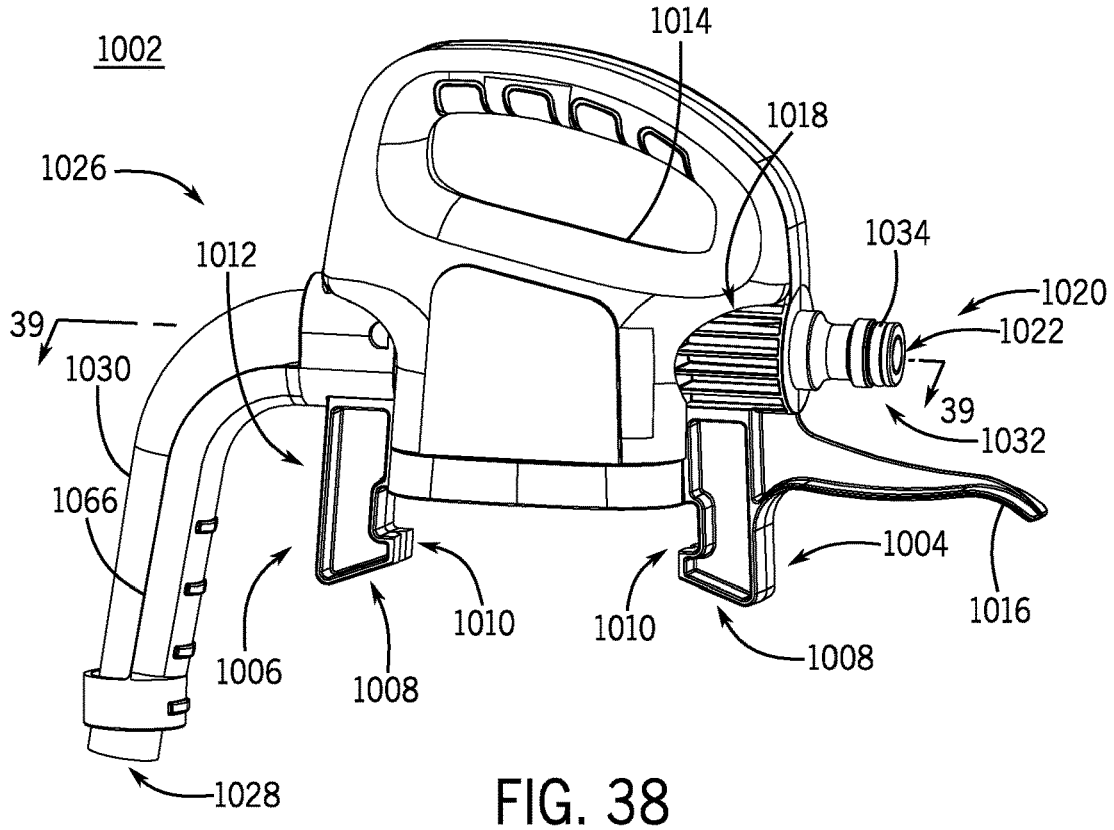
FIG. 38 is a rear, left, top perspective view of yet another mixing and dispensing attachment for a mixing and dispensing system in accordance with the present disclosure.
Figure 39:
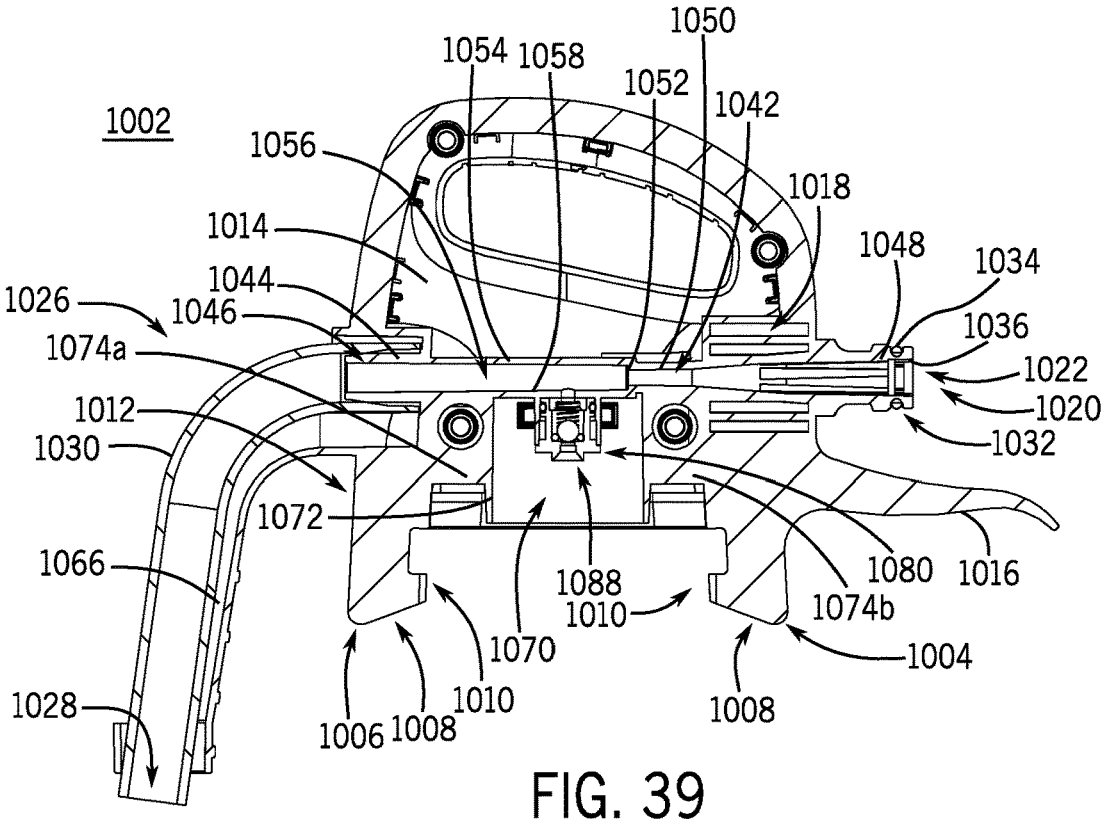
FIG. 39 is a left cross-sectional view of the mixing and dispensing attachment of FIG. 38, showing a check valve assembly, taken along line 39-39 of FIG. 38.

FIGS. 38 and 39 illustrate a mixing and dispensing attachment 1002 for use with the containers 820 and 920 (or other containers according to the invention). Generally, the attachment 1002 is configured similarly to the attachment 102 (see, e.g., FIG. 5). As such, for example, the attachment 1002 includes attachment arms 1004 and 1006 configured to securely, but removably, attach the attachment 1002 to the top ends 820*a* or 920*a* of the containers 820 or 920.

Generally, the attachment arms 1004 and 1006 are configured similarly to the attachment arms 104 and 106 (see, e.g., FIG. 5). For example, the attachment arms 1004 and 1006 generally include respective hooks 1008 with respective recesses 1010. As also discussed below, for example, the hooks 1008 and the recesses 1010 can be configured to engage the retention grooves 838 and 938 and the detents 846 and 946 of the containers 820 and 920 (see, e.g., FIGS. 31B and 35B) to secure the attachment 1002 to either of the containers 820 and 920.

In some aspects, the attachment arms 1004 and 1006 differ from the attachment arms 104 and 106. For example, the attachment arms 1004 and 1006 do not include cut-outs similar to the cut-outs 286 and 288. (see, e.g., FIG. 5)

Generally, the attachment 1002 can be formed as an integral (e.g., molded plastic) part. However, some components of the attachment 1002 can be formed separately and then assembled together. For example, the attachment 1002 includes a single-piece flow body 1012, as well as a set of separately formed covers 1014, which can be attached (e.g., screwed) to the flow body 1012. In the embodiment illustrated, the flow body 1012 includes, in addition to the flow passages and features described below, an integrally formed elongate grip 1016, which can assist an operator in holding the flow body 1012 during use. The flow body 1012 also includes a ribbed barrel 1018 generally adjacent to the grip 1016. In some embodiments, the ribbed barrel 1018 can assist an operator in holding the flow body 1012, as well as in other ways. The ribbed barrel 1018 can also be useful with regard to manufacturing. For example, the ribbed structure of the ribbed barrel 1018 can help to provide dimensional stability during manufacturing and generally improved manufacturing efficiency (e.g., in comparison to similarly arranged solid barrels).

In order to receive a diluent, such as liquid water, from a remotely disposed source, the attachment 1002 includes an inlet end 1020 with an inlet port 1022. Once received at the inlet port 1022, the diluent travels through the attachment 1002, to be mixed with concentrate drawn from a container (e.g., either of the containers 820 and 920). The resulting mixture of diluent and chemical concentrate is then dispensed from an outlet end 1026 of the attachment 1002, via an outlet port 1028 in a dispensing tube 1030. In the embodiment illustrated, the dispensing tube 1030 is somewhat longer than the dispensing tube 120 (see, e.g., FIG. 1), although other configurations are possible.

In contrast to the inlet end 110 of the attachment 102 (see, e.g., FIG. 1), the inlet end 1020 of the attachment 1002 is surrounded by an annular groove 1032 with an o-ring 1034. Accordingly, for example, a hose (not shown) can be secured to the attachment 1002 at the inlet port 1022 by seating the hose on the attachment 1002 at the inlet end 1020, in sealing engagement with the o-ring 1034.

Figure 40:
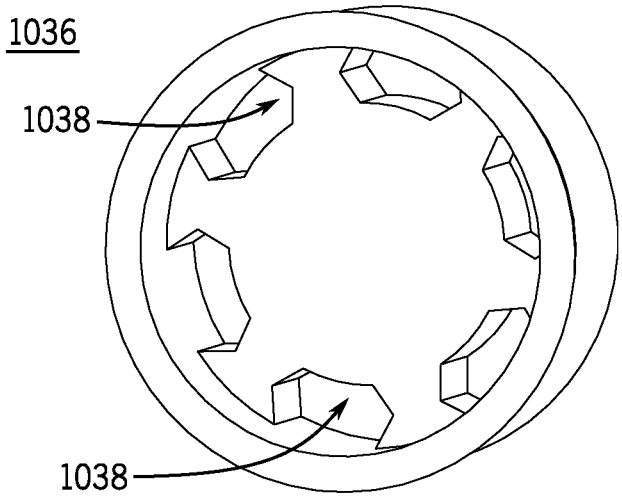
FIG. 40 is a top, right, rear perspective view of a flow regulator for the mixing and dispensing attachment of FIG. 38.

To help regulate flow from a hose (or other diluent source), a flow regulator 1036 (see FIG. 39) is disposed within the inlet end 1020 of the attachment 1002, generally downstream of the inlet port 1022. As illustrated in FIG. 40, the flow regulator 1036 is configured as a single-piece body, with an annularly arranged array of polygonal flow openings 1038. In other embodiments, other configurations are possible. Generally, the flow regulator 1036 can be press-fit (or otherwise secured) within the inlet end 1020 of the attachment 1002 (or at other locations within the attachment 1002).

Within the attachment 1002, as illustrated in FIG. 39 in particular, the inlet port 1022 is generally in communication with a primary flow passage 1042. The flow passage 1042 extends through the flow body 1012, from the inlet port 1022 to a cylindrical end coupling 1044 that defines a cylindrical flow passage outlet 1046. Immediately downstream of the inlet port 1022, the flow passage 1042 includes a shoulder 1048 (e.g., to seat the flow regulator 1036) before extending into a cylindrical channel 1050 that tapers inwardly toward a relatively small diameter portion adjacent another shoulder 1052. The shoulder 1052 generally marks the entrance to an extended cylindrical channel 1054 that generally defines a mixing chamber 1056. The cylindrical channel 1054 (and mixing chamber 1056) generally extends from the shoulder 1052 to the flow passage outlet 1046 at the end coupling 1044, and connects to a radially extending (with respect to the channel 1054) inlet passage 1058 somewhat downstream of the shoulder 1052.

To facilitate use of the attachment 1002 with a receptacle such as a bucket or other reservoir (not shown), the outlet end 1026 of the attachment 1002 includes a downwardly curving outlet trough 1066 configured to receive and support the dispensing tube 1030. The outlet trough 1066 is generally configured similarly to the outlet trough 240 (see, e.g., FIGS. 3 and 5), although the outlet troughs 1066 and 240 vary in some regards. For example, consistent with the larger length of the dispensing tube 1030, the outlet trough 1066 is generally longer than the outlet trough 240. Likewise, in contrast to the outlet trough 240, the outlet trough 1066 is not supported by a structure similar to the strut 252 that extends from the attachment arm 106 (see, e.g., FIGS. 3 and 5).

The flow passage 1042 is generally configured as a venturi tube, tending to positively accelerate fluid as the fluid moves from the inlet port 1022 toward the mixing chamber 1056. By principles of conservation of energy, the resulting increase in velocity of the fluid reduces the local pressure of the fluid as the fluid approaches the mixing chamber 1056. As described below, this reduction in pressure can be exploited to draw concentrated chemicals through the inlet passage 1058 for mixing with the diluent within the mixing chamber 1056.

Figure 41:
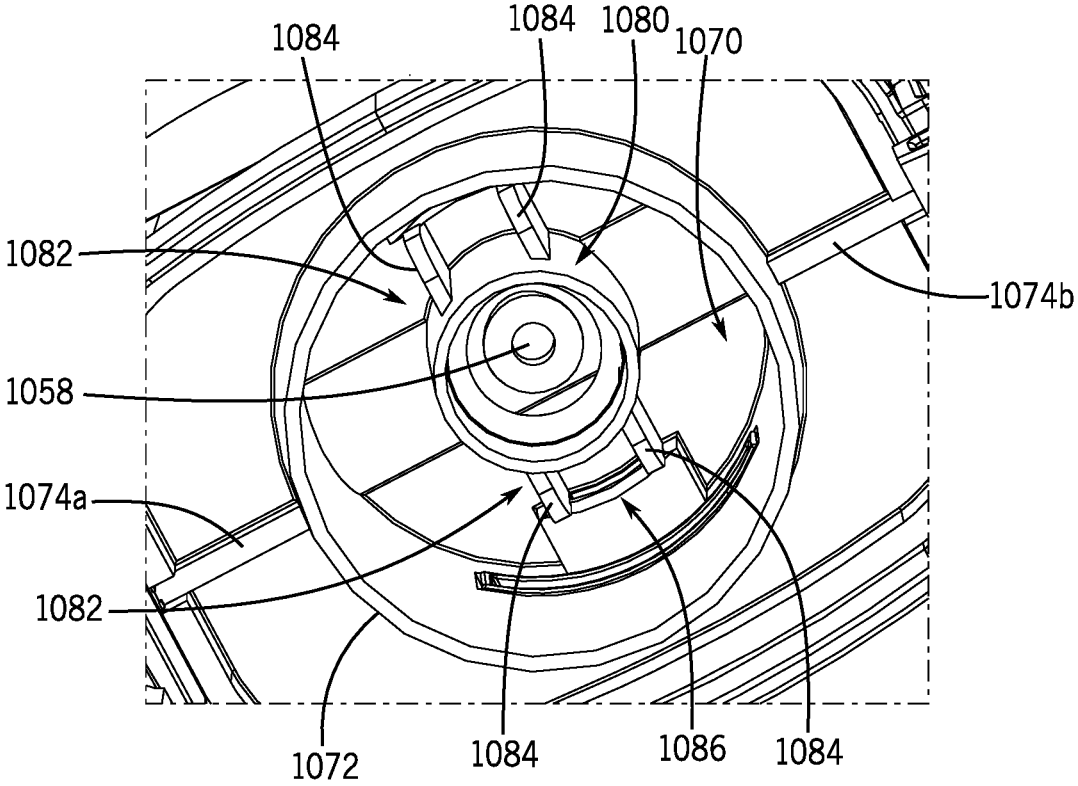
FIG. 41 is a partial bottom, left, rear perspective view of the mixing and dispensing attachment of FIG. 38, without the check valve assembly.

To help receive concentrated chemicals for mixing with the diluent, and as illustrated in particular in FIGS. 39 and 41, the flow body 1012 of the attachment 1002 contains a generally cylindrical cavity 1070, defined by a cylindrical shell 1072 that is generally supported with respect to the remainder of the flow body 1012 by a pair of ribs 1074*a* and 1074*b*. As illustrated in FIG. 41 in particular, within the cavity 1070, the flow body 1012 includes a generally cylindrical valve seat 1080 and a set of retention features 1082 that each include a pair of guide walls 1084 and a respective recess 1086 (only one recess 1086 visible in FIG. 41).

Figure 42A:
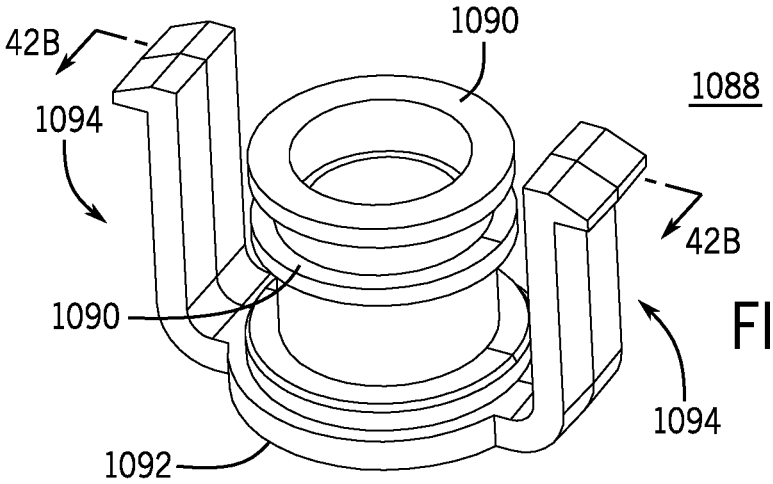
FIG. 42A is a top, left, rear perspective view of a check valve body for the check valve assembly of FIG. 39.
Figure 42B:
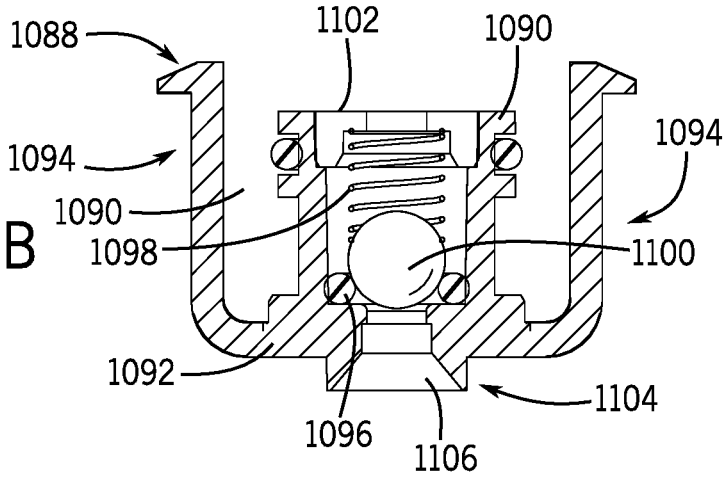
FIG. 42B is a left cross-sectional view of the check valve assembly of FIG. 39, including the check valve body of FIG. 42A, taken along line 42B-42B of FIG. 42A.

Generally, the valve seat 1080 is configured to receive and secure a check valve body (or other receiving assembly), which can receive concentrate from a container (e.g., one of the containers 820 or 920) and direct the received concentrate toward the mixing chamber 1056. As illustrated in FIGS. 42A and 42B, an example check valve body 1088 includes a generally cylindrical body portion, with a set of radially extending flanges 1090, a stepped bottom flange 1092, and a pair of hooked retention arms 1094. Check valve (or other valve) components, such as an o-ring 1096, spring 1098, and ball 1100 can be assembled within the check valve body 1088, and retained therein using a check valve body cap 1102 (see FIG. 42B), so that flow through the check valve body 1088 is generally possible only in one direction (i.e., generally upward, from the perspective of FIGS. 42A and 42B). Accordingly, the check valve body 1088, as part of the illustrated check valve assembly, can generally prevent leakage out of an attachment to which it is mounted.

Figure 42C:
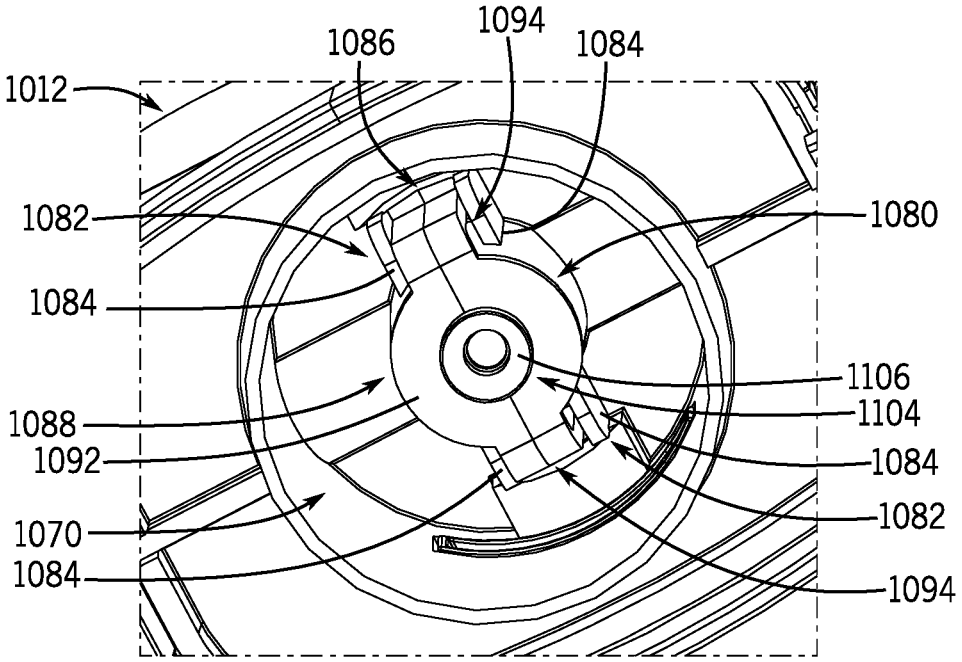
FIG. 42C is a partial bottom, left, rear perspective view of the mixing and dispensing attachment of FIG. 38, with the check valve assembly.

As illustrated in FIG. 42C in particular, with the check valve components in place, the body portion of the check valve body 1088 can be inserted into the valve seat 1080, so that the stepped bottom flange 1092 extends partly into and generally seals the open end of the valve seat 1080. With the check valve body 1088 thus disposed, the retention arms 1094 extend between the guide walls 1084 to engage the recesses 1086 on the flow body 1012 of the attachment 1002 and thereby secure the check valve body 1088 to the flow body 1012. With the check valve body 1088 thus secured, concentrate can flow into the attachment 1002 through the check valve body 1088, but leakage of fluid out of the attachment 1002 in the opposite direction is generally prevented. Further, leakage out of the attachment 1002 through the check valve body 1088 can be generally prevented whether a concentrate container is attached to the attachment 1002 or not.

Generally, the check valve body 1078 can be configured to engage a valve assembly of a container, when the container is secured to the attachment 1002, in order to allow concentrate to flow from the container into the attachment 1002. For example, as illustrated in FIGS. 42B and 42C in particular, a generally cylindrical, hollow protrusion 1104 extends axially from the bottom end of the check valve body 1088 and includes an inwardly tapered inlet 1106. As also described below, for example, the tapered inlet 1106 can engage a valve stem when a container is secured to the attachment 1002, in order to open an associated valve for flow of concentrate into the attachment 1002.

Referring again to FIG. 39, with the attachment 1002 configured as described above and placed in communication with appropriate sources of concentrate and diluent (e.g., the container 820 or 920, and a hose (not shown), respectively), diluent can flow from the inlet port 1022 through the channel 1050 to the shoulder 1052 and the mixing chamber 1056. As the diluent flows, the tapered profile of the channel 1050 can accelerate the diluent and thereby reduce its pressure, so that concentrate is drawn from the check valve body 1088 into the mixing chamber 1056 to be mixed with the diluent. The mixture of diluent and concentrate then flows along the channel 1054 toward the outlet port 1028 of the dispensing tube 1030 for use external to the attachment 1002.

Figure 43:
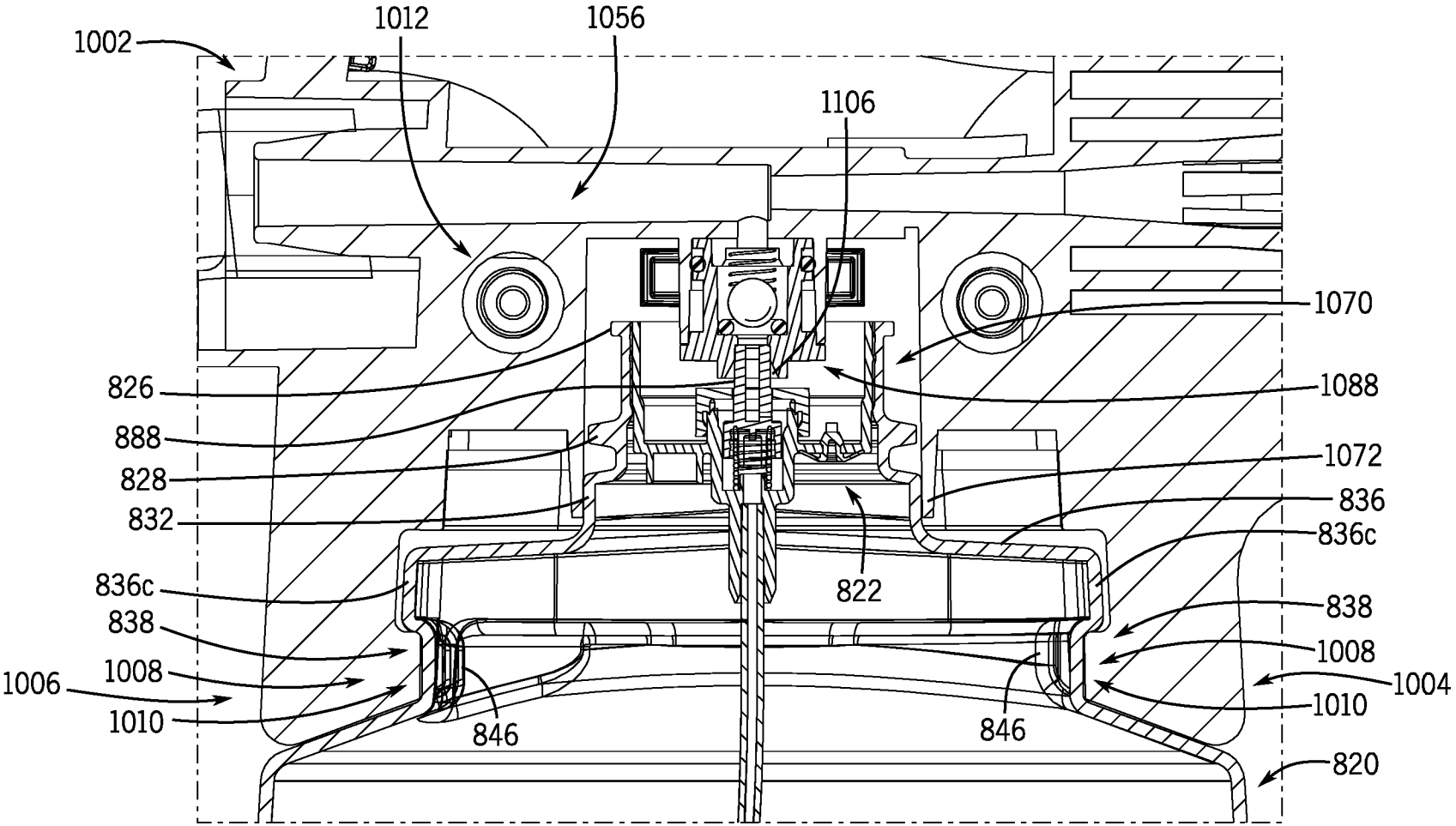
FIG. 43 is a partial left cross-sectional view of the mixing and dispensing attachment of FIG. 38 attached to the chemical concentrate container of FIG. 30, taken from a similar perspective to FIG. 39.

As illustrated in FIG. 43, to facilitate a mixing and dispensing flow of this nature, the attachment 1002 can be secured to the container 820 in a similar fashion as described above with regard to the attachment 102 and the container 108 (see, e.g., FIG. 19). For example, the attachment 1002 can first be disposed such that the attachment arms 1004 and 1006 are generally aligned with the left and right sides of the container 820 (e.g., are aligned with the centerline 836*a* of the upper container face 836 (see, e.g., FIG. 31A)). The attachment 1002 can then be moved axially toward the container 820 (or vice versa) so that valve assembly 822 of the container 820 is inserted into the cavity 1070 of the flow body 1012. With the attachment 1002 appropriately seated on the container 820, (e.g., with the attachment 1002 moved to seat the hooks 1008 on the container 820), the tapered inlet 1106 of the check valve body 1088 can accordingly engage the top of the valve stem 888 to generally depress the valve stem 888 and thereby permit flow of concentrate out of the container 820. The attachment 1002 (or the container 820) can then be rotated to seat the hooks 1008 on the arms 1004 and 1006 within the attachment grooves 838, with the hooks 1008 in general alignment with the protrusions 836*c* of the container, and with the recesses 1010 in engagement with the detents 846. Accordingly, the attachment 1002 can be securely, but removably, secured to the container 820 so that the decrease in pressure caused by diluent flowing through the flow body 1012 can draw concentrate from the container 820 into the mixing chamber 1056 for mixing and dispensing.

With the attachment 1002 secured to the container 820, the flow body 1012 is generally spaced axially apart from the upper container face 836, including at the lower end of the cylindrical shell 1072. Further, the inner surface of the cylindrical shell 1072 is generally spaced radially apart from the flanges 826, 828, and 832 of the container 820. In other embodiments, other configurations are possible. For example, the container 820 or the attachment 1002 can be configured so that an extended portion of the attachment 1002 seats on the upper container face 836, or so that one or more of the flanges 826, 828, and 832 contacts the cylindrical shell 1072 (e.g., in a press-fit engagement)

Figure 44:
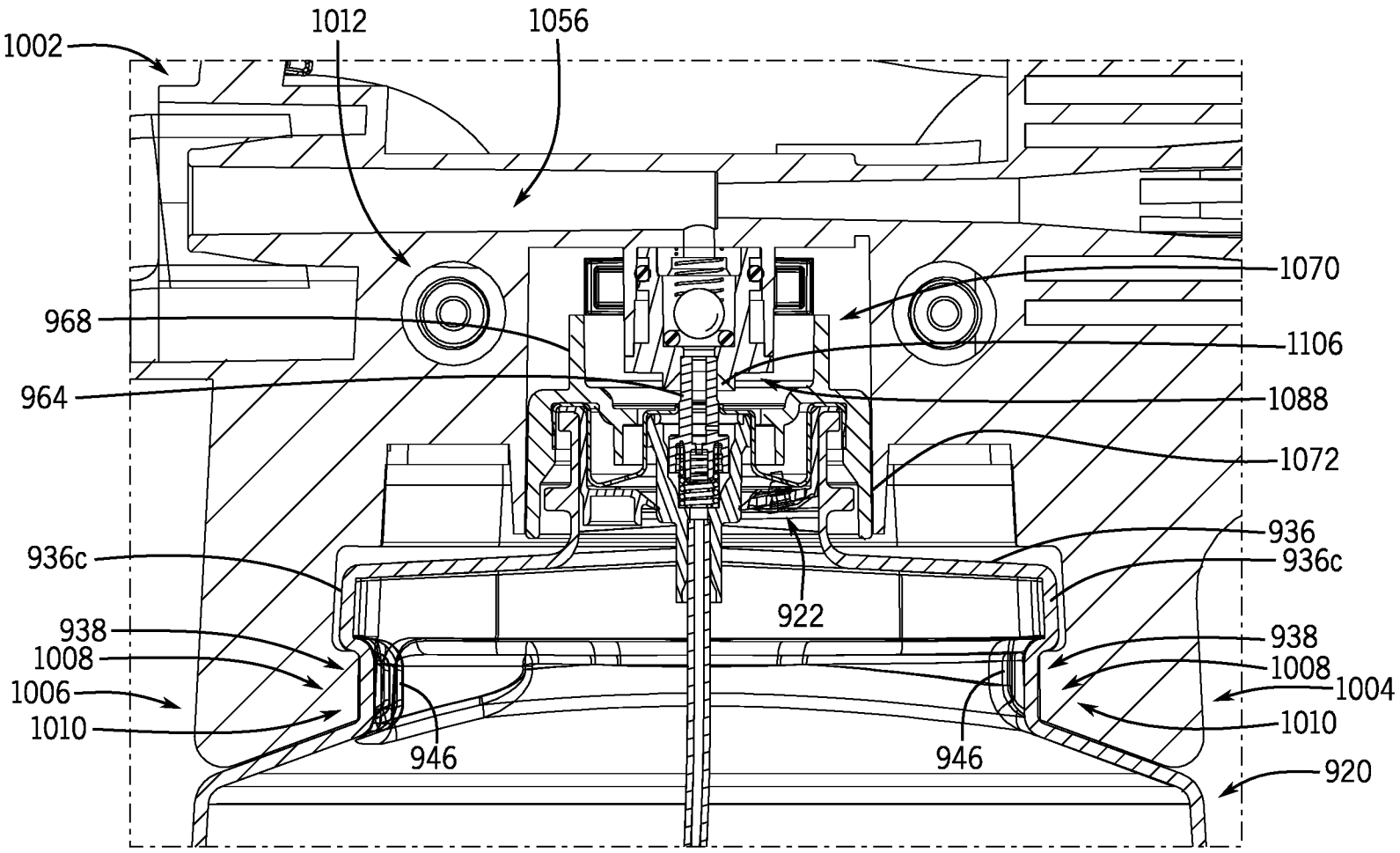
FIG. 44 is a partial left cross-sectional view of the mixing and dispensing attachment of FIG. 38 attached to the chemical concentrate container of FIG. 34, taken from a similar perspective to FIG. 39.

As another example, and as illustrated in FIG. 44, the attachment 1002 can be secured to the container 920 in a similar fashion as described above with regard to the container 820. For example, the attachment 1002 can first be rotated such that the attachment arms 1004 and 1006 are generally aligned with the left and right sides of the container 920 (e.g., are aligned with the centerline 936*a* of the upper container face 936 (see, e.g., FIG. 35A)). The attachment 1002 can then be moved axially toward the container 920 (or vice versa) so that valve assembly 922 of the container 920 is inserted into the cavity 1070 of the flow body 1012. With the attachment 1002 appropriately seated on the container 920, (e.g., with the attachment 1002 moved to seat the hooks 1008 on the container 920), the tapered inlet 1106 of the check valve body 1088 can accordingly engage the top of the valve stem 964 to generally depress the valve stem 964 and thereby allow flow of concentrate out of the container 920. The attachment 1002 (or the container 820) can then be rotated to seat the hooks 1008 on the arms 1004 and 1006 within the attachment grooves 938, with the hooks 1008 in general alignment with the protrusions 936*c* of the container, and with the recesses 1010 in engagement with the detents 946. Accordingly, the attachment 1002 can be securely, but removably, secured to the container 920 so that the decrease in pressure caused by diluent flowing through the flow body 1012 can draw concentrate from the container 920 into the mixing chamber 1056 for mixing and dispensing.

As with the container 820, with the attachment 1002 secured to the container 920, the flow body 1012 is generally spaced axially apart from the upper container face 936, including at the lower end of the cylindrical shell 1072. Further, the inner surface of the cylindrical shell 1072 is generally spaced radially apart from the collar 968 of the valve assembly 922. In other embodiments, other configurations are possible. For example, the container 920 or the attachment 1002 can be configured so that an extended portion of the attachment 1002 seats on the upper container face 936, or so that the collar 968 contacts the cylindrical shell 1072 (e.g., in a press-fit engagement).

Figure 45A:
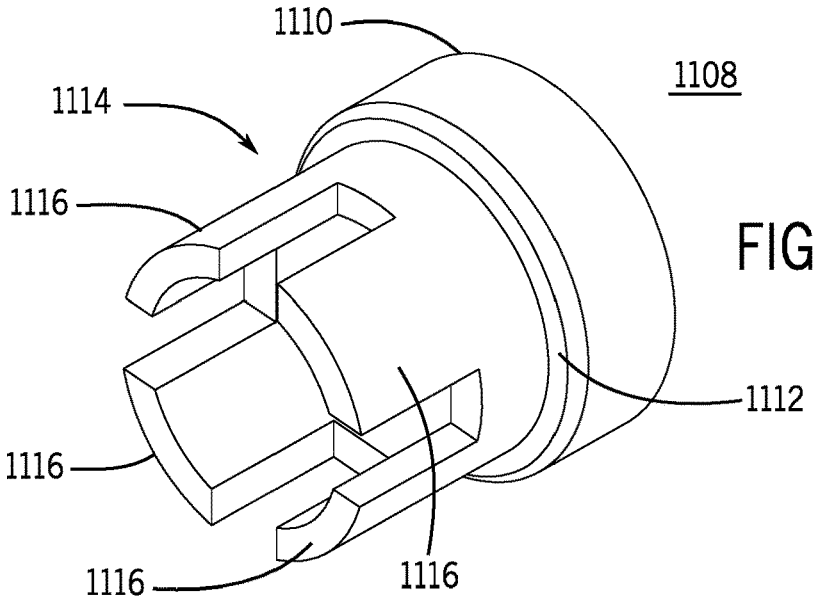
FIG. 45A is a bottom, left, rear perspective view of a check valve body cap for use with the check valve assembly of FIG. 39.
Figure 45B:
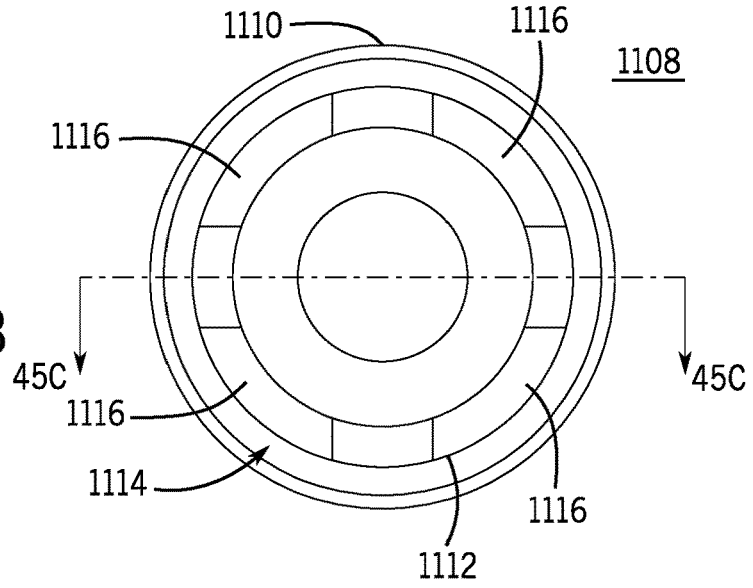
FIG. 45B is a bottom plan view of the check valve body cap of FIG. 45A.
Figure 45C:
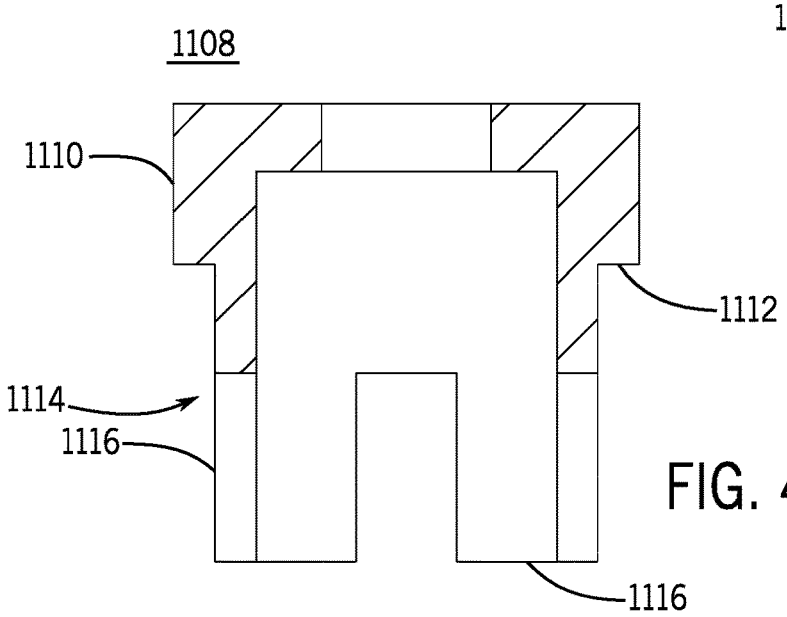
FIG. 45C is a right cross-sectional view of the check valve body cap of FIG. 45A, taken along line 45C-45C of FIG. 45B.

In other embodiments, other configurations are possible. For example, in some embodiments, a check valve body cap 1108 illustrated in FIGS. 45A through 45C can be used in place of the check valve body cap 1102 (see FIG. 42B), or in other check valve assemblies. The check valve body cap 1108 generally includes an annular base 1110 and a shoulder 1112 similar to the check valve body cap 1102. However, the check valve body cap 1108 additionally includes a generally annular skirt 1114 divided toward a free end of the skirt 1114 into discrete skirt posts 1116. In some embodiments, the skirt posts 1116 can help to further retain a check spring, a ball, or an o-ring (e.g., the spring 1098, the ball 1100, or the o-ring 1096 of FIG. 42B) in appropriate positions within the relevant check valve assembly.

Figure 46A:
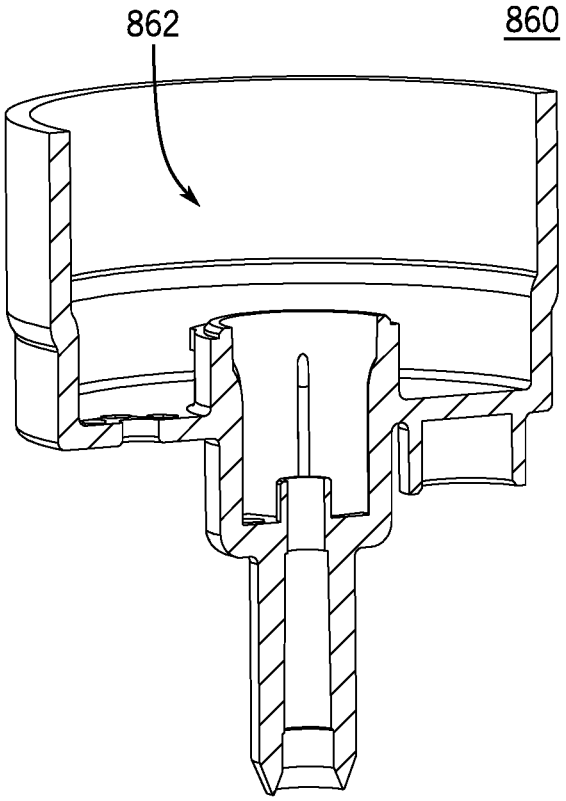
FIG. 46A is another a front, left, top perspective sectional view of the valve housing of FIG. 30, taken from a similar perspective to FIG. 32B.

In different embodiments, valve housings for valve assemblies can be configured to engage containers in different ways. In one embodiment, as illustrated in FIG. 46A, an outer wall of the well 862 of the valve housing 860 (see also FIGS. 30, and 32A-32C) is generally smooth, with a relatively small reduction in outer diameter toward a lower end of the well 862. This can allow for relatively easy insertion of the valve housing 860 into an outlet opening of a container (see, e.g., the outlet opening 824 in FIG. 30), with the reduced diameter portion of the outer wall of the well 862 serving as a locating feature during an initial alignment of the valve housing 860 and the outlet opening.

Figure 46B:
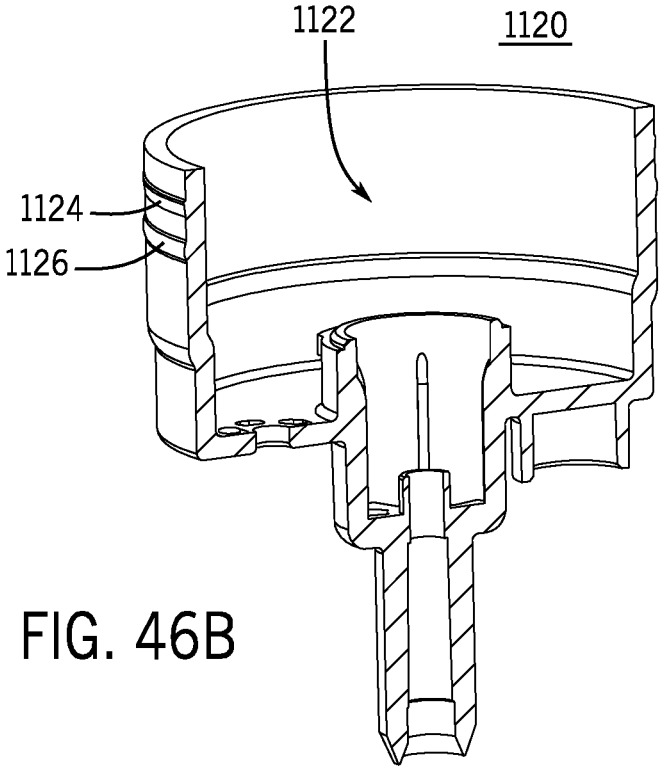
FIG. 46B is a front, left, top perspective sectional view of another valve housing, taken along a line similar to line 32B-32B of FIG. 32A.

In another embodiment, as illustrated in FIG. 46B, a valve housing 1120 is configured generally similarly to the valve housing 860. For example, similarly to the valve housing 860, a lower end of an outer wall of a well 1122 of the valve housing 1120 includes a relatively small reduction in diameter, which can serve as a locating feature during assembly. In contrast to the valve housing 860, however, the valve housing 1120 includes a squared annular rib 1124 and a rounded annular rib 1126 on the outer wall of the well 1122. These two ribs 1124 and 1126 can help to securely retain the valve housing 1120 within the relevant container opening.

As also discussed above, aspects of the flow path of liquids within the disclosed mixing and dispensing system can be used in order to provide a desired mixing ratio (or mixing ratios) for operations involving a particular diluent, a particular diluent flow rate, and a particular concentrate composition. In some embodiments, effective flow areas can be varied (e.g., locally restricted) in valve stems, flow passages (e.g., dip tubes), and other features, in order to provide a particular pressure drop for a particular fluid flow, and thereby control a corresponding mixing ratio. In some embodiments, inserts for one or more flow passages can be used in order to provide appropriate flow restrictions.

Figure 47A:
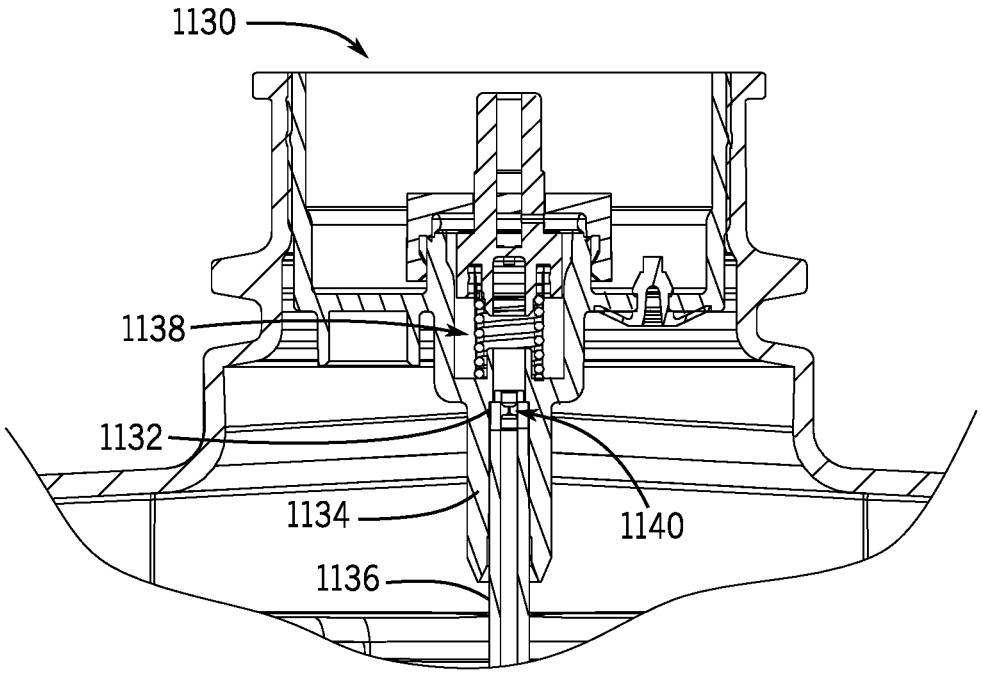
FIG. 47A is a partial right sectional view of a top portion of another embodiment of a chemical concentrate container for a mixing and dispensing system in accordance with the present disclosure, including a valve assembly.
Figure 47B:
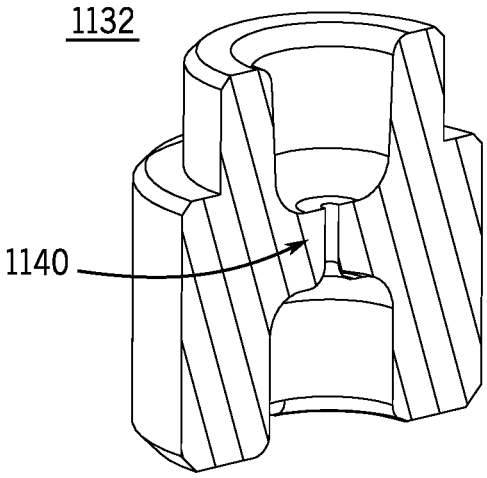
FIG. 47B is a top, right, front sectional view of a restriction-orifice insert for use with the valve assembly of FIG. 47A.

As illustrated in FIG. 47A, for example, a valve assembly 1130 is configured generally similarly to the valve assembly 822 (see, e.g., FIG. 30). In contrast to the valve assembly 822, however, a restriction-orifice insert 1132 is disposed within an inlet flow passage of a valve housing 1134 of the valve assembly 1130, between a dip tube 1136 and a valve cavity 1138 of the valve housing 1134. In some embodiments, a restriction orifice 1140 of the restriction-orifice insert 1132, illustrated in particular in FIG. 47B, can provide a minimum-diameter flow restriction for flow of concentrate into and through the valve assembly 1130 and thereby help to determine the resulting mixing ratio for the concentrate.

Generally, a restriction orifice such as the restriction orifice 1140 can have a reduced diameter, relative to adjacent flow passages, with any of a variety of sizes, depending on the desired mixing ratio for a given composition of a cleaning concentrate (or other concentrate) and a given diluent flow rate. In some embodiments, the restriction orifice has an inner diameter in the range of 0.07 millimeters to 0.7 millimeters (0.003 to 0.028 inches). In various embodiments, the restriction orifice 1140 (or another restriction in a relevant flow path) can provide a chemical to diluent mixing ratio of 1:15, a mixing ratio of 1:32, a mixing ratio of 1:64, or other mixing ratios, including ratios up to and exceeding 1:1000, 1:1600, or 1:2500.

In some embodiments, other types of effective flow restrictions can be used to help provide a desired mixing ratio. For example, the length of a dip tube (e.g., the dip tube 1136) can be selected in order to provide a desired pressure drop, for a particular concentrate composition and diluent flow rate.

Thus, the present disclosure provides an improved system and attachment for mixing and dispensing cleaning and other solutions. Among other benefits, the disclosed system and attachment can provide a partially re-usable and partially disposable system, operates without the need to store water or other diluent within the system, and provides for high flow rates with high mixing ratio accuracy. Further, various of the attachments can exhibit unitary construction, as may be useful for durability and ease of manufacturing and assembly.

Although the present invention has been described in detail with reference to certain embodiments, one skilled in the art will appreciate that the present invention can be practiced by other than the described embodiments, which have been presented for purposes of illustration and not of limitation. Therefore, the scope of the invention should not be limited to the description of the embodiments contained herein.

INDUSTRIAL APPLICABILITY

The present invention provides a mixing and dispensing system for mixing a chemical with a diluent and distributing a mixture of the chemical and the diluent. The system includes an attachment and a container, along with a valve assembly and related components for use with the container.

All documents cited in the Detailed Description of the Invention are, in relevant part, incorporated herein by reference; the citation of any document is not to be construed as an admission that it is prior art with respect to the present invention.

We claim:

1. A container for use with an attachment for mixing and dispensing a solution, the container comprising:

an outlet opening for flow out of the container;

a container valve that is configured to control the flow out of the outlet opening; and an oblong neck that includes a first attachment flange and a second attachment flange that are configured to secure the attachment to the container, the first attachment flange at least partly defining a first attachment groove and the second attachment flange at least partly defining a second attachment groove, and each of the first and second attachment grooves including a respective locking protrusion and a respective locking recess that are configured to secure the attachment to the container.

2. The container of claim 1, wherein the first and second attachment flanges extend farther from the outlet opening along a first axis of the oblong neck than along a second axis of the oblong neck.

3. The container of claim 1, for use with hooks on the attachment, wherein the first and second attachment grooves are configured to receive the hooks to secure the attachment to the container.

4. The container of claim 3, wherein each of the first and second attachment grooves exhibits a varying height along a respective circumferential portion of the oblong neck.

5. The container of claim 4, wherein each of the first and second attachment grooves exhibits a respective minimum height along a wider portion of the oblong neck and a respective maximum height along a narrower portion of the oblong neck.

6. The container of claim 4, further comprising:

a container face that is opposite the first and second attachment grooves from the first and second attachment flanges;

wherein a first attachment shelf extends on the first attachment flange along the first attachment groove and a second attachment shelf extends on the second attachment flange along the second attachment groove;

wherein the first and second attachment shelves are configured to engage the hooks to secure the attachment to the container; and wherein each of the first and second attachment shelves extends substantially in parallel with a respective opposing portion of the container face.

7. The container of claim 1, wherein the first and second attachment flanges at least partly define a container face with a generally rectangular geometry.

8. The container of claim 7, wherein a first protrusion and a second protrusion of the oblong neck extend outside of the generally rectangular geometry at opposing ends of the container face.

9. The container of claim 8, wherein the first attachment groove exhibits a maximum height in alignment with the first protrusion; and wherein the second attachment groove exhibits a maximum height in alignment with the second protrusion.

10. The container of claim 3, wherein each of the locking protrusions is configured to engage a notch on a respective one of the hooks.

11. The container of claim 1, wherein the locking recess of the first attachment groove is disposed between the locking protrusion of the first attachment groove and a first wall of the oblong neck that separates the first attachment groove from the second attachment groove; and wherein the locking recess of the second attachment groove is disposed between the locking protrusion of the second attachment groove and a second wall of the oblong neck that separates the second attachment groove from the first attachment groove.

12. A container for use with an attachment for mixing and dispensing a solution, the attachment including a first hook and a second hook, the container comprising:

a neck with an outlet opening for flow out of the container;

a container valve that is configured to control the flow out of the outlet opening;

a first attachment flange that at least partly defines a first attachment groove to receive the first hook; and a second attachment flange that at least partly defines a second attachment groove to receive the second hook;

the first and second attachment flanges defining a generally rectangular geometry around the outlet opening, with:

the first and second attachment flanges extending a first distance from the outlet opening at first opposing sides of the neck;

the first and second attachment flanges extending a second distance from the outlet opening at second opposing sides of the neck, the second distance being smaller than the first distance; and the container further including a first protrusion and a second protrusion that extend outside of the generally rectangular geometry at the first opposing sides of the outlet opening; and each of the first and second attachment grooves including a respective detent that is aligned with a respective one of the first and second protrusions and is configured to engage a respective one of the first and second hooks.

13. The container of claim 12, wherein each of the first and second attachment grooves exhibits a varying height along a respective portion of the first and second attachment flanges.

14. The container of claim 13, wherein each of the first and second attachment grooves exhibit a respective maximum height at the first opposing sides of the neck.

15. A container for use with an attachment for mixing and dispensing a solution, the attachment including a first hook and a second hook, the container comprising:

an outlet opening for flow out of the container;

a container valve that is configured to control the flow out of the outlet opening; and a neck that defines a first attachment shelf and a second attachment shelf;

the first and second attachment shelves defining a first container width along a first axis of the neck and a second container width, smaller than the first container width, along a second axis of the neck;

the first attachment shelf at least partly defining a first attachment groove and the second attachment shelf at least partly defining a second attachment groove; and each of the first and second attachment grooves including a respective locking protrusion that is configured to engage a respective one of the first and second hooks to secure the attachment to the container.

16. The container of claim 15, wherein the first attachment shelf extends to a first protrusion aligned with the first axis of the neck; and wherein the second attachment shelf extends to a second protrusion aligned with the first axis of the neck.

17. The container of claim 16, wherein a first of the locking protrusions is aligned with the first protrusion and a second of the locking protrusions is aligned with the second protrusion.

18. The container of claim 16, wherein the neck includes a container face with a generally rectangular geometry; and wherein the first and second protrusions extend outside of the generally rectangular geometry along the first axis of the neck.

* * * * *